US006550739B1

(12) United States Patent
Brindisi

(10) Patent No.: US 6,550,739 B1
(45) Date of Patent: Apr. 22, 2003

(54) ADJUSTABLE MOUNTING DEVICE

(75) Inventor: Thomas J. Brindisi, Studio City, CA (US)

(73) Assignee: HangGlider Partners, Venice, CA (US)

( * ) Notice: Subject to any disclaimer, the term of this patent is extended or adjusted under 35 U.S.C. 154(b) by 0 days.

(21) Appl. No.: 09/708,894

(22) Filed: Nov. 7, 2000

Related U.S. Application Data

(63) Continuation-in-part of application No. 09/396,249, filed on Sep. 15, 1999, now abandoned, which is a continuation-in-part of application No. 09/263,156, filed on Mar. 5, 1999, now Pat. No. 6,241,210.

(51) Int. Cl.[7] ..... A47E 1/24
(52) U.S. Cl. ..... 248/476; 248/496
(58) Field of Search ..... 248/316.3, 476, 248/485, 489, 480, 495, 493, 496

(56) References Cited

U.S. PATENT DOCUMENTS

| | | | | |
|---|---|---|---|---|
| 28,174 | A | 5/1860 | Hochstrasser | 248/215 |
| 309,980 | A | 12/1884 | Poposkey | 248/495 |
| 371,124 | A | 10/1887 | Croom | 248/295 |
| 1,017,174 | A | 2/1912 | Sander et al. | 248/48.1 |
| 1,209,582 | A | 12/1916 | Hoernegel | 248/490 |
| 1,432,206 | A | 10/1922 | Poole, Jr. | 248/476 |
| 1,887,159 | A | 11/1932 | Knight | 210/146 |
| 1,908,200 | A | 5/1933 | Webster | 248/495 |
| 2,056,078 | A | 9/1936 | Slater | 248/243 |
| 2,117,714 | A | 5/1938 | Funk | 248/274 |
| 2,448,588 | A | 9/1948 | Greenberg | 248/495 |
| 2,478,256 | A | 8/1949 | Eysmann | 248/496 |
| 2,723,096 | A | 11/1955 | Schwartz | 248/495 |
| 2,740,603 | A | 4/1956 | Wofford | 248/494 |
| 2,757,890 | A | 8/1956 | Sutton et al. | 248/494 |
| 2,791,388 | A | 5/1957 | Hirt | 248/495 |
| 2,898,064 | A | 8/1959 | Scott | 248/496 |
| 2,943,831 | A | 7/1960 | Goss | 248/495 |
| 2,975,994 | A | 3/1961 | Goss | 248/496 |
| 3,019,709 | A | 2/1962 | Teason | 88/84 |
| 3,063,666 | A | 11/1962 | Morrison | 248/496 |
| 3,112,912 | A | 12/1963 | Alvarez | 248/223 |
| 3,268,195 | A | 8/1966 | Hoffman | 248/225 |
| 3,285,549 | A | 11/1966 | Cook | 248/495 |
| 3,330,525 | A | 7/1967 | Weinstein | 248/496 |
| 3,360,229 | A | 12/1967 | Beyer | 248/496 |
| 3,591,013 | A | 7/1971 | Von Herrman | 211/50 |
| 3,838,842 | A | 10/1974 | McCracken | 248/476 |
| 3,895,775 | A | 7/1975 | Norton | 248/476 |
| 3,945,599 | A | 3/1976 | Spier et al. | 248/476 |
| 4,141,117 | A | 2/1979 | Van Gompel | 24/136 |
| 4,220,309 | A | 9/1980 | Eisen et al. | 248/542 |
| 4,222,544 | A | 9/1980 | Crowder | 248/495 |
| 4,278,224 | A | 7/1981 | Arakawa | 248/246 |
| 4,364,538 | A | 12/1982 | Tomlinson | 248/495 |
| 4,530,482 | A | 7/1985 | Berinson | 248/475.1 |
| 4,549,713 | A | 10/1985 | Magadini | 248/495 |
| 4,557,455 | A | 12/1985 | Benjamin | 248/496 |
| 4,611,779 | A | 9/1986 | Leonard, Jr. | 248/476 |
| 4,641,807 | A | 2/1987 | Phillips | 248/480 |
| 4,656,698 | A | 4/1987 | Arakawa | 24/136 |
| 4,736,855 | A | 4/1988 | Arakawa | 211/94 |
| 4,786,022 | A | 11/1988 | Grieshaber | 248/287 |
| 4,863,135 | A | 9/1989 | Mellor et al. | 248/328 |
| 4,883,247 | A | 11/1989 | Crandall | 248/542 |
| 4,892,284 | A | 1/1990 | Kelrick | 248/476 |
| 5,000,124 | A | 3/1991 | Bergen | 119/63 |
| 5,056,954 | A | 10/1991 | Flux et al. | 403/330 |
| 5,058,847 | A | 10/1991 | Arakawa | 248/328 |

(List continued on next page.)

*Primary Examiner*—Ramon O. Ramirez
(74) *Attorney, Agent, or Firm*—Law Offices of Thomas J. Brindisi

(57) ABSTRACT

An adjustable linear locking assembly, such as may be used in a mounting device or other suitable devices, which assembly allows automatic, substantially continuous adjustment to the linear position of a locking element such as an interface. The assembly may also provide two-way adjustability.

26 Claims, 57 Drawing Sheets

U.S. PATENT DOCUMENTS

| | | | | |
|---|---|---|---|---|
| 5,069,411 | A | | 12/1991 | Murphy ..... 248/476 |
| 5,133,526 | A | | 7/1992 | Olmsted ..... 248/495 |
| 5,303,895 | A | | 4/1994 | Hart ..... 248/475.1 |
| D349,447 | S | | 8/1994 | Daniller ..... D8/367 |
| 5,342,014 | A | | 8/1994 | Wilson ..... 248/476 |
| 5,359,870 | A | | 11/1994 | Reutlinger ..... 70/456 |
| 5,454,542 | A | | 10/1995 | Hart ..... 248/494 |
| 5,480,120 | A | | 1/1996 | Bruner ..... 248/477 |
| 5,584,462 | A | | 12/1996 | Reese ..... 248/477 |
| 5,605,313 | A | | 2/1997 | Erickson et al. ..... 248/467 |
| 5,806,826 | A | | 9/1998 | Lemire ..... 248/476 |
| 5,878,987 | A | * | 3/1999 | Hayde ..... 248/477 |
| 5,931,439 | A | | 8/1999 | Lemire ..... 248/493 |
| 5,947,438 | A | | 9/1999 | Lemire ..... 248/476 |
| 6,003,825 | A | * | 12/1999 | Abernathy, Jr. ..... 248/478 |

* cited by examiner

FIG. 1
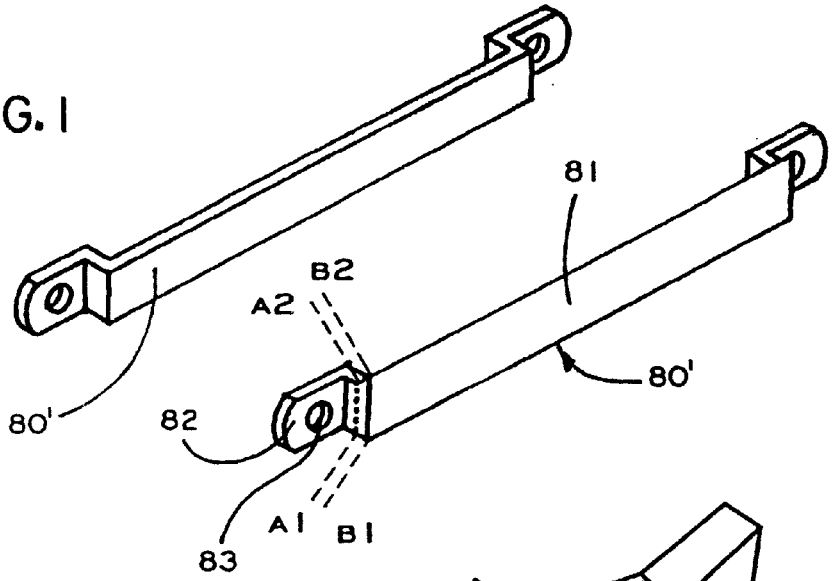
FIG. 1a
FIG. 2
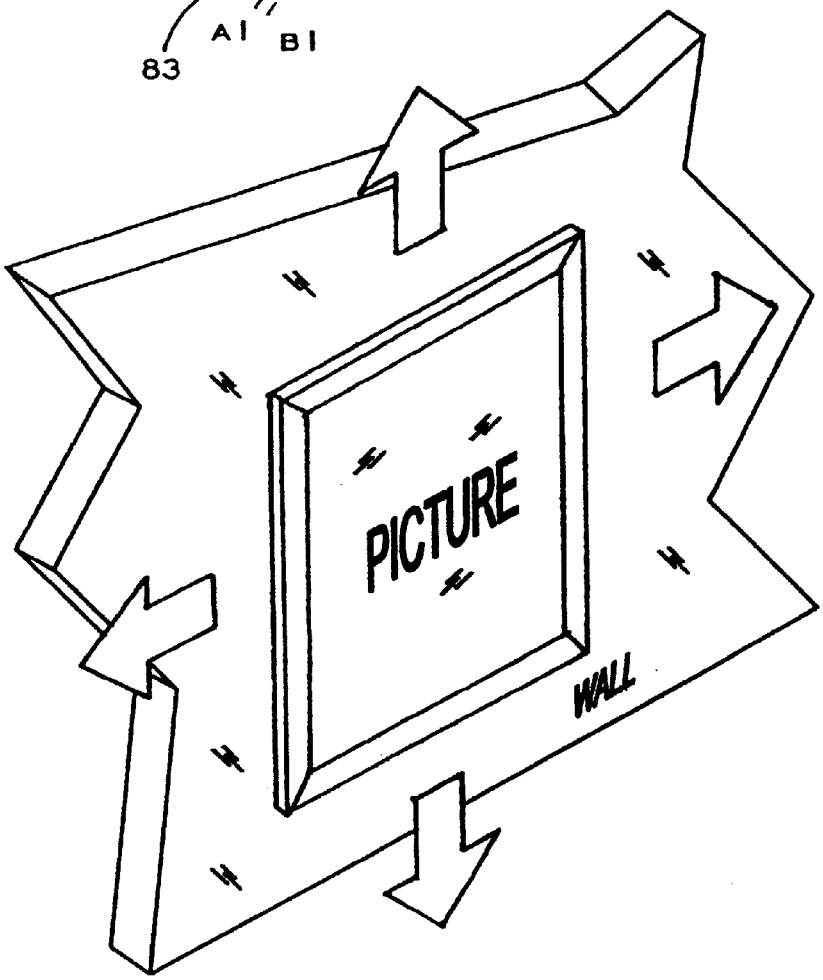

FIG. 9A
FIG. 9
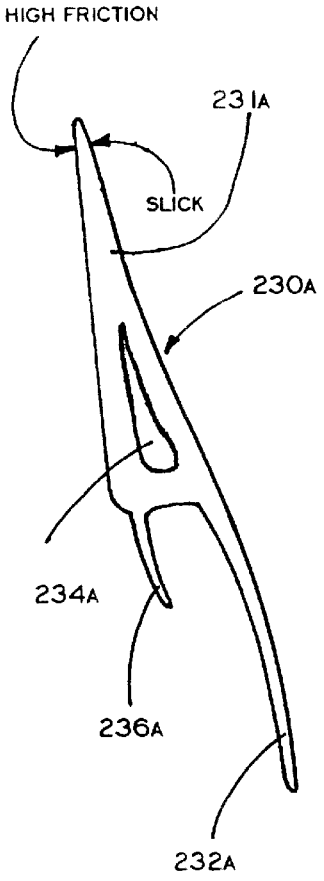
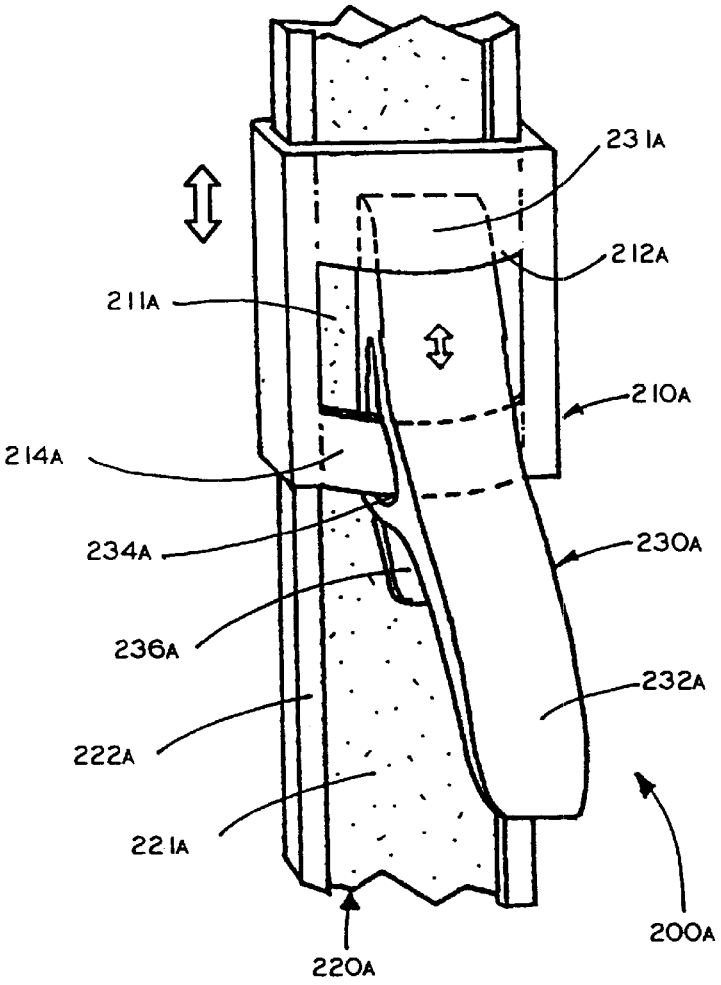

FIG. 12
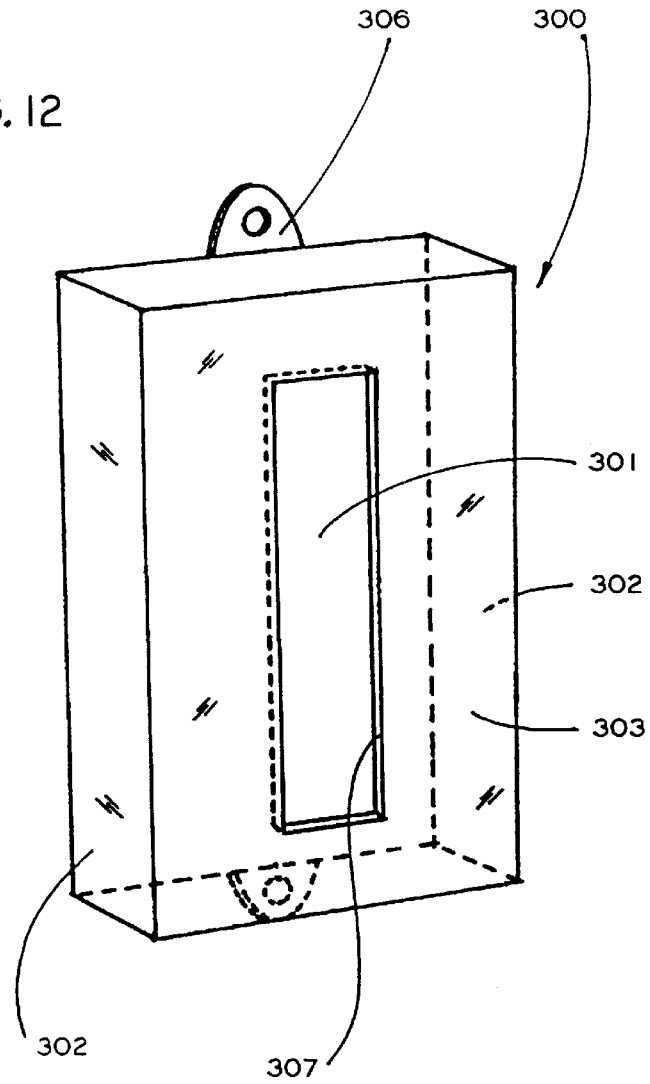
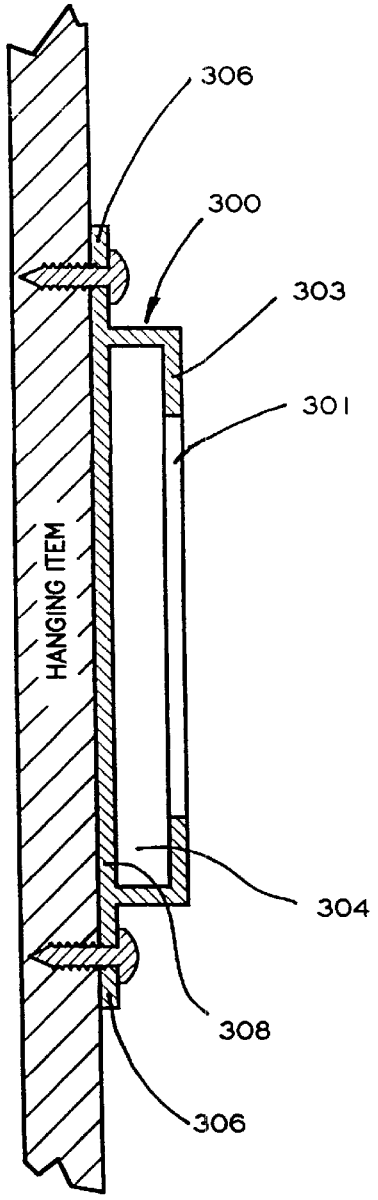
FIG. 12A

FIG. 30
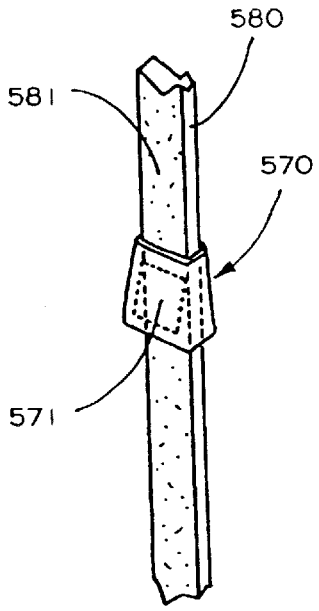
FIG. 30A
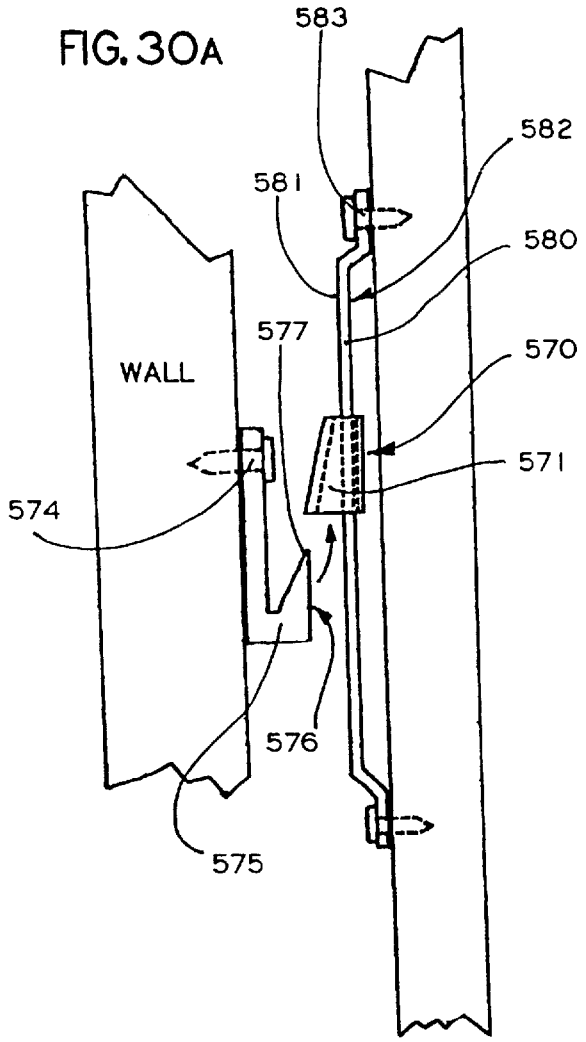
FIG. 31
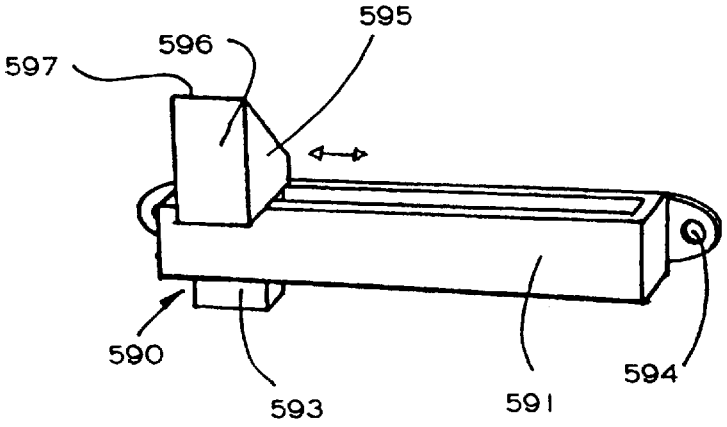
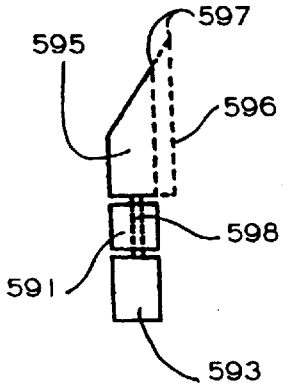
FIG. 31A

FIG 62
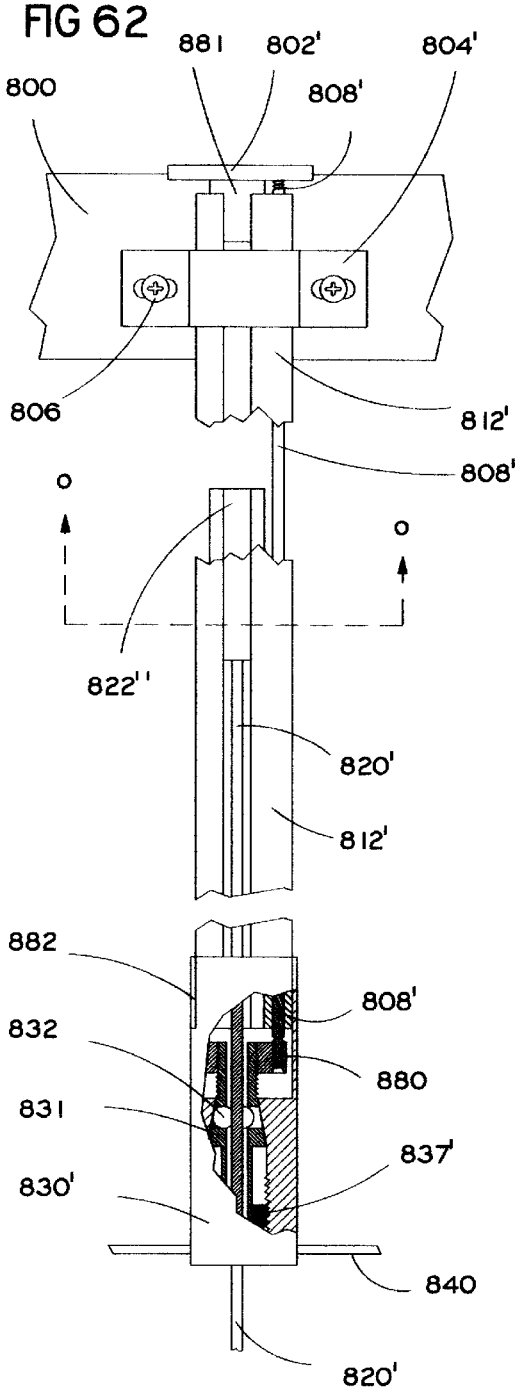
FIG 63
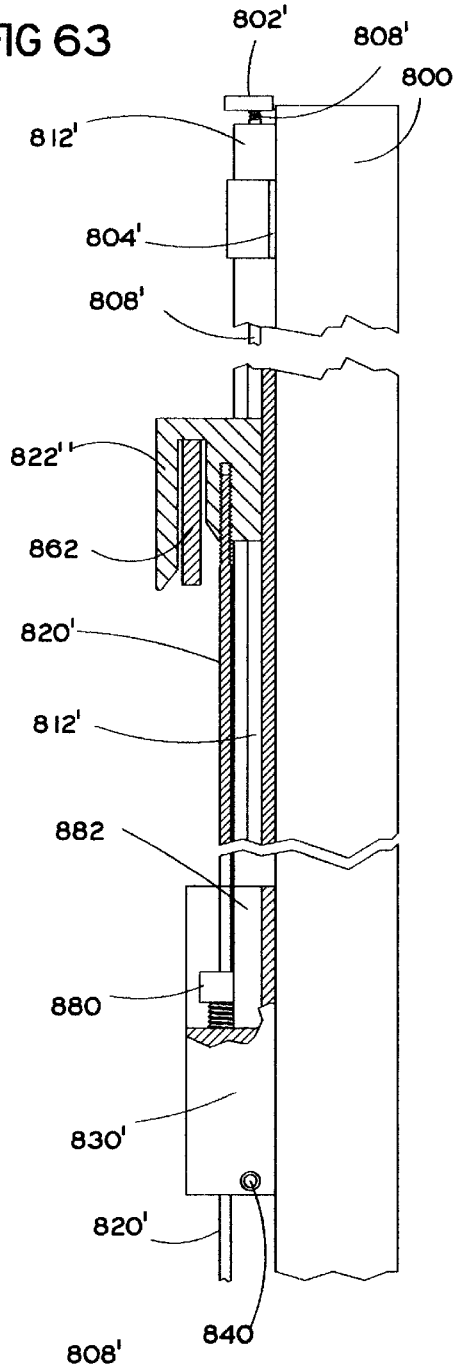
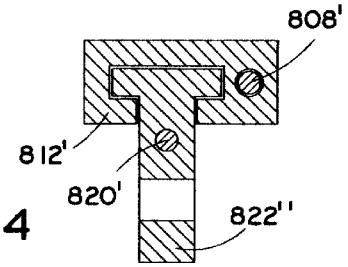
FIG 64

ADJUSTABLE MOUNTING DEVICE

This application is a continuation-in-part of U.S. patent application Ser. No. 09/396,249, filed Sep. 15, 1999, now abandoned, which was in turn a continuation-in-part of U.S. patent application Ser. No. 09/263,156, filed Mar. 5, 1999, now issued as U.S. Pat. No. 6,241,210, on Jun. 5, 2001.

BACKGROUND OF THE INVENTION

The field of the present invention pertains to the art of adjustable linear locking assemblies. More particularly, the present invention relates to adjustable linear locking assemblies that can be conveniently adjusted to different fixed positions.

The prior art reflects a long-standing endeavor to create mounting devices which simplify the process of positioning and mounting an item and which expand the latitude concerning where and how a mounted, hanging, or otherwise secured item can be repositioned. For example, as has been repeatedly noted in a multitude of patents granted over the last century (including those discussed below, the disclosures of which are incorporated herein by reference), hanging an item such as a picture or painting in a precise desired position on a wall can prove frustrating and time consuming. For one thing, it is often difficult to discern exactly where an item will look best until it has already been hung in the vicinity of the desired position, and then, from the proper perspective, viewed hanging. Even when an exact desired position is known in advance, imprecision or errors in measurement usually occur (to different degrees depending on the hanging hardware used) and commonly prevent that location from actually being obtained on the first try. Finally, even when an exact position is known in advance, and it is satisfactorily obtained through luck or work, the addition or rearrangement of furniture or other hanging items is often discouraged or rendered less attractive because of the disincentive to tamper with the location of the existing item. In addition to the time that is wasted and the less than aesthetically satisfactory arrangements that are often lived with, the removal and reaffixing nails or screws is a common occurrence that causes damage to the wall surface and sometimes failure of support for the hanging item. While prior artisans in the field have long recognized these difficulties and have created a myriad of devices aimed at solving them, the devices have fallen short of providing satisfactorily robust yet simple ways for the end user to hang an item.

More generally, prior to the present invention, there has been a need for an improved adjustable linear locking assembly that can be adjusted conveniently.

Definitions

A few specific definitions and non-exhaustive comments are provided separately in this section, and apply to the defined terms themselves as well as their roots, derivatives and other variants evidently directed at the same concept. Due to the large number of embodiments and parts described in this specification, some words may be used overlappingly, etc. Nevertheless, upon a careful review of this specification, the applicable definitions of the various terms used herein should become clear in their context.

"Automatic"adjustability means that the position of an item can be linearly adjusted: (1) without disengaging the item from a support or the rest of the assembly to a degree such that letting go of the item then would allow it to be released from the support or rest of the assembly (i.e., the adjustment can be done "in situ"), (2) without requiring movement of the item to a position significantly distant from the position being sought, and (3) without requiring direct manipulation (by hand or by tool) of any portion of the assembly that is inconveniently concealed from reach by the item. Automatic activation of adjustment can be achieved by the user manually applying a selected force or series of forces on the item itself, and/or on a part of the assembly that is conveniently accessible (for example, an activation trigger). The term "automatic" is not meant to exclude devices that incorporate the automatic nature of the invention taught herein, but simply add an additional locking means requiring some user interaction with a concealed part of the assembly (e.g., an added security locking means that requires a tool for initial unlocking) prior to an otherwise automatic process of adjustment.

"Continuous" adjustability means that adjustment occurs over a substantially continuous range rather than falling into a discrete group of selectable positions. This definition is not intended to exclude mechanisms having a minor degree of discontinuities imposed by supplemental holding means, such as relatively fine incremental teeth, which are added to improve an otherwise continuous mechanism's holding of a vertical position (as exemplified by the embodiment of FIGS. 35–41).

"Ready engagement and disengagement of the item," "readily engageable and disengageable from the support," and the like, means that an item may be readily hung on a support and removed therefrom as desired, through facile manipulations that do not involve any significant disassembly or any detachment of parts of the assembly affixed to the support or the subject item.

Finally, terms such as "item" and "frame"; and "wall" and "support" are used herein with some overlap. For example, depending on the logical context, the term "item" may refer only to an item such as a diploma or picture, or it may also be inclusive of the "frame" in which such an item is framed, and/or inclusive of an attached or incorporated mounting device. Likewise, the term "frame" may refer just to the object in which an item is framed, or it may include the framed item and/or mounting device. These terms are intended to illustrate the concepts of the present invention, and are not meant to limit the types of items that may be adjustably held in position thereby. For example, a shelf or chair-back might be considered a "hanging item" for the purposes of the present invention, despite the fact that neither has a distinct "frame."

The Prior Art

The prior art includes a series of patents directed to devices that provide two-way adjustability that is vertically neither continuous nor automatic. These patents include U.S. Pat. No. 5,480,120, issued Jan. 2, 1996 to Bruner; U.S. Pat. No. 3,945,599, issued Mar. 23, 1976 to Spier et al.; U.S. Pat. No. 3,063,666, issued Nov. 13, 1962 to Morrison; U.S. Pat. No. 2,757,890, issued Aug. 7, 1956 to Sutton et al.; and U.S. Pat. No. 2,740,602, issued April 3, 1956 to Wofford. The devices taught in each of these patents essentially comprise a first portion having a series of horizontal slots (or pairs of slots) and a second portion comprising an opposing hook(s) or the like which seats in any member of the series of horizontal slots. Some of the aforementioned patents disclose devices with the first portion attached to the wall and the second to the picture, while the others teach the converse arrangement. In either case, a measure of vertical adjustability is provided by disengaging the hanging item and its associated hanging means from the wall support means, and reseating the hook in a different member of the series of horizontal slots. In most of the devices, horizontal adjustability is provided by the hook(s) or the like being free to slide laterally along the horizontal length of the opposing slot(s) with which it is engaged. Most significantly, however, in each of these patents, the vertical adjustability is not substantially continuous in nature, and instead falls into a group of discrete selectable positions. Also, in each of these patents, vertical adjustment requires disengagement of the hanging item from the wall support, meaning that if the person hanging the item were to let go of the item, it would presumably drop to the floor. Moreover, reengagement during vertically adjustment can involve somewhat of a "blind" process.

The prior art also teaches devices which provide for continuous, two-way, but non-automatic adjustability, requiring that adjustments be made directly to an assembly residing behind the hanging item in a fashion which is not conveniently accessible. For example, U.S. Pat. No. 4,892,284, issued Jan. 9, 1990 to Kelrick, and U.S. Pat. No. 2,791,388, issued May 7, 1957 to Hirt, both teach devices that allow for two-way adjustability effected by the manipulation by tool (e.g., screwdriver) of a rack and pinion or the like. These devices present a clear inconvenience in that the user is required to insert a tool between the hanging item and wall and then, with some precision, locate the adjustment means. In addition, these devices require that the user have a suitable tool handy whenever adjustment to the hanging item is desired, and they also tend to necessitate the existence of a substantial gap between the hanging item and the wall in order to accommodate the device as well as clearance for the tool to be inserted.

Another example of a two-way adjustable device is found in U.S. Pat. No. 4,549,713, issued Oct. 29, 1985 to Magadini. Magadini discloses vertically disposed rods which slide along a horizontal wall support, and upon which spring biased "L" or "I" shaped metal hanger straps are locked in place against downward vertical movement. This device, however, is not automatically adjustable. First, vertical adjustment requires direct manual location, manipulation (i.e., overcoming the spring bias of a hanger strap and moving it to a different position), and resetting of the hanger straps. Further, the Magadini device may require the hanging item to be removed from the wall in order to manipulate the hanger straps. Also, because the horizontal wall support is (by necessity) at the uppermost position compared to the rest of the assembly, part of the assembly itself is visible, which is generally not aesthetically desirable.

Another example of a non-automatic adjustable device is disclosed in U.S. Pat. No. 2,898,064, issued Aug. 4, 1959 to Scott. The Scott device comprises a beaded chain that attaches to the item to be hung, and an assembly that attaches to the wall and includes a horizontally sliding member with slots into which the beaded chain can be connected at various positions along the chain. This device is of course not automatic because the beaded chain must be manually reached, pulled out of the slots, and reinserted at a different position in order to accomplish vertical adjustment. It also appears that the hanging item may have to be disengaged from the wall for the beaded chain to be reinserted.

The prior art includes various other patents disclosing two-way, non-automatic adjustable devices. Beyond the disadvantages noted above, these devices require the hanging item be repeatedly removed, set somewhere, and then replaced, and further require some guesswork as to exactly where an item will hang after the device has been adjusted a given amount. This type of non-in situ adjustment process creates temporal lapses that undermine visual and mental comparison of the item hanging in different positions.

U.S. Pat. No. 4,641,807, issued Feb. 10, 1987 to Phillips teaches such a device. This device comprises a mounting stud attached to a slotted body plate that is secured to the wall by a screw passing through the slot and into the wall. When the screw is loosened, the body plate can be slid along and rotated about the screw; the body plate stays in position once the screw is retightened. This device requires that the hanging item be disengaged and set somewhere while the assembly is directly manipulated and a new configuration secured. It also appears that the device affords at most one screw to secure the body plate to the wall; thus, hanging an item anywhere other than with its center of mass directly above the screw will create a rotational torque in the plane of the wall tending to cause the whole assembly to rotate out of level, undermining horizontal adjustability.

The prior art also includes patents directed to devices that provide vertical but not horizontal adjustability. One example is U.S. Pat. No. 4,557,455, issued Dec. 10, 1985 to Benjamin, and disclosing a toothed latching device. Beyond not providing horizontal adjustability, however, this device is not fully automatic as it only allows upward movement when engaged, i.e., it is "one-way." In order to adjust a hanging item downwardly, the item must first be moved all the way to the top of its adjustment range, whereat the latch disengages, and then all the way to the bottom of its adjustment range whereat the latch reengages. Then, with the latch engaged, the item is moved upwardly until the desired (originally) lower position is reached. Consequently, whenever a hanging item is desired to be moved downwardly at all, it must be moved entirely out of its existing position, the previous position (minus the desired downward adjustment) remembered or marked, and then relocated. Each time an item is adjusted just past its desired position, the entire process must be repeated.

Another type of prior art device providing vertically-only adjustability is disclosed in U.S. Pat. No. 3,285,549, issued Nov. 15, 1966 to Cook, and in U.S. Pat. No. 2,943,831, issued Jul. 5, 1960 to Goss. These devices are non-automatic and operationally somewhat similar to the Magadini device, in that they each require inconvenient manual manipulation (the hanging item must be tilted away or removed from the wall) of a recessed assembly in order to effect adjustment.

Finally, U.S. Pat. No. 1,432,206, issued Oct. 17, 1922 to Poole, Jr., discloses a marginally relevant device that provides automatic, vertically-only adjustability. The device is a mirror support comprising a clamping portion affixed to the mirror, and a vertically disposed rod affixed to the wall. When the mirror is disposed in the vertical plane, the clamping portion clamps the rod; when the bottom of the mirror is tilted upward, the clamping portion no longer clamps the rod, allowing it to slide up or down on the rod until the mirror is again disposed vertically by the user. In as much as there appears no ready way to remove the rod from the wall or to remove the clamp from the mirror, the clamping portion is permanently secured in sliding relation to the rod, and there is no way to readily engage or disengage the mirror from the wall. It should also be noted that, because the portion of the device which provides the range of vertical adjustability (namely, the rod) is attached to the wall, visible overhang of part of the assembly itself is apparently unavoidable. It should be further noted that the Poole, Jr. device necessitates a significant gap between the hanging item and the wall. This is because the clamp must be distanced from the rear of the item to provide clearance for pivoting the item on the rod without hitting the rod, and because the portion of the clamp facing the wall must have clearance from the wall in order to allow pivoting on the rod without hitting the wall.

The prior art also contains numerous teachings concerning horizontally-only adjustable devices, for example, U.S. Pat. No. 5,454,542, issued to Hart on Apr. 19, 1994.

Thus, there clearly remains a need for a mounting device that allows for readily disengageably hanging an item with automatic, substantially continuous vertical adjustability. A further need is for a mounting device that provides automatic, substantially continuous, two-way adjustability, with or without ready disengageability of the supported item. Another need is for a mounting device that can increase the usable horizontal hanging area for items that require the support of a wall stud, so that the position of studs is not as determinative of the placement of such items. There is also more generally a need for an improved adjustable linear locking assembly that allows automatic, substantially continuous adjustment to the linear position of a locking element. The foregoing description of prior art and needs is not meant to limit the invention in any way, and it should be understood that an embodiment of the invention need only serve one of the aforementioned needs or one of the other needs described or alluded to herein.

SUMMARY OF THE INVENTION

The present invention provides an adjustable linear locking assembly, such as may be used in a mounting device or other suitable applications, which assembly allows automatic, substantially continuous adjustment to the linear position of a locking element such as an interface. The above and other objects, features, and advantages of the present invention will become apparent from the following description of preferred embodiments and the accompanying drawings.

BRIEF DESCRIPTION OF THE DRAWINGS

The accompanying drawings, along with the description, serve merely to illustrate and explain the concepts underlying the present invention, and to describe preferred embodiments thereof. From these representative embodiments, many other configurations of the invention will be readily apparent to those of skill in the art. A variety of different techniques are used to depict the various embodiments and their parts, and it will be evident that some of the Figures are not professionally drawn; however, a careful review of the written specification should resolve any drafting inconsistencies.

FIGS. 1 and 1A are front perspective views of two versions of a generic wallbar that may used or modified for use with the two-way adjustable embodiments such as those shown in FIGS. 8–29, 33–34, 42–67, and 70–122;

FIG. 2 is a perspective view of an item hanging on a vertical flat surface wherein an automatic, substantially continuous, two-way adjustable embodiment of the present invention (not shown) is attached to the rear of the hanging item and/or to the flat vertical surface, showing the two-way automatic repositioning of the item that can be accomplished while the item remains hanging in situ;

FIGS. 9 and 9A are a partial side view and partial transparent perspective view of an embodiment similiar to that of FIG. 8, showing the wedge nearly trapped in the brake trap;

FIGS. 12 and 12A are a perspective view and sectional side view of a generic box that may be adapted for use in the devices of FIGS. 13–21, showing the attachment of the box to the rear of an item to be hung;

FIGS. 30 and 30A are a partial perspective view and a side transparent view of an embodiment providing vertical adjustability, showing how the hook projecting from the wall is poised to be trapped in the vertically sliding lock trap;

FIGS. 31 and 31A are a perspective view and a side transparent view of part of an embodiment similar to that shown in FIG. 30 but providing two-way adjustability;

FIG. 62 is a front cutaway partial sectional view of an embodiment similar to that of FIG. 42 but utilizing an alternate track, hook, and trigger configuration;

FIG. 63 is a partial side sectional cutaway view of the embodiment of FIG. 62;

FIG. 64 is a sectional view taken through the line O—O of FIG. 62, showing the mating of hook and track;

{In FIGS. 93*a* through 94, shading is used for some parts instead of hatching, but will be converted to hatching in the formal drawings.}

{In FIGS. 105 and 106, shading is used, but will be converted to hatching in the formal drawings.

FIG. 107 is a front perspective view of a coupling used to house the collar and connect the upper and lower track halves of the embodiment depicted in FIGS. 104–106;

FIG. 108 is a right side view of the coupling of FIG. 107;

FIG. 109 is a top view of the coupling of FIG. 107;

FIG. 110 is a perspective, partially exploded view of a two-way adjustable embodiment wherein downward vertical adjustability is activated by pressing slightly upward and then inward on the hanging item against the wallbar, and upward vertical adjustability is ensured by pulling lightly outwardly on the hanging item;

FIG. 111 is an exploded perspective view of the hook/clamp of the embodiment of FIG. 110;

FIG. 112 is a perspective view of the bottom stopper of the embodiment of FIG. 110;

FIG. 113 is a perspective view of the safety slider of the embodiment of FIG. 110;

FIG. 114 is a side sectional view of the embodiment of FIG. 110 as indicated by the relevant lines in that figure;

FIG. 115 is a partial top sectional view of the embodiment of FIG. 110 looking down as indicated by the relevant lines in that figure;

Figure 18:
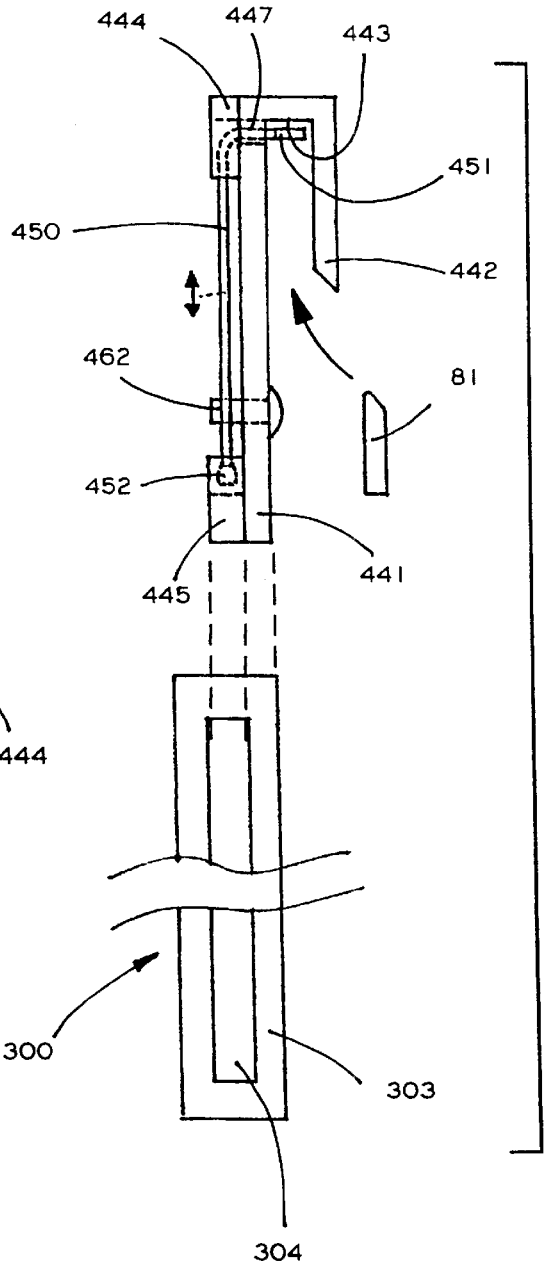
FIG. 18 is an exploded side transparent view of the embodiment of FIG. 17, showing how the sliding assembly resides primarily in the box, and showing where the hook rests on the wallbar.
Figure 110:
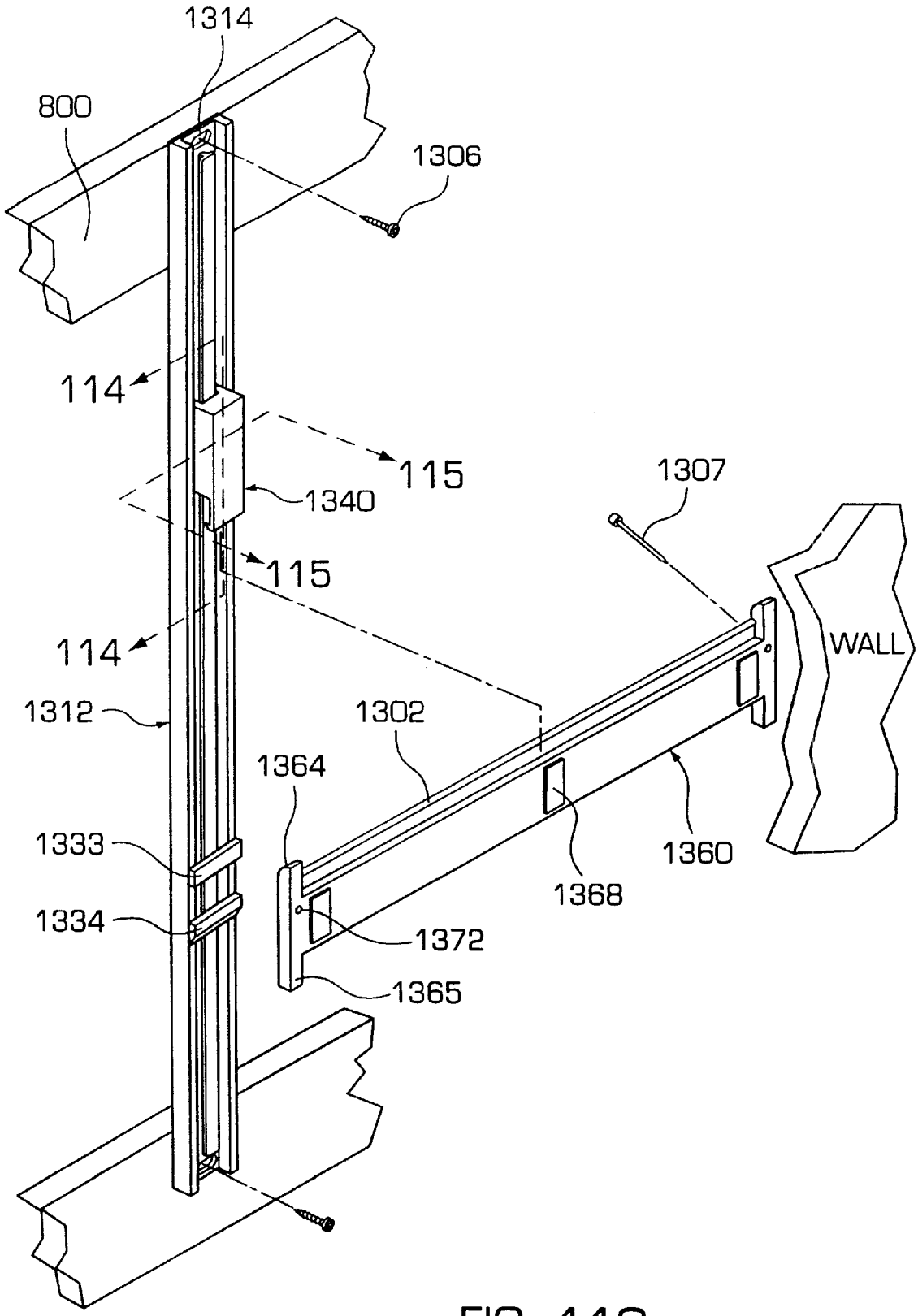
Figure 115:
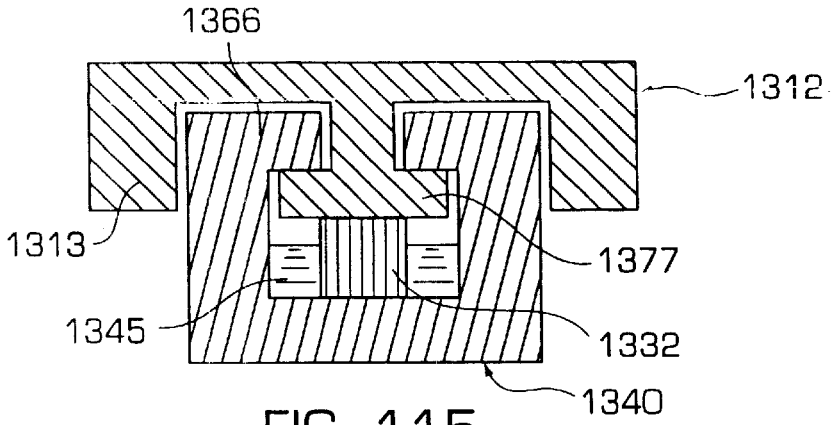
Figure 115A:
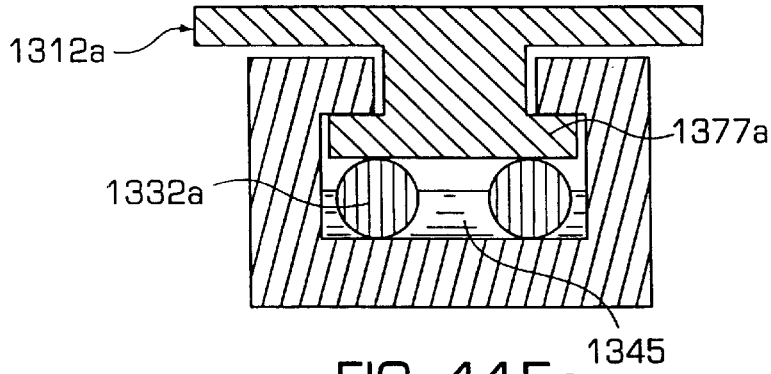
Figure 115B:
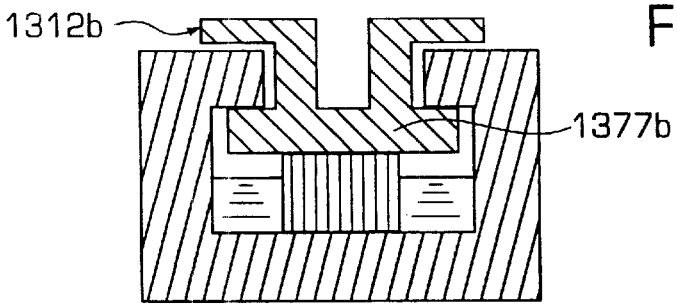
Figure 115C:
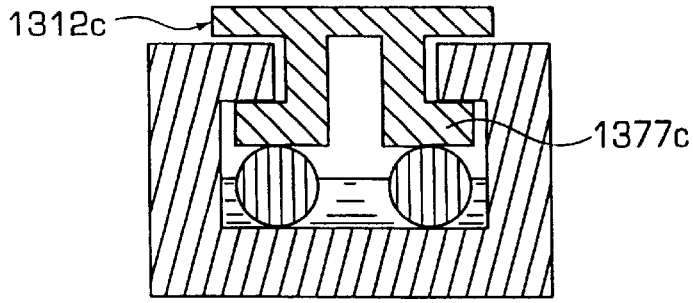
Figure 116:
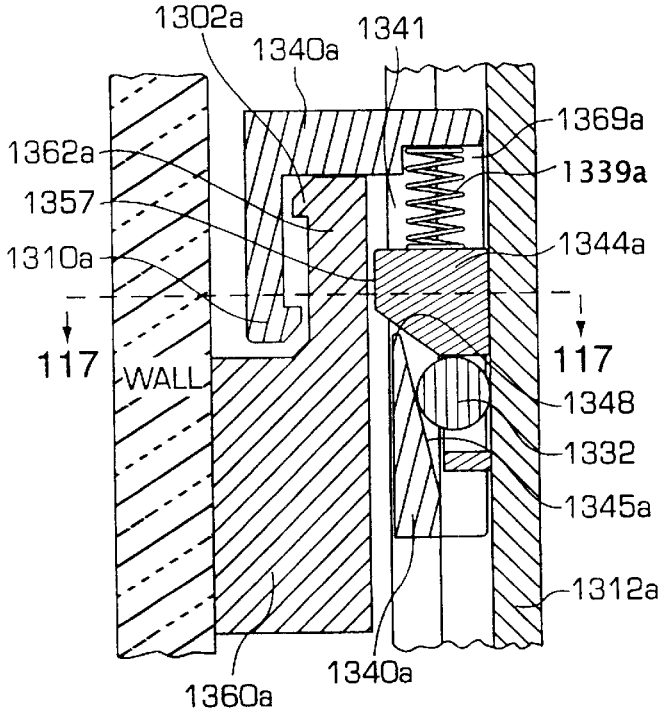
Figure 118:
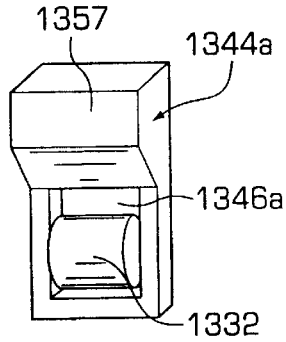
Figure 117:
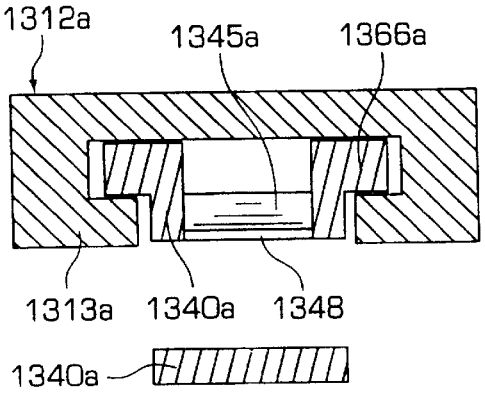
Figure 119:
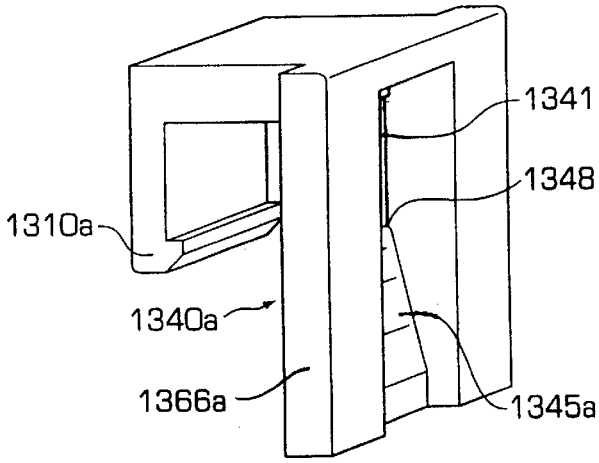
Figure 120:
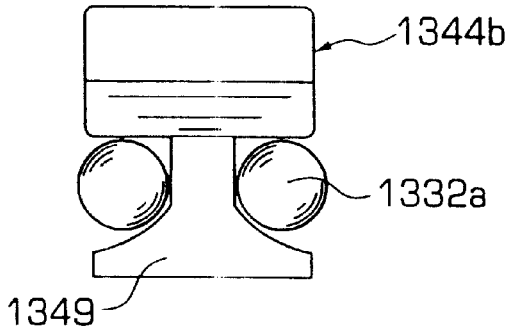
Figure 121:
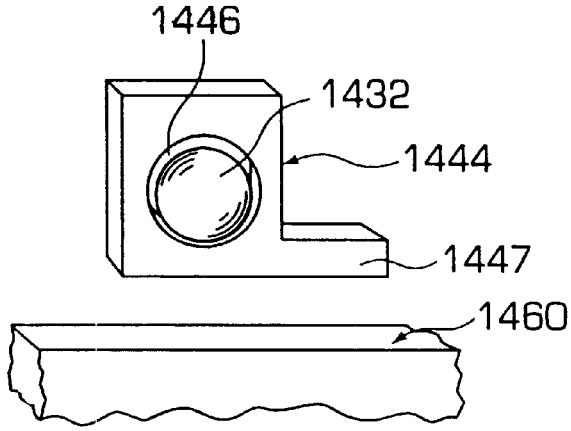
Figure 122:
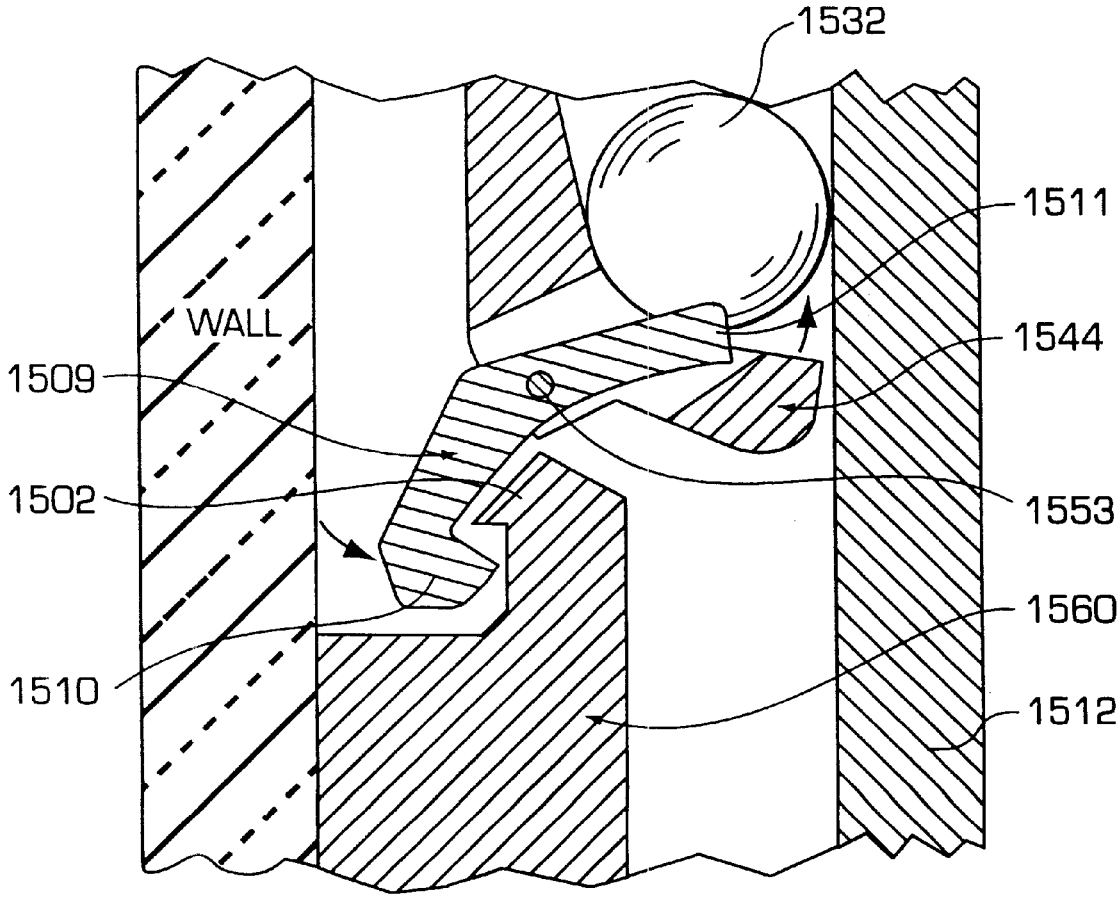
Figure 123:
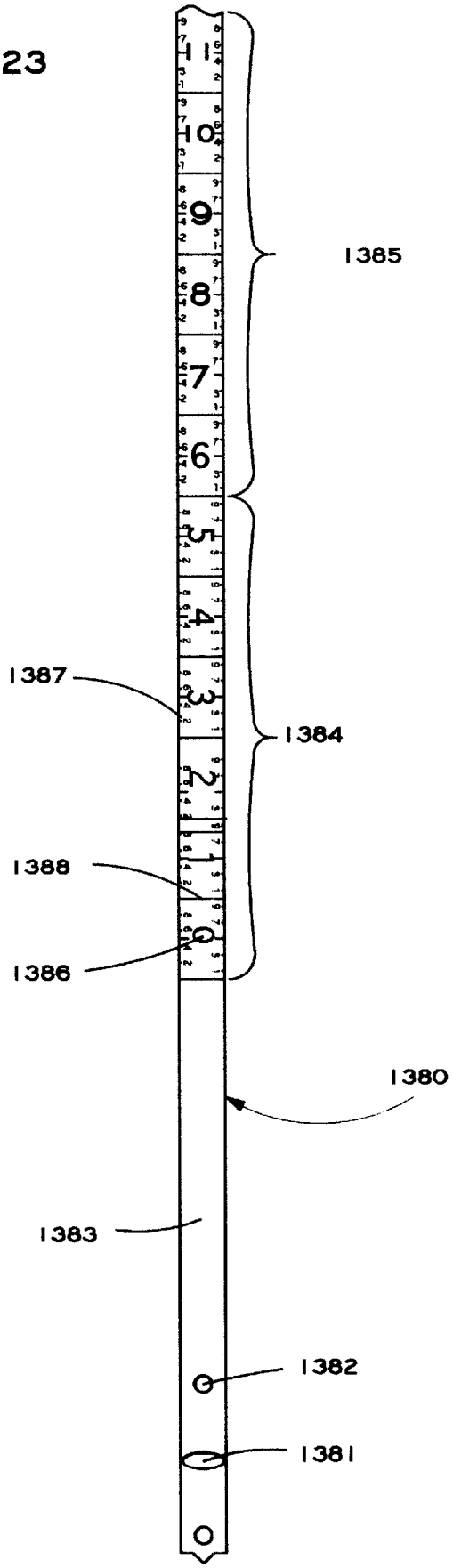

FIGS. 115*a* through 115*c* are top sectional views like that of FIG. 115, of alternate embodiments to the embodiment of FIG. 110;

FIG. 116 is a side sectional view (similar to the view of FIG. 114) of an alternate embodiment to that of FIG. 110, wherein the trigger is primarily above the rolling member rather than below;

FIG. 117 is a partial top sectional view (similar to the view of FIG. 115) looking down as indicated in the lines of FIG. 116;

FIG. 118 is a front perspective view of the trigger and rolling member of the embodiment shown in FIGS. 116 and 117;

FIG. 119 is a rear perspective view of the hook/clamp of the embodiment shown in FIGS. 116–18;

FIG. 120 is a front view of an alternate (to that shown in FIG. 118) trigger and rolling members for use in the embodiment of FIG. 116;

FIG. 121 is a front partial perspective view of a trigger and rolling member of an embodiment with two-way adjustability wherein downward vertical adjustment is triggered by rotating the hanging item counterclockwise on the wall;

FIG. 122 is a partial side sectional view of the hook/clamp/trigger, rolling member, track, and wallbar of an embodiment wherein downward vertical adjustment is activated by pressing the hanging item inwards toward the wall; and, FIG. 123 is a front view of part of a measuring and aligning tape for use in positioning and aligning the screws used to connect tracks of various embodiments of the invention to the rear of an item to be hung.

DETAILED DESCRIPTION OF PREFERRED EMBODIMENTS

There are many applications for the present invention, and the specific embodiments described herein are not meant to limit such applications. Thus, while the following detailed description focuses on embodiments that may be of a scale and character appropriate to the hanging of pictures, paintings and the like, this is simply for the sake of furthering the clarity of the discussion. The invention taught herein, however, is envisaged as encompassing a wide range of applications extending to anything that can benefit by adjustable mounting. Examples include advertising or informational displays, art exhibits, flat screen televisions, and various other flat or even three dimensional items, including items having utilities or functions other than as a mere display, and items that are intended to have direct or remote interaction with a person or other object. For example, certain of the one-way locks taught herein (e.g., ball-in-cone and related variants) could be modified for use in vertically adjustable suspension lighting that hangs from the ceiling (with a trigger placed near the light).

Regarding the particular embodiments of the invention that are described herein in detail, it must be kept in mind that the cross-sectional shapes, thicknesses, widths and lengths of the various elements, as well as the particular mechanisms and configurations, can readily be varied to afford different combinations of strength, operational dynamics, and overall thickness of the assembly. Only a few representatives of the many possible different configurations are shown. However, it is preferable (although not mandatory) that an embodiment be: (1) easy to understand and adjust; (2) easy to level; (3) capable of securing a hanging position that is not too easily disturbed by vibration or the like; (4) sufficiently durable so as to allow a reasonable life cycle of adjustments; (5) at most minimally visible when hung; and (6) not prone to scratching, marring, or otherwise damaging the support.

Proceeding to the figures, FIG. 2 shows generally how two-way (i.e., horizontally and vertically), automatic, substantially continuously adjustable embodiments of the invention are movable to different positions while hanging on the wall. Simultaneous, diagonal two-way adjustment is also possible with some embodiments. It should be noted, however, that two-way adjustability of any kind is not strictly a requisite to the present invention, certain embodiments of which provide vertical or (in the case of the stud extender) horizontal adjustability only.

Figure 3:
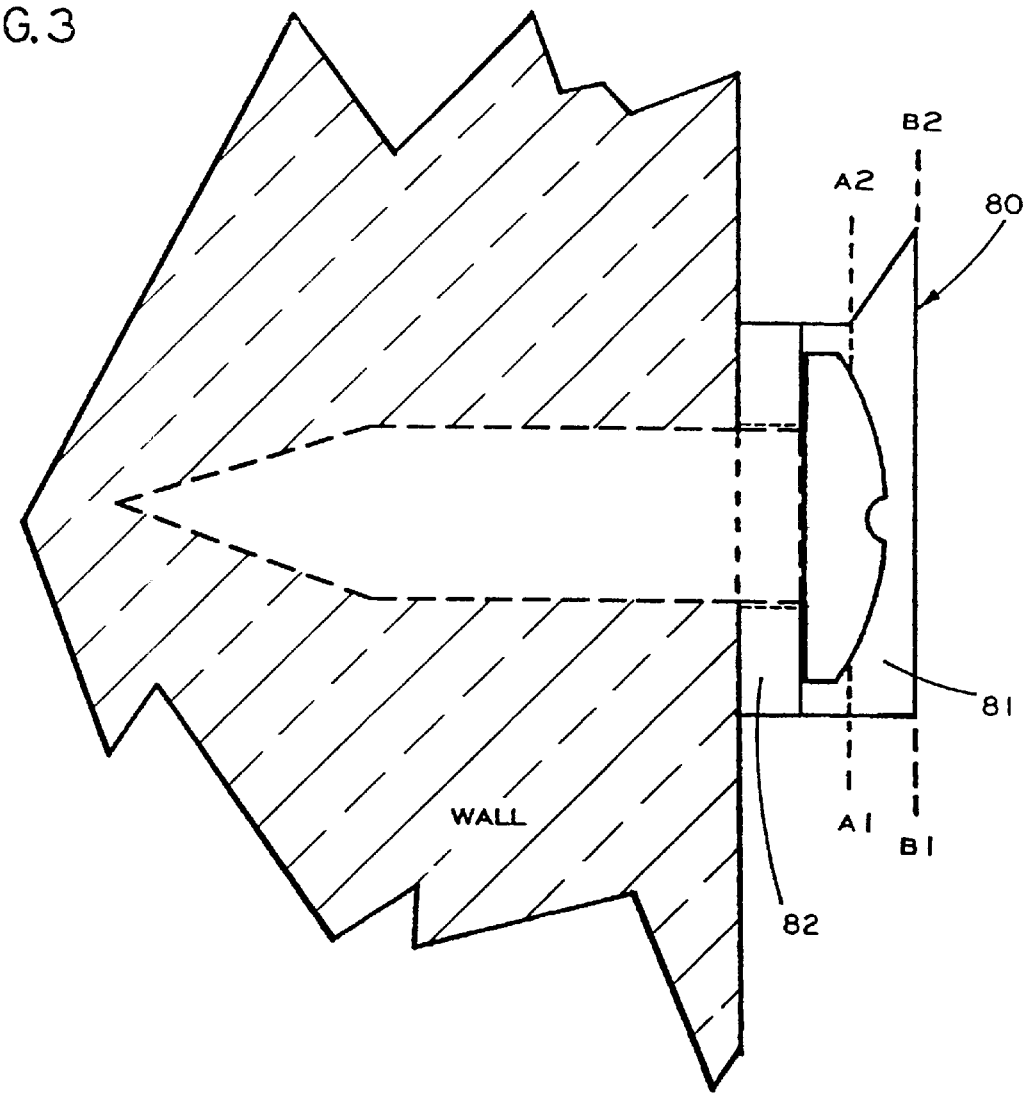
FIG. 3 is a side transparent view of a generic version of the wallbar shown in FIG. 1A viewed along the lines a1–b1 and a2–b2, with the wallbar attached to the wall by screws or nails.
Figure 4:
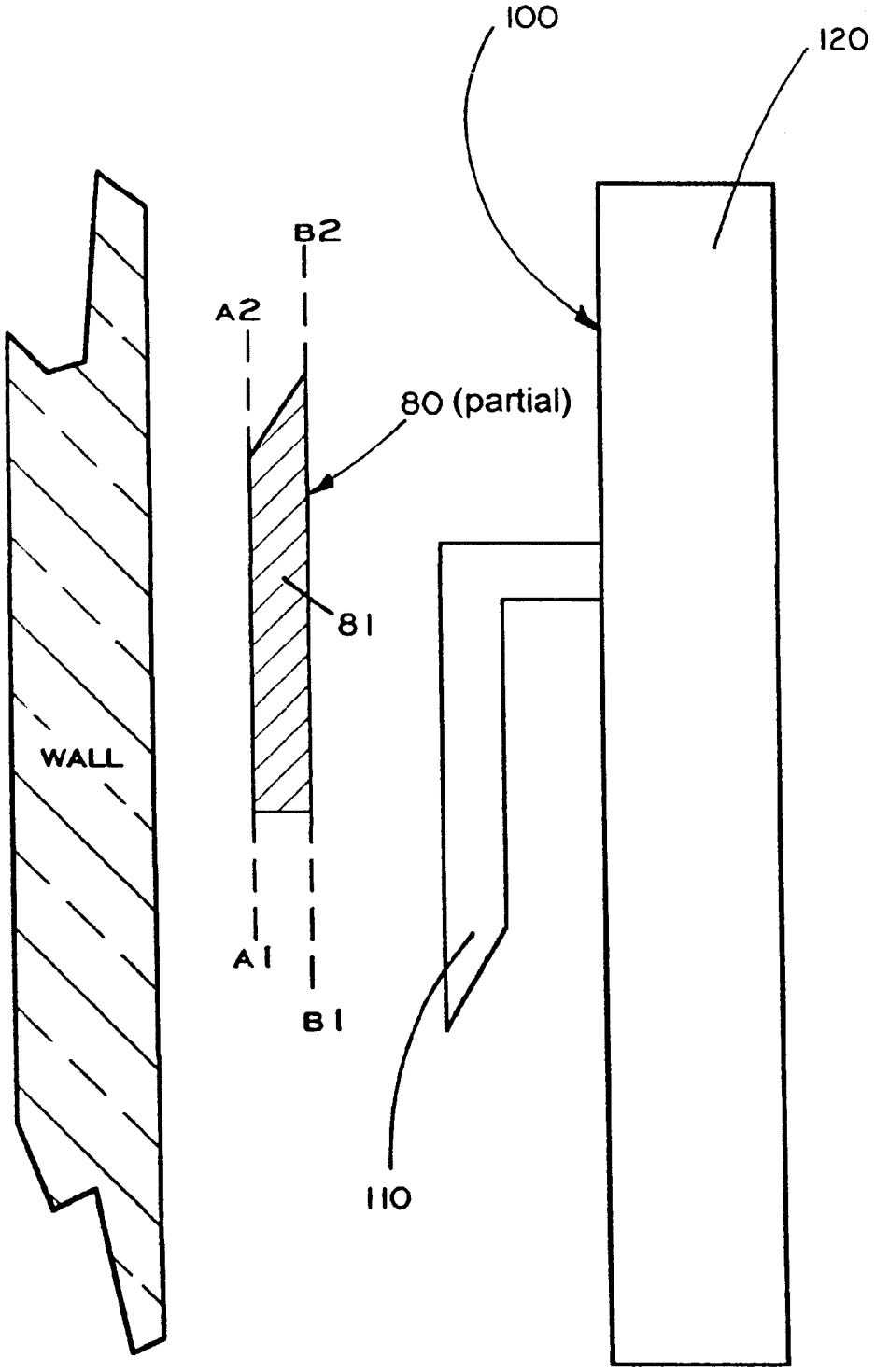
FIG. 4 is a partial side view of part of the wallbar (mounted to the wall) and the rest of a generic two-way adjustable assembly (mounted to an item to be hung, not shown) of an embodiment such as those shown in FIGS. 8–29, 33–34, 42–66, 70–91, and 96–109, with the rest of the adjustable assembly being raised into position (along with the item to be hung, not shown) for mounting on the wallbar.
Figure 5:
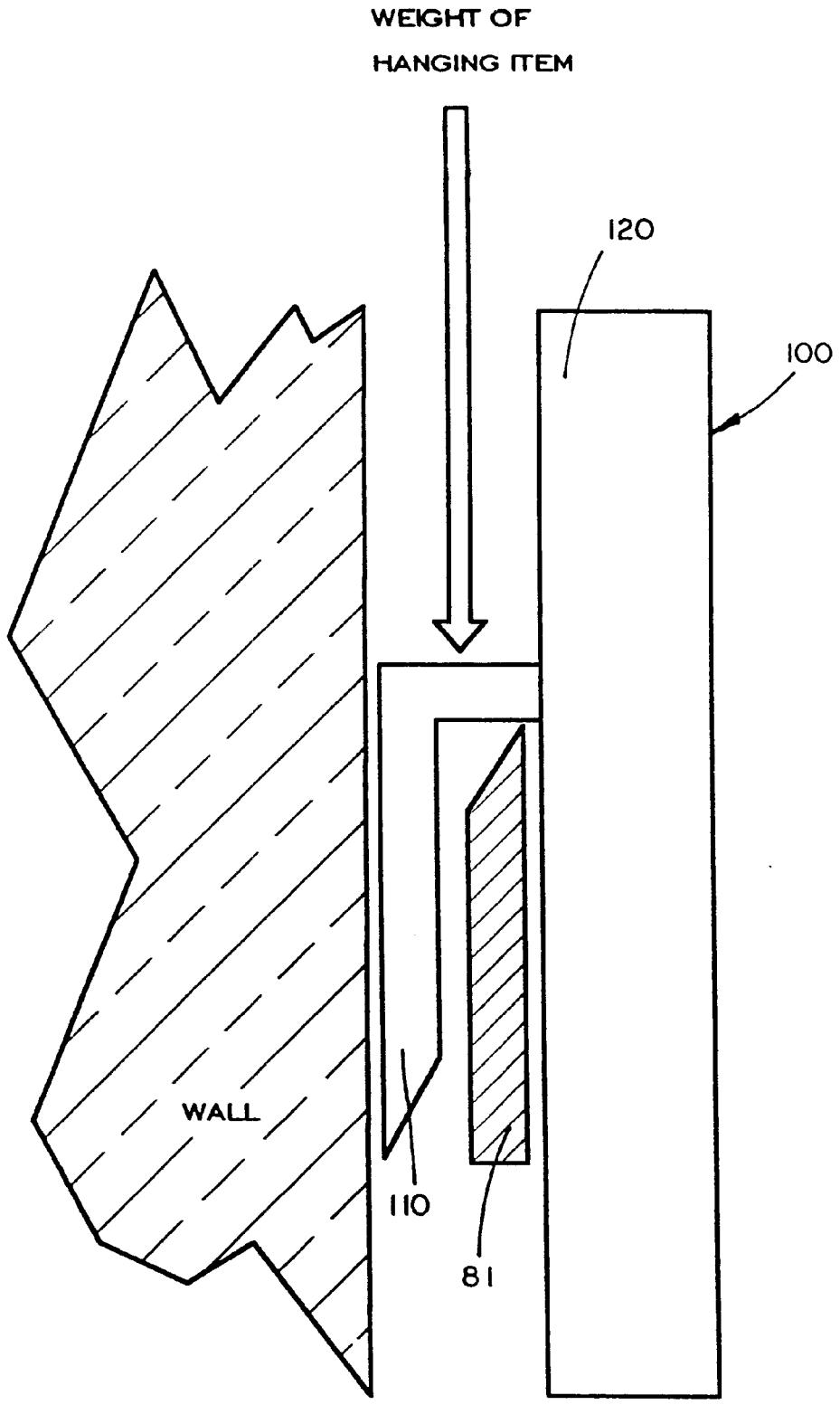
FIG. 5 is a partial side view similar to FIG. 4, except that the assembly is in a mounted position with the hook seated on the wallbar and the arrow depicting the force exerted by the weight of the hanging item (not shown) being supported by the wallbar mounted to the wall.

FIGS. 1 & 1A show a perspective view of a generic wallbar 80 or 80' that attaches to the wall (with nails or screws through holes 83 of ears 82) for use with most of the two-way adjustable embodiments described herein. FIG. 3 shows a side transparent view of generic wallbar 80 viewed along the lines a1–b1 and a2–b2, with wallbar 80 being attached to the wall. It should be noted that in many of the embodiments of hangers described herein, as a substitute for the wallbar, a horizontal slot or a series of such slots can be preformed into the surface on which an item is to be hung, permitting boundless horizontal adjustability in a way that can be aesthetically acceptable. This would be particularly suitable for art galleries and the like.

Figure 6:
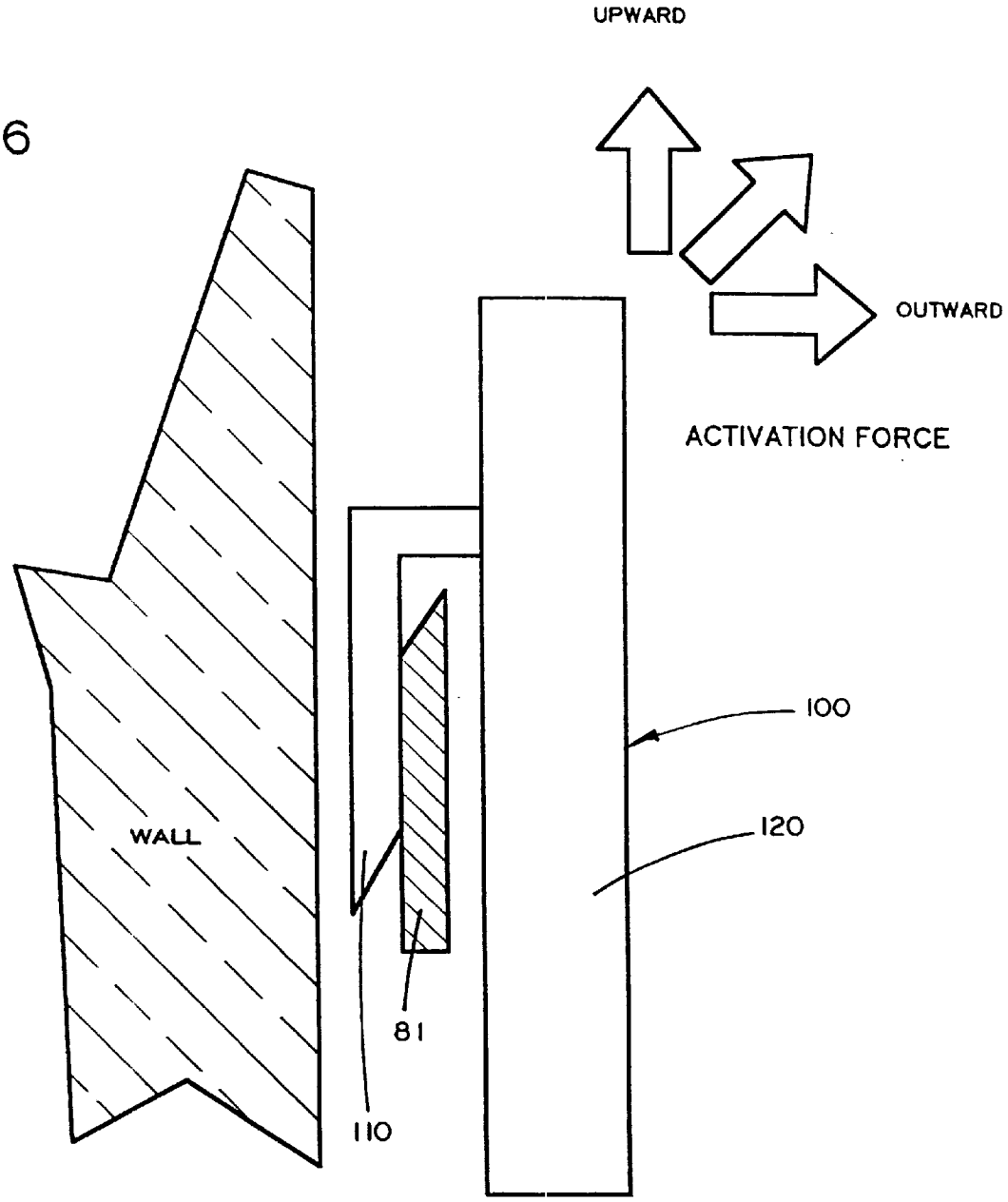
FIG. 6 is a partial side view similar to FIG. 5, except that the assembly is in an activated position caused by pulling upward and outwardly (as in the embodiments of FIGS. 10–21) on the hanging item (not shown)
Figure 7:
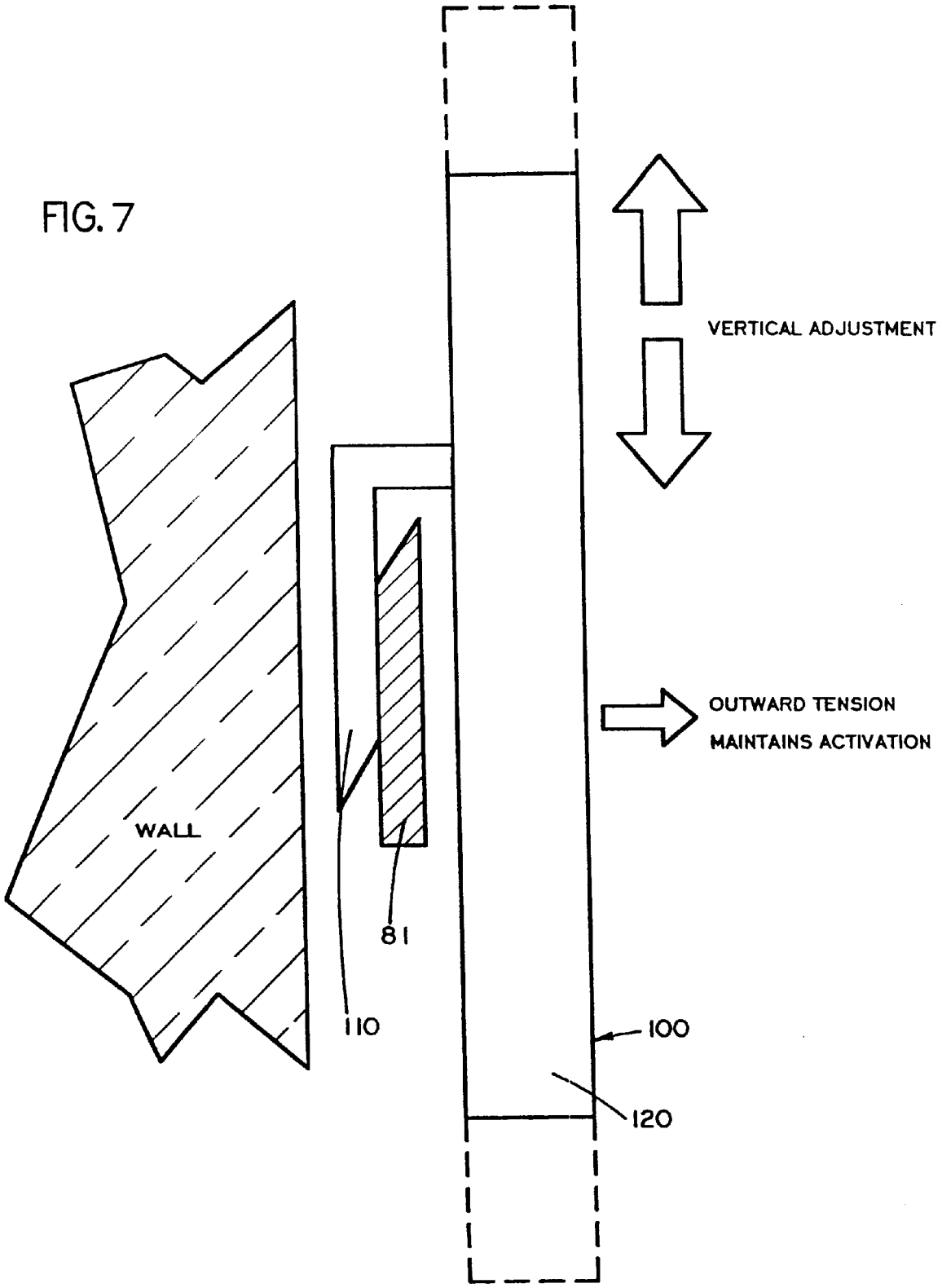
FIG. 7 is a partial side view similar to FIG. 6, with the assembly remaining in its activated position (as maintained in the embodiments of FIGS. 10–21), but also showing vertical adjustment of the assembly (indicated in broken lines)

FIGS. 4–7 show a sequence wherein a generic vertically adjustable mounting device having a downwardly pointing hook mounted on the rear of the item to be hung is seated on the horizontal bar 81 of generic wallbar 80 (see FIG. 1) and then activated for vertical adjustment. Typically in the embodiments of FIGS. 10–21, this activation is achieved by pulling upward and outward on the hanging item, as shown in FIG. 6, and adjustment is typically accompanied by maintaining some degree of outward (away from the wall) tension on the hanging item, as shown in FIG. 7. The operation of the embodiments of FIGS. 8–9, 22–29, 33–34, and 93–95*b* is similar, except that they are activated by inward or inward and upward pressure, as discussed below. The embodiments of FIGS. 42–67, 70–91, and 96–109 are vertically activated by pressing on an activation button or toggling a lever(s) conveniently placed at an edge of the frame.

FIGS. 8–29, 33–34, 42–67, and 70–109 illustrate embodiments of two-way, automatic, substantially continuously adjustable mounting devices wherein a vertically adjustable, downward pointing hook assembly is mounted on the rear of the item to be hung, and the hook assembly, in turn, mates with and horizontally adjusts on a wallbar (such as wallbar 80 shown in FIG. 1), that is mounted to the wall (as shown in FIG. 3). In reviewing the Figures, it should be kept in mind that, although the wallbar 80 shown in FIG. 1 presents a further aspect of the present invention, it is not a requisite. In other words, there are readily apparent embodiments of the present invention that are quite similar to many of the embodiments of FIGS. 8–29, but which only provide vertical adjustability, with the wallbar being entirely omitted, and a suitable interface (in place of a downwardly pointing hook) provided for catching a nail or the like protruding from the wall.

Figure 8A:
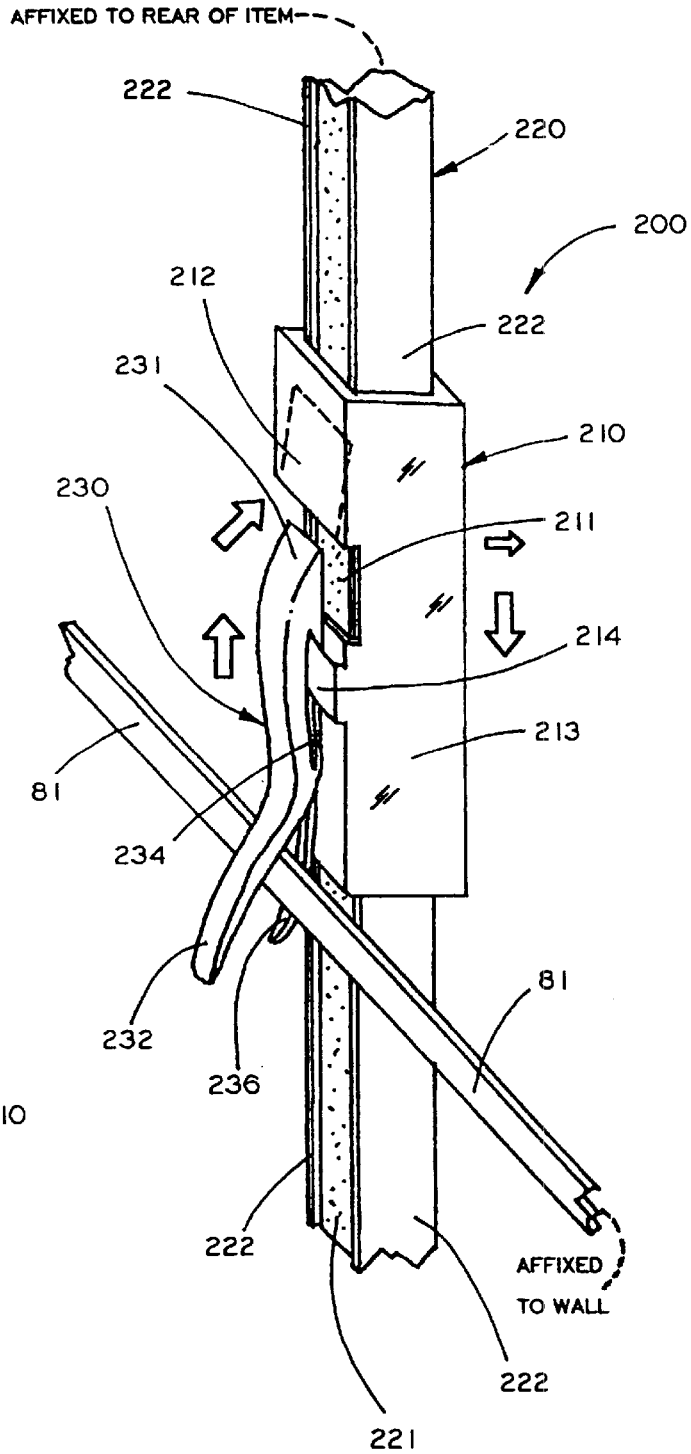
FIGS. 8 and 8A are perspective views of a two-way adjustable embodiment having a locking hook and wedge that wedges into a brake lock trap, showing force applied on the item (indicated with arrows on the right) to seat the hook on the wallbar and pivot the wedge toward and up into the brake lock trap (indicated with arrows on the left)
Figure 8:
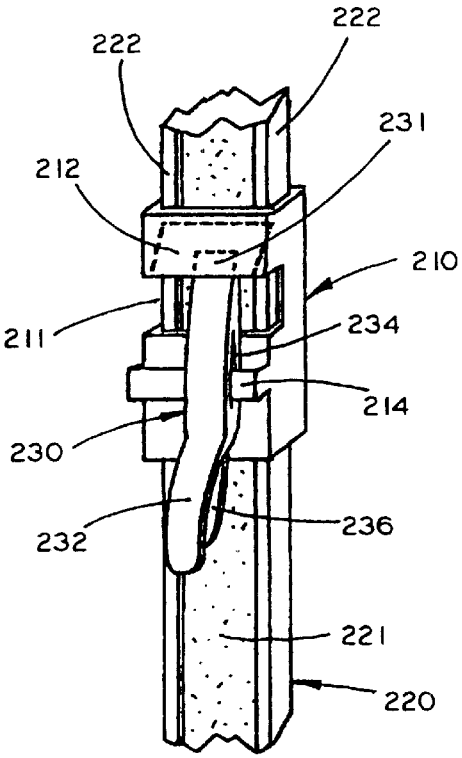

FIGS. 8 and 8A show an adjustable mounting device utilizing a wedge in sliding trap design. Vertical bar 220 is fixedly attached to the rear of the item to be hung, and includes guide rails 222 and brake strip 221. Vertically sliding along guide rails 222 and over brake strip 221 is sliding lock trap 210. Sliding trap includes body 213, brake trap window 211, trap pocket 212, and hook holder bar 214. Mounted on holder bar 214 is locking hook and wedge 230. Locking hook and wedge 230 vertically slides and partially pivots on bar 214 along slot 234. At the upper end of hook and wedge 230 is wedge 231, and at the lower end is hook 232 and wallbar catch 236. On the side of wedge 231 facing brake strip 221 is a high-friction surface, such as rubber or metal grating, chosen to provide the maximum grip with the surface of the material chosen for brake strip 221. The other side of wedge 231 facing the interior of pocket 212 may have a slick surface so that wedge 231 slides as far into pocket 212 as possible to increase wedging (described below). Pocket 212 is shaped with a triangular cross-section, coming close to meeting with bar 220 at the top section of pocket 212, and being its furthest away from bar 220 at its bottom section. Slot 234 extends down far enough in locking wedge and hook 230 so that holder bar 214 can almost, but not quite, contact the lowest point of slot 234 without wedge 231 being fully jammed in pocket 212. Slot 234 extends up far enough so that when holder bar 214 is proximate to the uppermost extent of slot 234, wedge 231 is fully within window 211 when viewed frontally.

In operation, the item to be hung is lowered with hook 232 above bar 81 (see FIG. 1 regarding the connection of bar 81 to the wall), such that hook 232 catches on bar 81. At this point, the item is pulled just slightly outward to ensure that wedge 231 pivots slightly and is fully within window 211. Then the item is lowered slightly further, causing hook and wedge 230 to slide upwardly on holder bar 214 until wedge 231 inserts into and then jams in pocket 212 between the interior face of pocket 212 and brake strip 221. Wedge 231 jams between pocket 212 and strip 221 because of the complementary shapes (generally wedge-shaped or triangular) of the brake strip facing side of wedge 231 and the interior face of pocket 212. At this point, due to the aforementioned jamming or wedging of wedge 231 between the sliding trap 210 and the vertical bar 220, sliding lock trap 210 is no longer able to move vertically along bar 220, and is locked in place; consequently, so is the item, the weight of which is transferred through the crotch between hook 232 and catch 236 and onto bar 81. The item can be freely moved horizontally, however, with the crotch between hook 232 and catch 236 sliding along the top of bar 81. Level hanging can be improved by widening hook 232 and ensuring bar 81 is attached closely along the center of weight line of the item. The bar can be hung sufficiently level by sight.

To adjust the item's vertical position once it is hung as described above, the user pushes gently inwardly (towards the wall) on the item and then lifts the item up slightly while gently maintaining inward pressure. This causes catch 236 to be forced into bar 81, exerting torque on locking hook and wedge 230 and forcing wedge 231 towards the wall, and it also moves the main point of wedging from the high-friction side of wedge 231 and brake strip 221 to the low-friction side of wedge 231 and the low friction interior of pocket 212. The upward pull on the item pulls vertical bar 220 upwards and at first this brings sliding lock trap 210 with it, because the two are jammed together. Because the high-friction wedging has been replaced with low-friction wedging, however, locking hook and wedge 230 is allowed to fall out of pocket 212 by its own weight. (The end of catch 236 can be extended and slightly curved so as to allow the user to apply a degree of upward pull through catch 236 and on the bottom of bar 81 to provide further assurance that hook and wedge 230 can become unwedged.) Thereupon, the continuance of inward pressure and upward pulling on the item causes wedge 231 to be lowered fully into window 211 and then to pivot slightly about holder bar 214 and outside of window 211 such that the tip of wedge 231 is physically outside of sliding trap 210. At this point, the vertical position of the item can be freely adjusted. Then, to relock the item once the desired vertical position has been reached, the user applies some outward tension on the hanging item (which causes hook 232 to be in tension with the wall-facing side of bar 81, applying torque on hook and wedge 230 forcing wedge 231 in against the outer surface of the top of trap 210) and pulls up slightly on the item until wedge 231 slips down and back into window 211. Finally, vertical locking is again achieved in the same way that it is right after hook 232 has been lowered onto bar 81, as described above.

Regarding the embodiment of FIG. 8, it might be desirable to place a small awning (not shown) right at the edge of pocket 212 that fronts window 211, for holding the tip of wedge 231 during vertical adjustment. The awning would be shaped with a slight curve such that the tip of wedge 231 would slide directly back to window 211 as soon as there is an outward pull on the hanging item. Note that the thickness of rail 222 is exaggerated for the purposes of illustration, and its thickness should be minimized (to the extent sufficient rigidity can be retained to prevent undue bowing of rail 222), lessening the overall thickness of the assembly and gap between the hanging item and wall. Also, the points of contact between sliding lock trap 210 and bar 220 should be made as slick as possible to allow convenient vertical adjustment.

FIGS. 9 and 9A show an embodiment that is similar to that of FIG. 8, except that the hook and wedge 230*a* is shaped somewhat differently than 230 of FIG. 8, particularly at slot 234*a;* the corresponding holder bar 214*a* is also shaped differently. Reference numbering in FIGS. 9 and 9A is the same as in FIG. 8, except that "a" is appended to the corresponding parts in FIGS. 9 and 9A. Note that guide rail 222*a* is much thinner than rail 222 is shown in FIG. 8, which, as noted, is exaggerated for illustration. FIGS. 9 and 9A also show a side view of hook and wedge 230*a,* and how its side facing brake strip 221*a* may have a high-friction surface while the opposing side (which faces the interior of pocket 212*a*) may have a low-friction surface.

Figure 10:
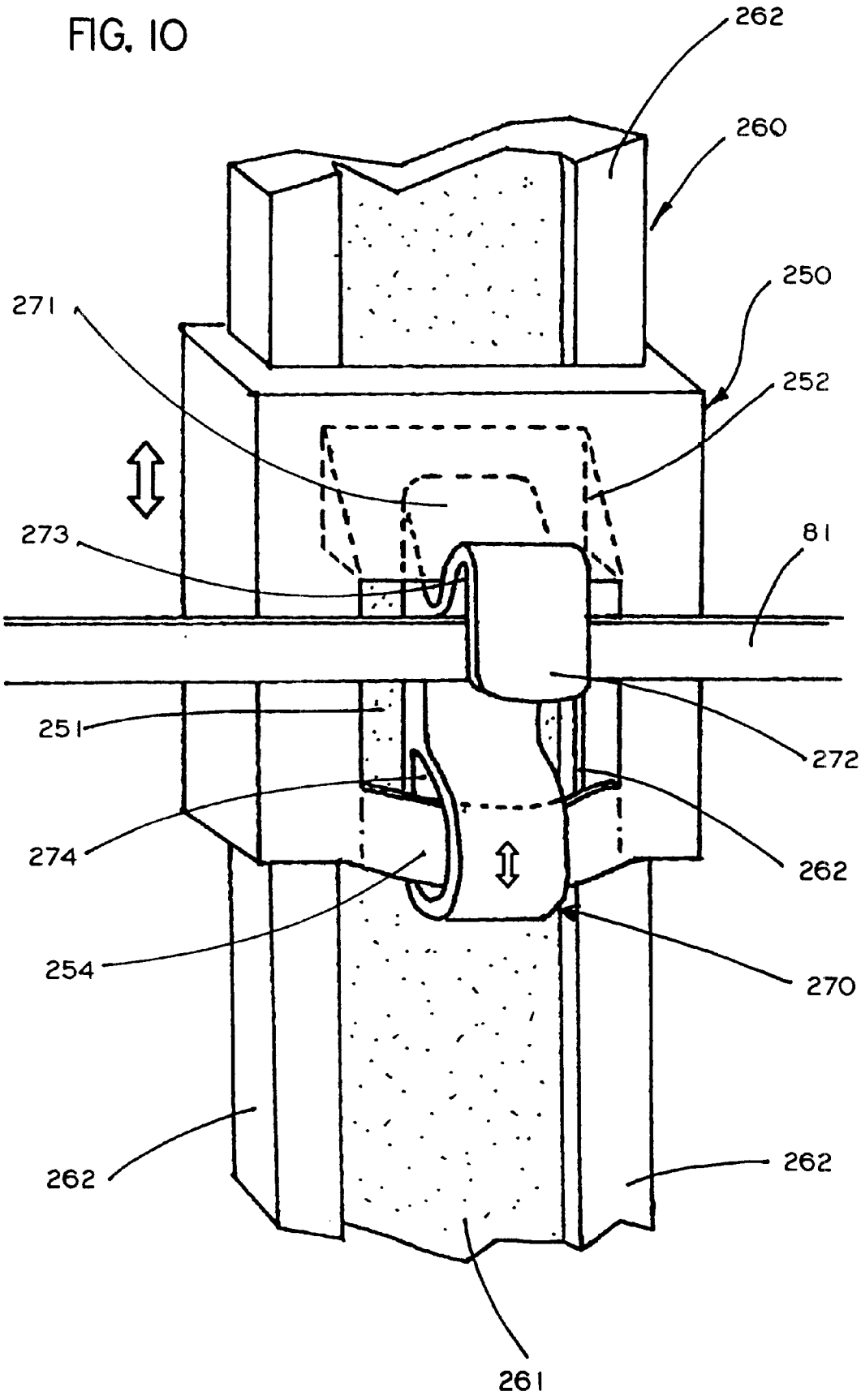
FIG. 10 is a partial transparent perspective view of an embodiment similar to that shown in FIGS. 8 and 9 but having a hook that is closer to the wedge, showing the wedge nearly trapped.

FIG. 10 shows an embodiment that is similar to that of FIGS. 8 and 9, except that it is configured so that activation is caused by pulling up and out rather than by pushing in and pulling up. Parts that correspond to those of FIGS. 8 and 8A are numbered with reference numbers 40 higher than those of FIG. 8 (e.g., guide rails 262 correspond to guide rails 222 of FIG. 8). As in FIGS. 8 and 9, sliding lock trap 250 slides vertically on guide rails 262 of vertical bar 260, and locking hook and wedge 270 in turn slides vertically and pivots a small amount via slot 274 on holder bar 254 of trap 250. The difference in activation force for this embodiment is due to the fact that the point at which hook 272 seats on bar 81 is on the same side rather than the opposite side of holder bar 254 as wedge 271. In other words, the pivoting action needed to pull the wedge out of wedging from between the brake strip and the interior surface of the pocket is opposite here because both the point to be moved and the point at which pressure are applied are on the same side of the fulcrum instead of at opposing sides of the fulcrum. Note that in FIG. 10, for purposes of illustration, crotch 273 of locking hook and wedge 270 is not shown as seated on bar 81. In situ, however, hook and wedge 270 would only be in the illustrated position if forced there by being seated on bar 81. When seated, with the weight of the hanging item transferred through crotch 273 onto bar 81 and into the wall, wedge 271 is jammed between the interior face of pocket 252 and brake strip 261. Similar to what is shown in FIGS. 9 and 9A, the side of wedge 271 facing brake strip 261 may have a high-friction surface.

To activate the assembly for vertical adjustment, the user applies outward tension on the hanging item and then lifts upwardly a bit on the item until wedge 271 unjams from between strip 261 and pocket 252. Because the embodiment of FIG. 10 is configured such that opening 274 does not extend up far enough, wedge 271 cannot entirely leave pocket 252 or escape through window 251. (Although it is not shown in FIG. 10, this embodiment could also be configured similarly to that of FIG. 8 inasmuch as wedge 271 could leave pocket 252 entirely so as to be able to escape through window 251.) Instead, wedge 271 can simply move down in pocket 252 such that the tip of wedge 271 is in a lower section of pocket 252 which is further from strip 261 (see the above description of the shape of similar pocket 212 of FIG. 8, which is similar to pocket 252). Then, while maintaining a modicum of outward pressure (which keeps wedge 271 pinned against the interior surface of pocket 252 but not jammed, and keeps the interior face of hook 272 pinned against the wall-facing side of bar 81), the user can pull the hanging item up or down, and sliding trap 250 will follow suit, sliding up and down along bar 260. (Optionally, there could be a catch on the lower part of the interior face of pocket 252 to hold onto wedge 271 during adjustment, or some other similar means to hold hook and wedge 270 together with trap 250 during the adjustment process). When adjustment is complete, the user simply releases the outward pressure, and then lowers the item until bar 81 forces wedge 271 (via pressure transmitted through crotch 273) to wedge between sliding trap 250 and brake strip 261. Note that opening 274 must extend downwardly far enough to allow holder bar 254 to move down without hitting the lower extent of opening 274 when wedge 271 is jammed between strip 261 and pocket 252 (i.e., when hook and wedge 270 reaches its highest point with respect to sliding trap 250).

In this embodiment, to ensure that wedge 271 never became irretrievably jammed (inasmuch as it cannot be unjammed in situ), a few optional devices could be employed. First, although it is noted above that the sliding trap should generally move as easily as possible along the vertical bar, there may be a modicum of friction between them so that when the item is pulled slightly upward, the whole jammed trap/hook and wedge does not simply follow downwardly on the bar, and instead separates from the bar such that a wiggle or shake on the item will cause the hook and wedge to fall out of the trap by its own weight. Another measure would be to press inwardly and then upwardly on the hanging item if wedge 271 stayed jammed, so that the bottom of bar 81 would hit the upwardfacing surface of hook and wedge 270 just above opening 274 (which protrudes outwardly a bit), snapping wedge 271 downwardly and out from between pocket 252 and strip 261. Further, the end of hook 272 could be provided with a barb (not shown) which would catch the bottom of bar 81 when the hanging item is pulled upwardly even if the item were not pushed inwardly (although this may make it harder to initially seat crotch 273 over bar 81 when hanging the item).

Figure 11:
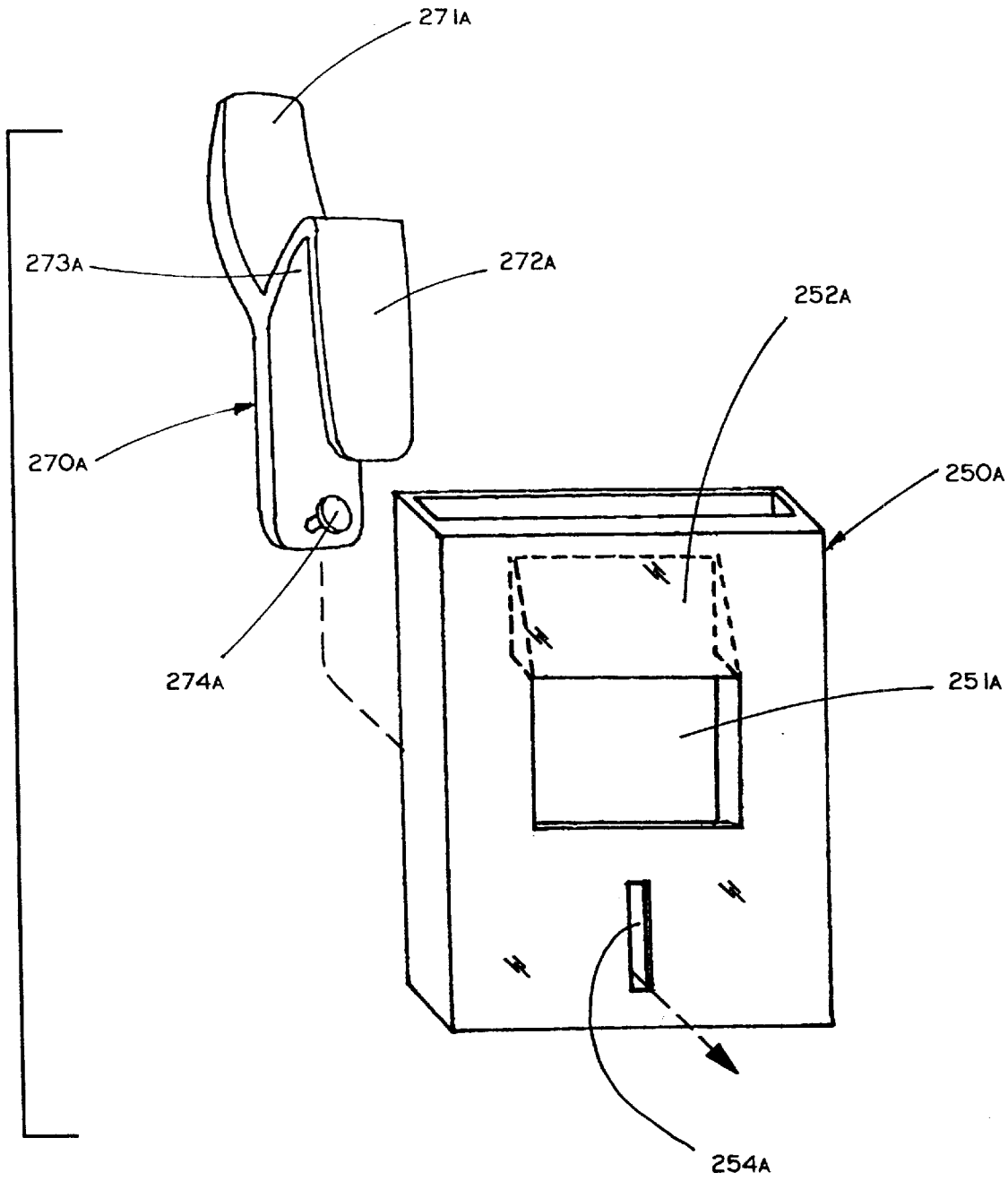
FIG. 11 is an exploded perspective partial view of an embodiment similar to that shown in FIG. 10 but having a different sliding connection between the hook/wedge and sliding trap.

The embodiment of FIG. 11 is similar to that of FIG. 10, except that instead of having locking hook and wedge 270 connected to sliding trap 250 with a female/male vertically sliding arrangement (opening 274 on holder bar 254), this embodiment has a male/female sliding arrangement, with diskcapped rod 274*a* sliding through and slightly pivoting within slot 254*a*.

FIGS. 12 and 12A show a generic box 300 that can be adapted for use in the lock embodiments of FIGS. 13–21. Box 300 is fixedly mounted to the rear of an item to be hung by way of mounting ears 306, and has a hollow cavity 304, and a vertical slot 301. For purposes of illustration in FIGS. 12 and 12A, the depth of sides 302 is exaggerated, and the height of box 300 is foreshortened. As viewed in FIGS. 12 and 12A, front side 303 of box 300 faces the wall and, in situ, will be adjacent to a mounting point on the wall such as wallbar 80 shown in FIGS. 1 & 3. In each of the embodiments of FIGS. 13–21, a downwardly pointing hook projects out through slot 301, along which it slides vertically during vertical adjustment.

The interior faces of sides 302 are chosen for the highest possible friction contact and gripping with the surface of the particular part of the embodiments of FIGS. 13–21 that will make contact there (discussed below). Conversely, the interior face of front face 303, and the slot sidewalls 307, may be coated with a slick surface such as TEFLON® in order to minimize friction with the downwardly pointing hook. The overall thickness of box 300 may be very important in certain configurations and it is thus desirable to minimize the depth of sides 302 to the extent that box 300 cannot be affixed or otherwise incorporated into the rear of the hanging item or frame in a recessed manner (i.e., with face 303 flush with the rear of the item), which means that materials such as steel or high-strength polymers may be most appropriate (to withstand the aforementioned forces). The interior faces of sides 302 should be of fairly high strength as some significant outward force may be applied to them by the apparatus described in FIGS. 13–21. Front face 303, however, generally need not be that strong and can thus be comparatively thin. As an example, using steel, front face 303 may be 1/64" thick, and rear wall 308 of box 300 may be 3/64" thick, with each measuring 2" wide by 8" tall; sides 302 may be 1/8" thick (excluding any interior coating such as rubber), and measure 8" tall by 5/32" deep. Such a configuration leaves a cavity 304 with a useable depth of (just less than) 3/32".

Figure 13:
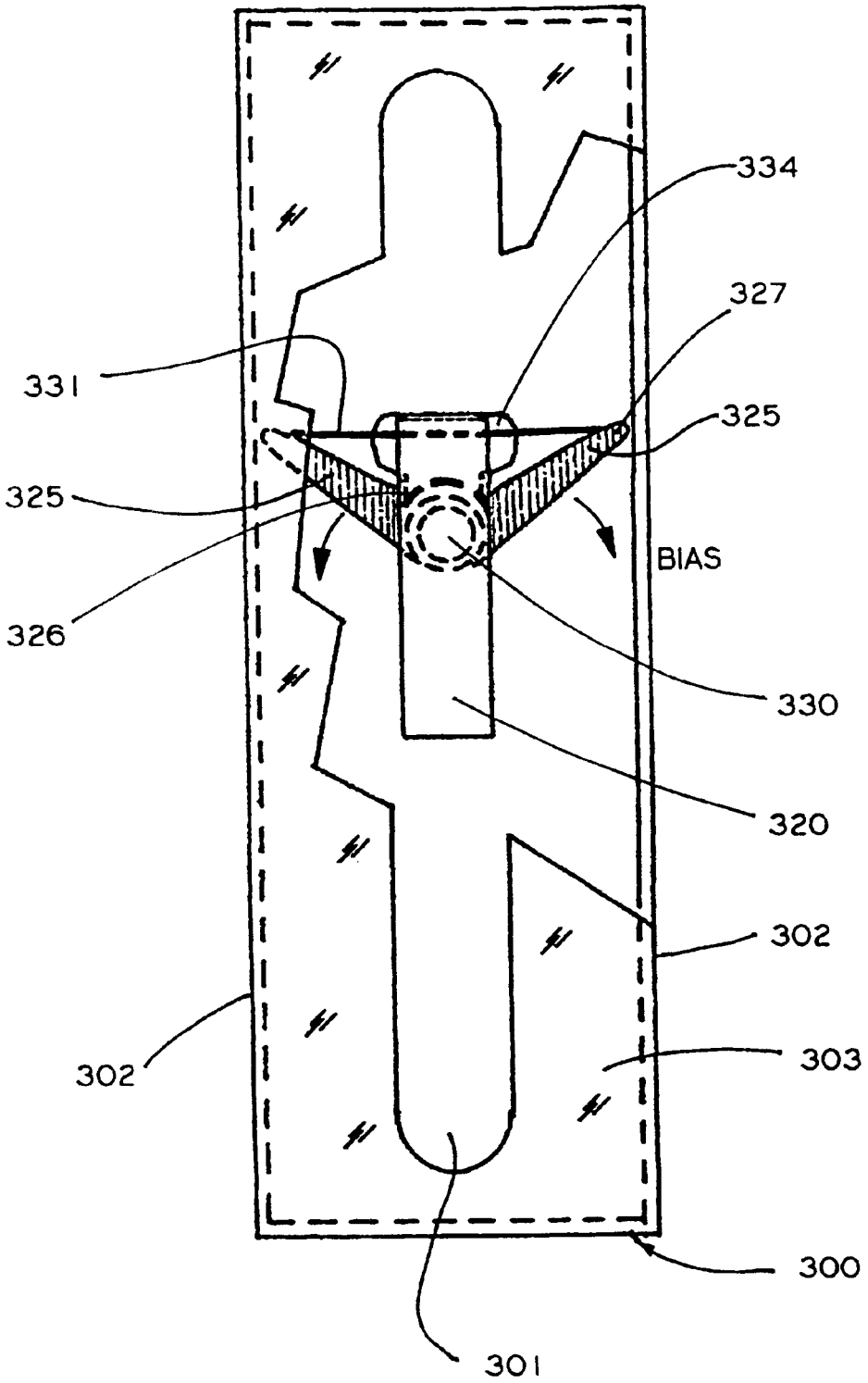
FIG. 13 is a partial front transparent cutaway view of a two-way adjustable embodiment including a version of the box of FIG. 12.
Figure 14:
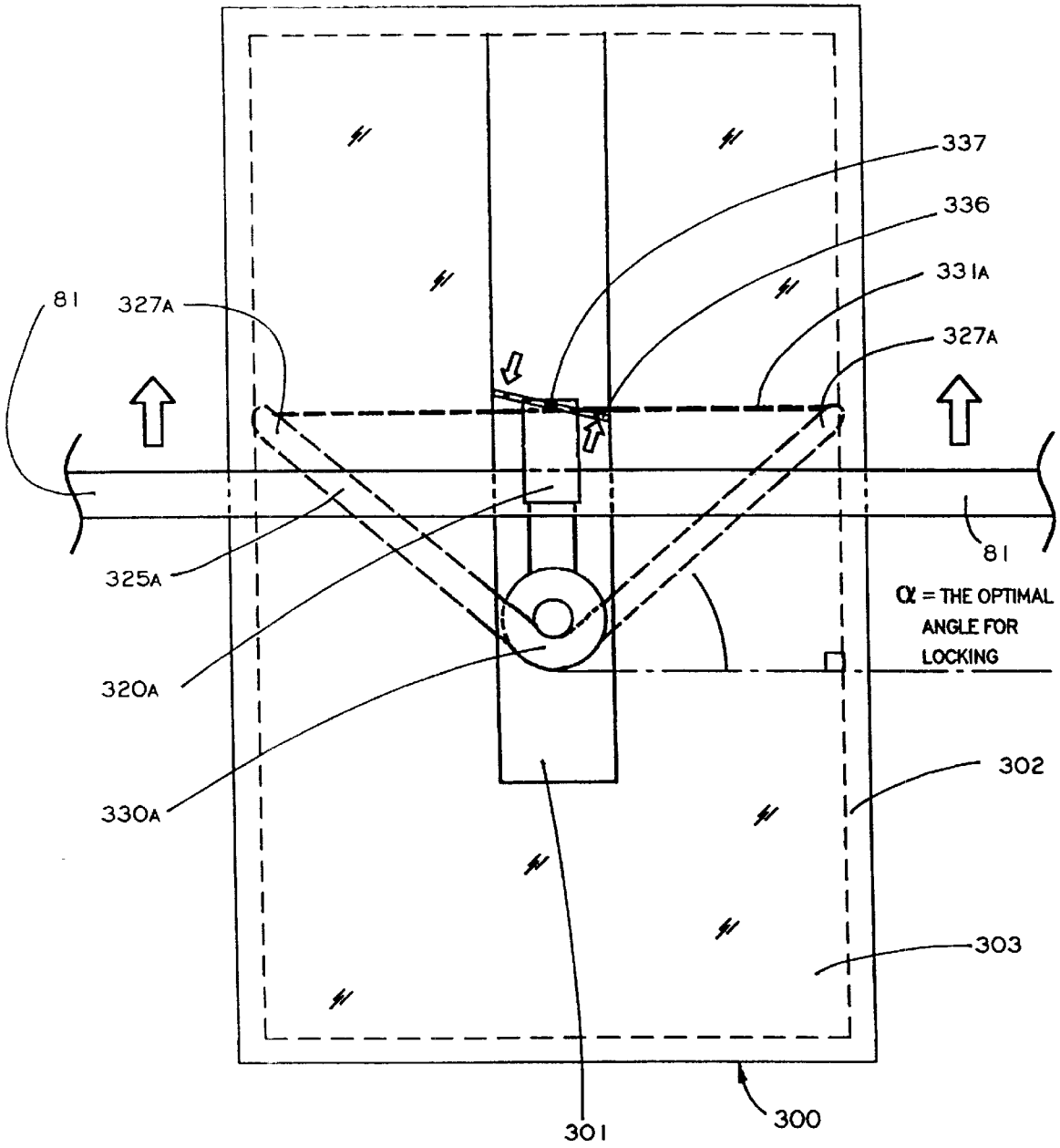
FIG. 14 is a front transparent view of an embodiment similar to that shown in FIG. 13.

FIGS. 13 and 14 show embodiments of the invention that are useable with a box similar to that of FIGS. 12 and 12A, and which utilize a bending hook and biased wings or arms lock assembly that slides vertically within the box during vertical adjustment. FIGS. 15–21 show embodiments of the invention that are also useable with a box similar to that of FIGS. 12 and 12A, and which utilize different configurations of an unbending hook and flippers that vertically slides in the box.

FIG. 13 shows a hook and wing lock assembly within a box. Hook 320 is "U" shaped, projects through slot 301, and includes a downwardly pointing portion that extends outside of the box and catches bar 81. The other end of hook 320 is attached to joint 330, which in turn has two wings 325 attached to it. At their inner radius, wings 325 are directly attached to each other with compressed spring 326; near their tips 327, wings 325 are attached by a taut cable 331. Taut cable 331 in turn passes underneath the top part of the upside-down "U" of hook 320. Optional vertical stabilizer lips 334 may be behind cable 331. The operation of this embodiment is partially similar to that of the embodiments of FIGS. 15–21 discussed below, inasmuch as locking is achieved in the same way, and is enhanced with the weight of the hanging item (see discussion below). In this embodiment, however, tips 327 are locked against the interior faces of sides 302 when at rest and pulling outward on the item causes this locking to be released. Pulling outward on the item releases the locking because the arm of hook 320 which connects to joint 330 is somewhat flexible, and outward tension causes it to bend outward through slot 301 and outside of box 300, taking part of cable 331 with it. Since cable 331 tautly connects tips 327 of wings 325, pulling outward on cable 331 pulls tips 327 toward each other and away from engagement with the inner surfaces of sides 302. Releasing tension allows them to relock. As is discussed regarding some of the vertically sliding assemblies of the embodiments of FIGS. 15–21 below, when outward tension is maintained on the hanging item, pulling up or down on the hanging item causes the vertically sliding assembly of this embodiment to follow, sliding up or down within cavity 304 and slot 301 of box 300.

FIG. 14 shows a bending hook embodiment that is quite similar to that of FIG. 13, except for its substitution of arms 325*a* for wings 325 and the substitution of sprung joint 330*a* for joint 330 and spring 326, and the addition of rotating safety catch 336. As a consequence of the addition of rotating catch 336, the operation of this embodiment is partially different than that of FIG. 13, in that pulling outward will not activate vertical adjustability unless the hanging item is first pulled upwardly a slight amount. That is because when the hanging item is hanging, bar 81 has the top of hook 320*a* and also catch 336 resting on it. This forces catch 336 to rotate on axle 337 into a flat horizontal position that cause its arms to physically lie behind and obstruct the edges of face 303 adjacent to slot 301. When the item is pulled upwardly, however, catch 337 no longer rests behind any part of face 303 and is fully visible in slot 301, because axle 337 is biased to rotate catch 336 out of the horizontal position, and this occurs as soon as bar 81 is no longer in contact with it. Consequently, after this upward pull on the item, applying outward tension on the item causes hook 320*a,* unrestrained, to pull on taut cable 331*a,* causing tips 327*a* to disengage from the interior surfaces of sides 302, allowing adjustment as described of FIG. 13.

Figure 15:
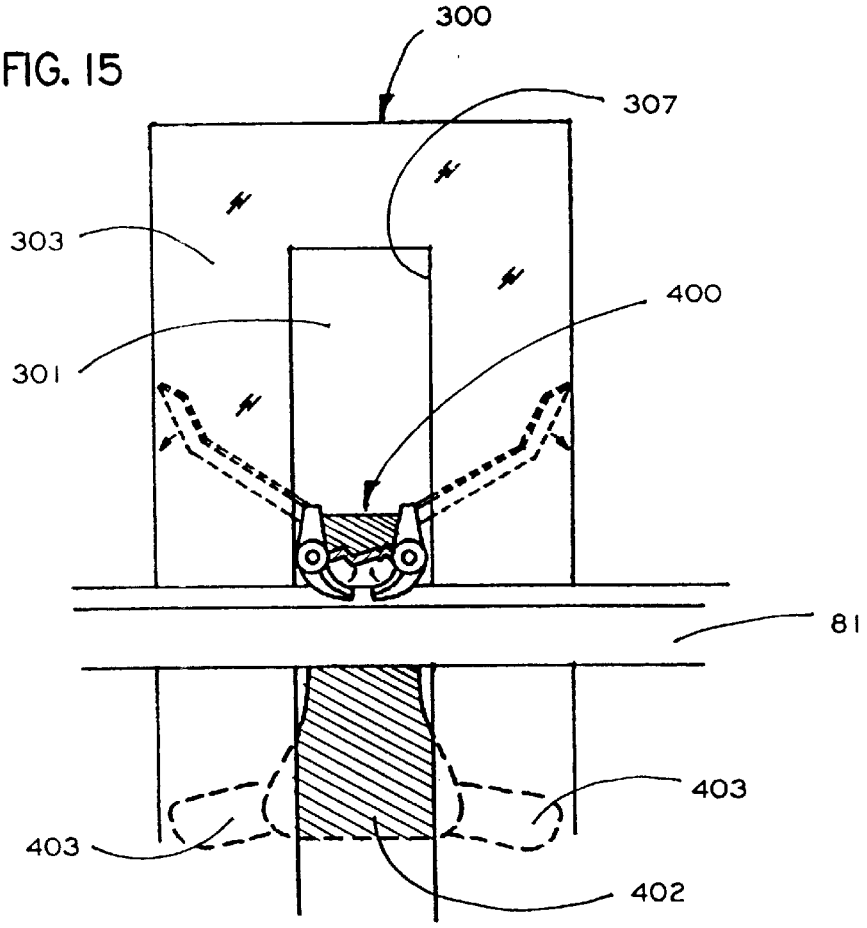
FIGS. 15 and 15A are a top perspective cutaway transparent view and a corresponding close-up view of part of a two-way adjustable embodiment, showing its actuators hitting the wallbar and the attached biased flippers moving towards the inner walls of the box.
Figure 15A:
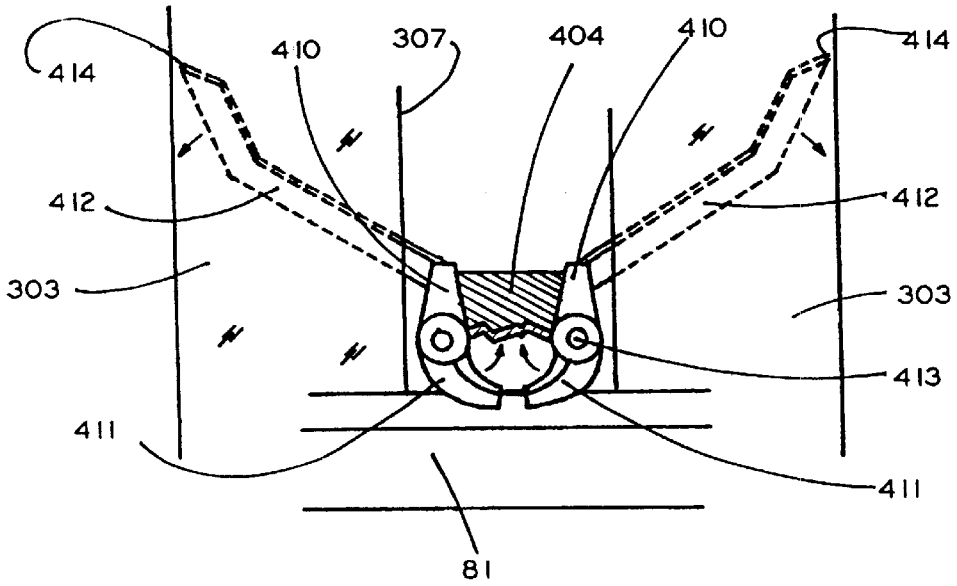
Figure 16:
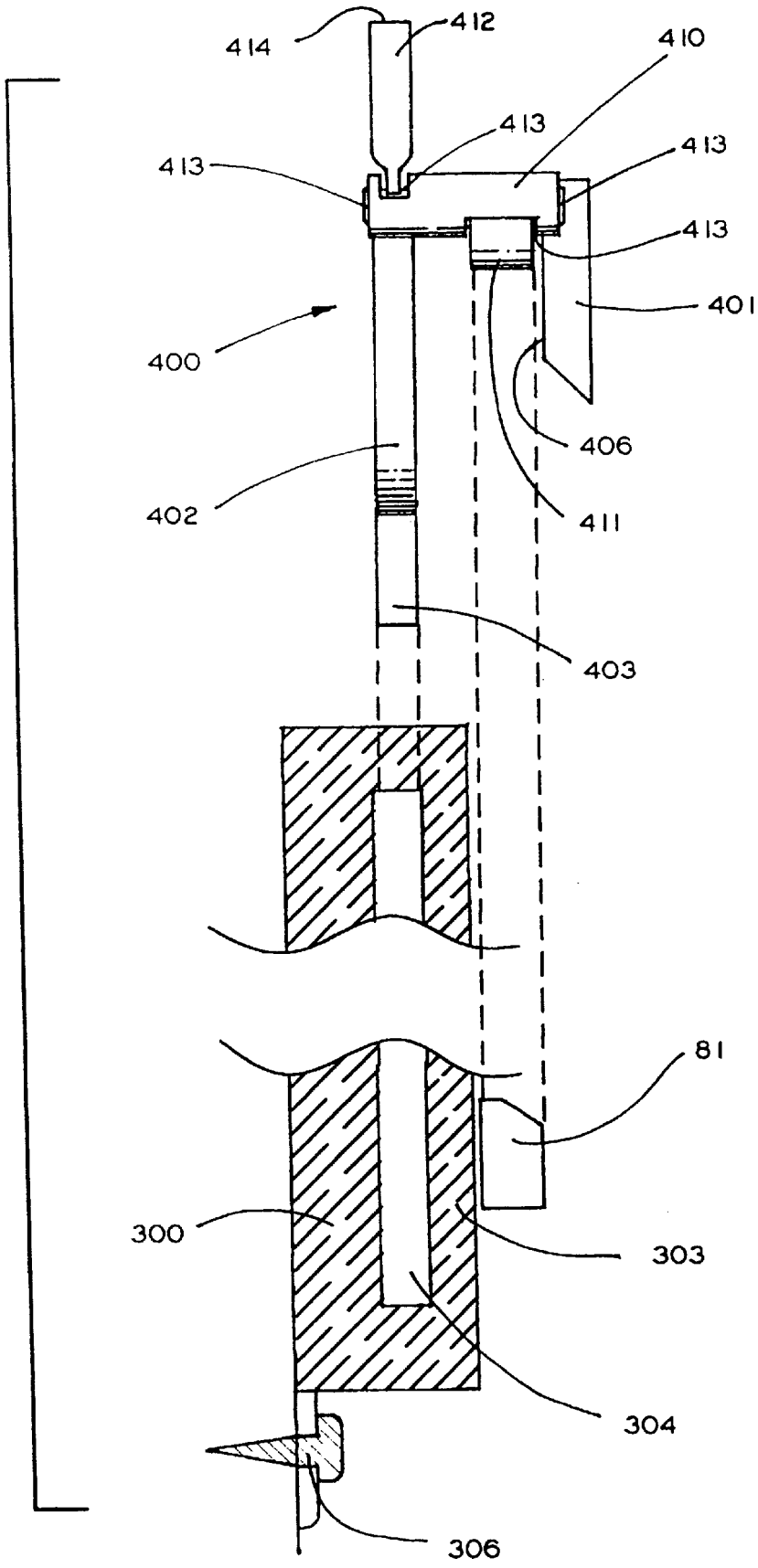
FIG. 16 is an exploded side view of the embodiment of FIG. 15, showing how the sliding locking hook assembly resides in the cavity of the box and how the flipper actuators rest on the wallbar and how the hook resides behind the wallbar.
Figure 17:
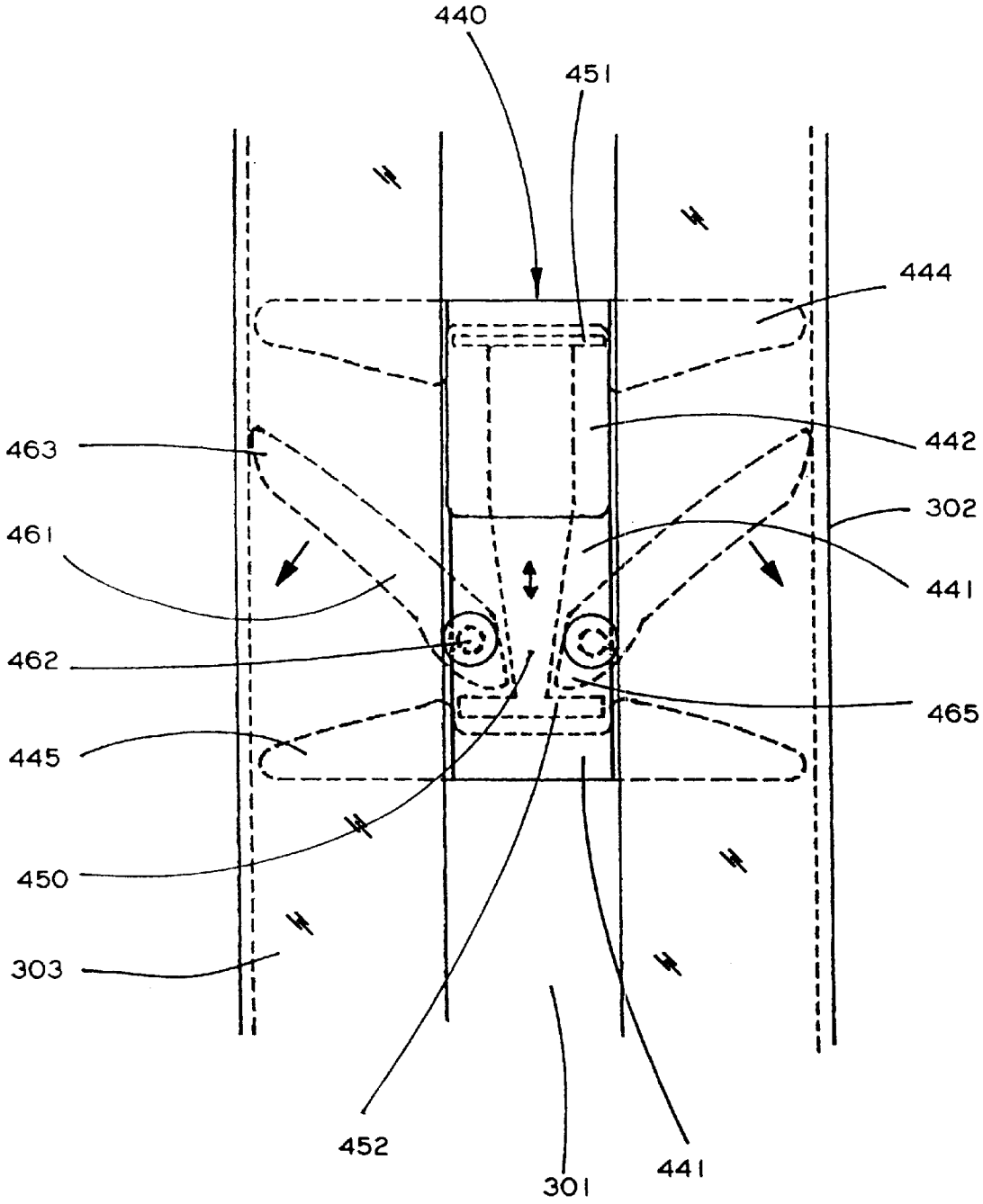
FIG. 17 is a front transparent view of an embodiment similar to that shown in FIGS. 15 and 16 but having a hook that is above the flippers.
Figure 19:
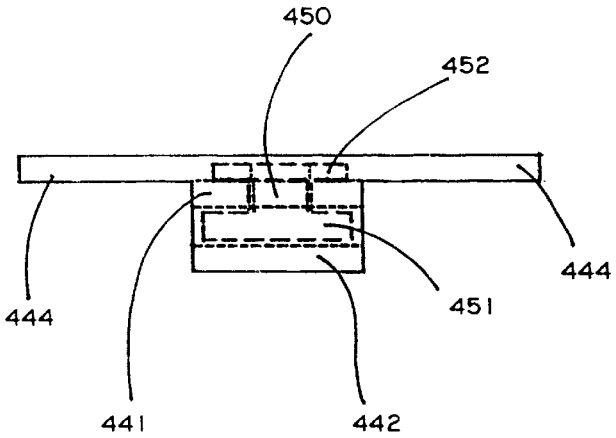
FIG. 19 is a partial transparent top view of the embodiment shown in FIGS. 17 and 18.
Figure 20:
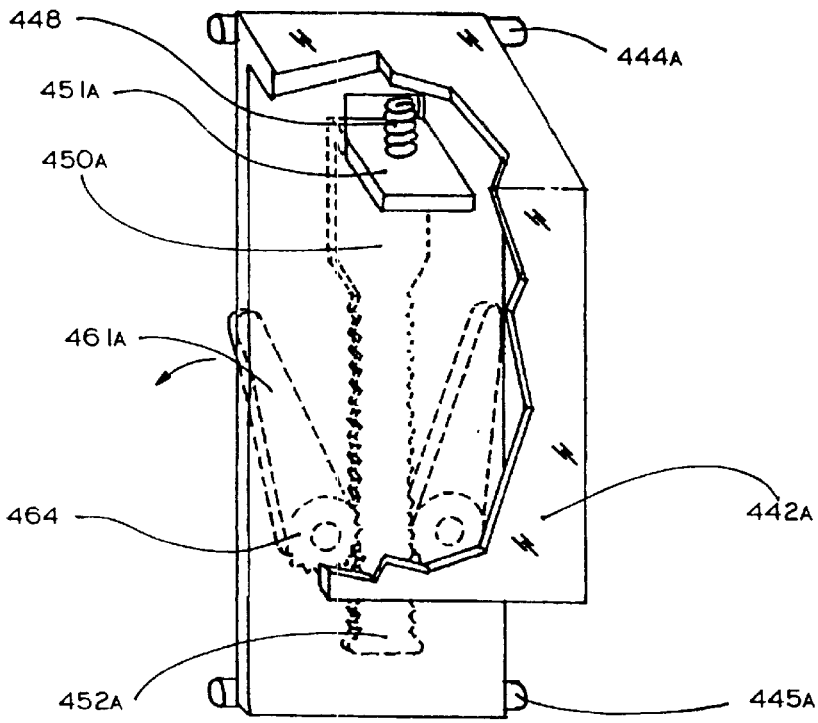
FIG. 20 is a partial transparent perspective cutaway view of an embodiment similar to that shown in FIGS. 17–19, but having a different actuator.
Figure 21:
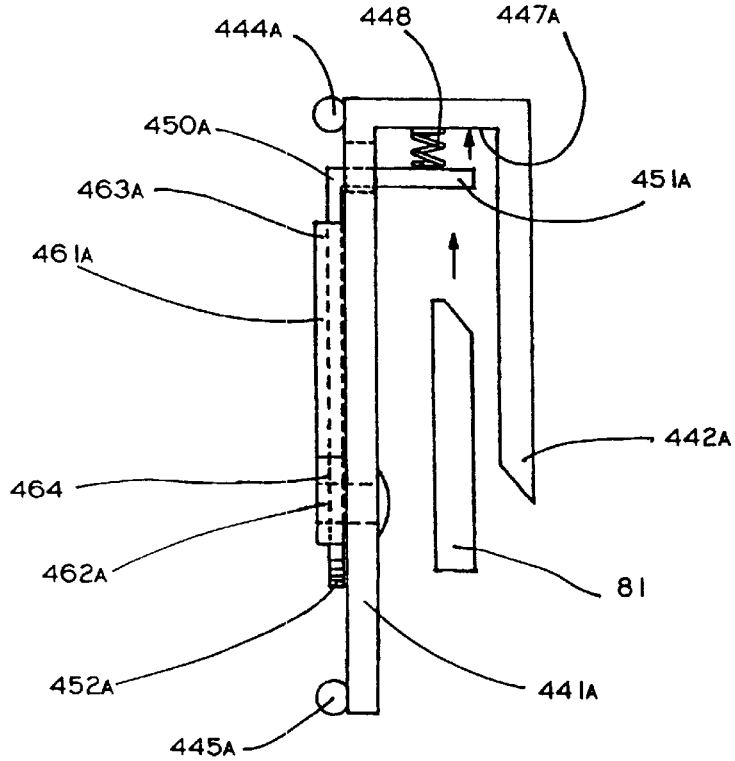
FIG. 21 is a partial transparent side view of the embodiment shown in FIG. 20.

FIGS. 15, 15A, and 16 show an unbending hook and flippers embodiment wherein the hook is below the flippers, while FIGS. 17–19 show a similar embodiment wherein the hook is above the flippers. FIGS. 20 and 21 illustrate an alternative embodiment to that of FIGS. 17–19.

FIGS. 15, 15A, and 16 show that vertically sliding locking hook assembly 400 resides primarily in cavity 304 of box 300. Therein, it may slide up and down with part projecting through slot 301, as can be seen from FIG. 16. Locking assembly 400 includes hook 401 (which is cutaway in FIGS. 15 and 15A where it connects to upper body 404 near the front, top region of assembly 400) which points downwardly and may be wedge-shaped to facilitate easy "finding" of bar 81 (which is attached to the wall as part of wallbar 80) when the hanging item is hung. Likewise, the top of bar 81 may be complementarily wedge-shaped in part (although not too much, as it may get stuck behind actuator 411) as shown in FIG. 16. Hook 401 connects to upper body 404 which connects axle housings 410. Upper body 404 is also connected to lower body 402 which includes wings 403 which serve to prevent rotation of assembly 400 within cavity 304 in the plane of the hanging item. Lower body 402 is completely contained with in cavity 304, and part of upper body 404 passes through and outside of front face 303 of box 300. Axle housings 410 run orthogonal to the plane of the hanging item and box 300, and contain axles 413 which rotate freely therein. Near the front end of axles 413 are connected downwardly facing flipper actuators 411. Near the rear end of axles 413 are connected upwardly facing flippers 412 which include wedging tips 414 designed to readily wedge into and grasp the interior faces of sides 302 of box 300 under a small amount of force. A bias means (not shown) is provided so that, at rest, tips 414 are lightly urged slightly away from the interior faces of sides 302.

Accordingly, when hook 401 of the item to be hung is positioned over and lowered onto wallbar 80, actuators 411 hit the top surface of bar 81, causing them to counterrotate with their tips moving upwardly (indicated by arrows in FIGS. 15 and 15A). At the same time, this causes axles 413 to counterrotate, and tips 414 to rotate downwardly and into the interior surfaces of sides 302. Thereupon, wedging tips 414 bite into sides 302 (which may be, for example, rubber coated); any further downward force on the hanging item, such as that due to its own weight, simply causes tips 414 to bite even more strongly, and hook 401 of assembly 400 is locked in its vertical position. Downward force from the hanging item may increase the locking bite of tips 414 through at least two mechanisms; first, any added rotation at actuators 411 will further rotate tips out towards sides 302; second, the added downward force on tips 414 applied by sides 302 simply applies further leverage at tips 414 causing them to attempt to rotate further outward.

To accomplish automatic vertical adjustment, the user pulls slightly upwardly on the item, which allows the bias of axles 413 to unlock tips 414 from the interior faces of sides 302. The user then pulls slightly outwardly on the hanging item, such that hook inside face 406, which may have a somewhat high-friction surface, is in tension with the wall-facing side of bar 81. Maintaining this tension, the user then simply pulls the hanging item up or down to a desired level and then releases the outward tension. When the user is pulling the hanging item up or down, sliding assembly 400 follows suit, sliding vertically in cavity 304 and slot 301. When the user releases outward tension (whether or not the vertical position of the hanging item is maintained), sliding assembly 400 falls downwardly by its own weight and onto the top of bar 81, causing actuators 411 to rotate axles 413 and push tips 414 to sides 302. Then, as the user lets go of the hanging item, the item's weight locks tips 414 into sides 302, as described above.

FIGS. 17–19 show an embodiment that operates somewhat similarly to that of FIGS. 15, 15A, and 16, except that the area where the hook rests on the wallbar is above the flippers. In this embodiment, sliding locking hook assembly 440 consists of three layers as can best be seen in FIG. 18 (which omits the flippers for clearer illustration). One layer resides entirely in cavity 304 of box 300, the second layer, adjacent to the first, resides in slot 301, and the third layer, adjacent to the second, resides outside of box 300. The first layer includes lower tabs 445 and upper tabs 444 which keep the assembly 440 aligned, and it includes flippers 461 and part of flipper axles 462. The second, middle, layer includes mid-body 441 of assembly 440, trigger channel 449, and part of axles 462. The third, outside, layer includes hook 442 and hook ceiling 447.

Also, trigger 450 runs through all three layers, starting with actuator bar 452 in the first layer just below axles 462, running up to and through trigger channel 449 in the middle layer, and into the third layer where it ends with trigger plate 451 which is parallel to and just below hook ceiling 447. Trigger 450 does not fall out of assembly 440 because trigger plate 451 is wider than channel 449, and because actuator bar 452 cannot rise above actuator tips 465 which are almost the same thickness as cavity 304. Also, trigger 450 has enough strength to substantially retain the right angle bend at its top adjacent to plate 451 when pressed by bar 81.

Operation of this embodiment is similar to that of the embodiment of FIG. 15, except that trigger plate 451 is lowered down onto bar 81, whereupon trigger plate 451 rises (channel 449 having enough vertical leeway for it to do so) close to or adjacent to ceiling 447. As it does so, trigger 450 pulls actuator bar 452 upwards whereupon it strikes actuator tips 465 at the bottom of flippers 461, causing wedging tips 463 to drive into the interior faces of side 302, locking the vertical position in box 300 of assembly 440. Similar to the embodiment of FIGS. 15, flippers 461 and/or axles 462 are preferably biased toward the unlocked position, and the weight of a hanging item increases their locking once they have "bitten" (which is accomplished by lowering hook 442 down behind bar 81 whereupon trigger plate 451 is pressed upwards, raising actuator bar 452 into actuator tips 465 sufficiently to overcome the aforementioned bias).

A major advantage of this embodiment is that hook ceiling 447—which rests atop bar 81—is very close to the top of assembly 440. Assembly 440, in turn, can come very close to the top of box 300, assuming slot 301 is extended up sufficiently. Accordingly, the more desirable potential adjustability zone toward the top of the hanging item is maximized.

FIGS. 20 and 21 show an embodiment similar to that of FIGS. 17–19, with the main difference being the addition of geared axle heads 464 at the ends of axles 462*a,* and the substitution of toothed actuator rod 452*a* for actuator plate 452. The teeth of actuator rod 452*a* mesh with the gears of axle heads 464. As shown, rod 452*a* may also increase in width towards its bottom. Further differences in this embodiment are the addition of springs 448 between ceiling 447*a* and the top of plate 452*a,* and the substitution of guide rods 444*a* and 445*a* (which may be, for example, TEFLON®-coated), for tabs 444 and 445, respectively.

Figure 22:
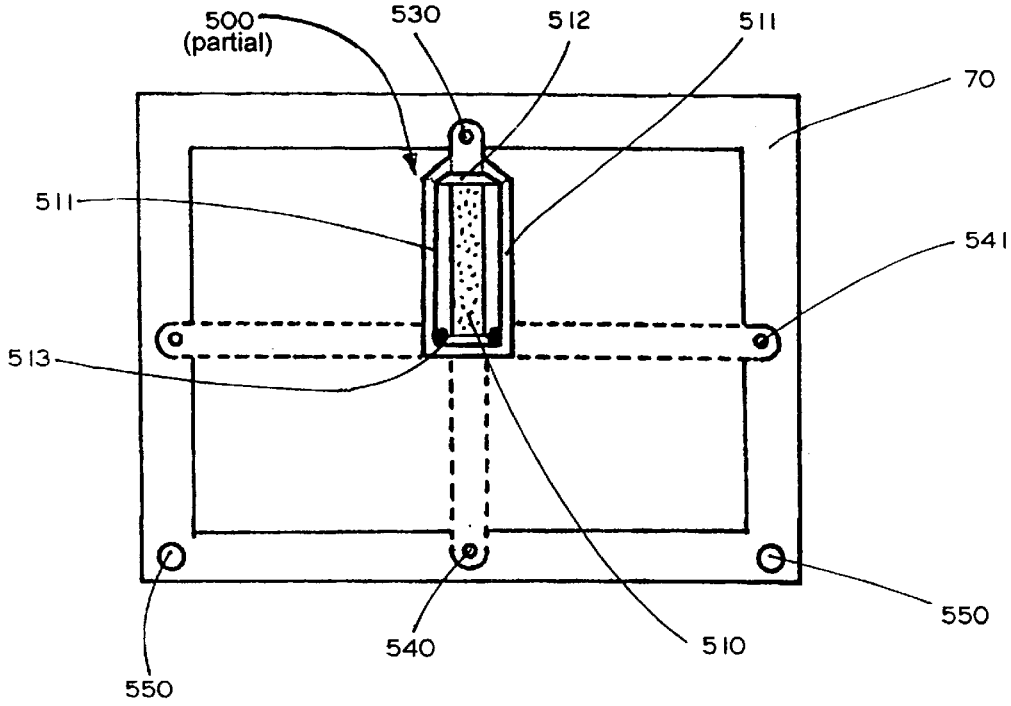
FIG. 22 is a front view of part of a two-way adjustable embodiment that attaches to the rear of a frame or the like, showing how the brake pad and rail assembly may be attached.

FIG. 22 shows an embodiment having two parallel guide rails 511 attached on either side of a locking brake pad 510. Locking brake pad 510 can be rubber, grooved metal or plastic, or other like means that are well known in the art. Relative to rails 511, brake pad 510 is depressed towards the rear of the item to be hung. Assembly 500 is preferably positioned on frame 70 so as to extend along the weight centerline, from the top portion to about the vertical midpoint of the frame 70; attachment may be by nail, pin, glue, et cetera. A small extension 530 can project from the top for nailing to the top of frame 70 of the item to be hung. Additionally, a manually adjustable-lengthed (or one sized to fit standard frames) bottom extension 540 can be used to attach to the bottom of the frame, or, alternately, a horizontal bar 541 (manually adjustable or in stock lengths) can be provided at the bottom of assembly 500, to allow attachment to the sides of frame 70. Another alternative is to provide a flat-backed assembly that can be glued or similarly adhered to a suitably flat rear surface of an item to be hung. Such an adhesive could be preapplied to the back of the assembly, and covered with a peel-off plastic liner.

Because assembly 500 may create some physical obstruction between the frame 70 and the wall, bumpers 550 can be provided for placement at the bottom corners of frame 70 to allow equalization and control of the distance from the wall. Such bumpers could be, for example, felt, rubber, or plastic, but may need to be slightly compressible to accommodate the inward activation force required for vertical adjustment (discussed below). Such bumpers could also be placed at the top of frame 70, to serve as a biasing means to urge the top of frame 70 just slightly further away from the wall than assembly 500 would dictate, ensuring that the hanging item would not accidentally unlock (locking and unlocking is described below).

Figure 23:
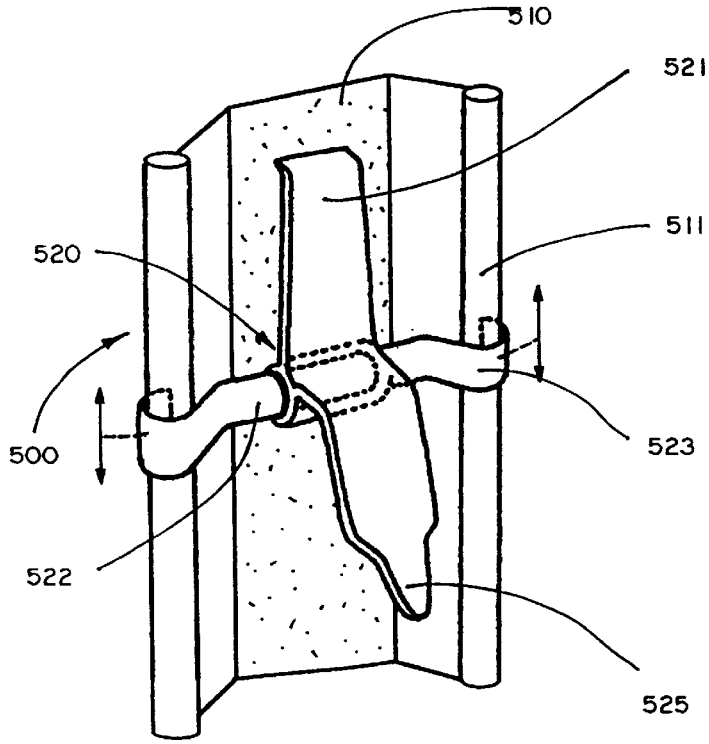
FIG. 23 is a partial perspective view of the embodiment of FIG. 22, showing how the vertically sliding locking hook attaches to and moves relative to the brake pad and rail assembly.

Finally, there may be a projection 512 at the top of brake pad 510 that serves as an upper stop for the brake foot 521 (see FIG. 23), and there may be projections 513 at the bottom of guide rails 511 to serve as lower stops for sliding grips 523 (see FIG. 23).

In FIG. 23, the connection of vertically sliding hook assembly 520 to guide rails 511 and brake pad 510 is shown. Hook assembly 520 can travel up and down rails 511, unless brake foot 521 is engaged with brake pad 510. Brake pad 510 is attached to guide rails 511 down their length, however, this attachment could alternatively just be at the top and bottom (similarly to the embodiment of FIG. 27), allowing sliding grips 523 to fully enclose or wrap around rails 511.

Figure 24:
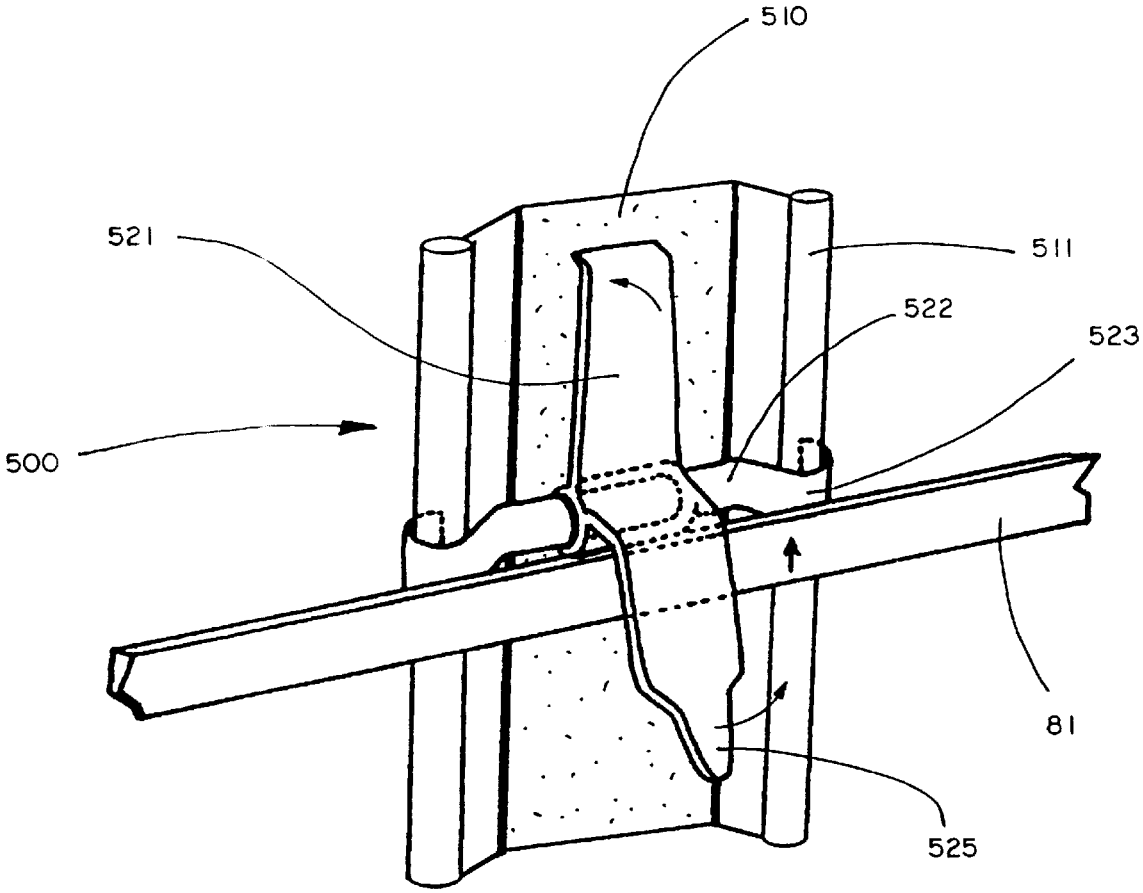
FIG. 24 is a partial transparent perspective view of the embodiment of FIGS. 22 and 23, showing how the hook seats on the wallbar, causing the brake foot to catch in the brake pad under load.

As shown in FIGS. 23 and 24 (indicated with arrows), when loaded with a hanging item, hook 525 rotates counterclockwise as viewed from the left, causing engagement of brake foot 521 with brake pad 510. FIG. 24 shows how the bar 81 of wallbar 80 (not fully shown), which is affixed to the wall (see FIGS. 1 and 3), applies a relative upward force in opposition to the load of hook 525, causing hook 525 to rotate about axis 522, forcing the distant end of brake foot 521 to rotate into brake pad 510. It can also be seen from FIG. 24 that hook assembly 520 can freely slide left or right upon bar 81. To ensure level hanging (where a single mounting device is used), it may be desirable to provide means allowing for horizontally adjusting the attachment of assembly 500 to frame 70; hook 525 and/or sliding grips 523 can also be widened.

Figure 25:
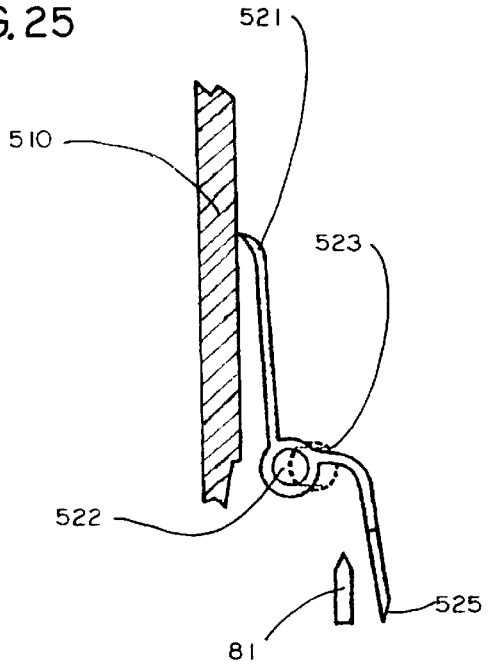
FIGS. 25 and 25A are a sequence of partial side views of the embodiment of FIGS. 22–24, showing how the hook seats on and mates with the wallbar, causing the brake foot to lock in the brake pad under load.
Figure 25A:
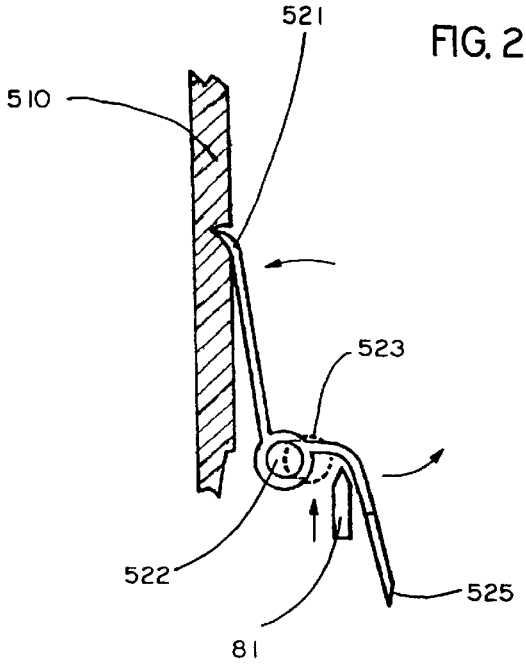

FIGS. 25 and 25A show a sequence wherein hook assembly 520 is seated over bar 81, causing engagement and locking. Bar 81 nests between hook 525 and the front extent of sliding grips 523 (shown in phantom). To facilitate insertion and seating of hook 525 behind bar 81, it may be beneficial to form hook 525 at somewhat of an angle. But, to prevent that angle from causing the tip of hook 525 to excessively impinge on the wall, the portion of hook 525 that extends below bar 81 may comprise an easily flexible but resilient material such as plastic, and simply act as an insertion guide.

Figure 26:
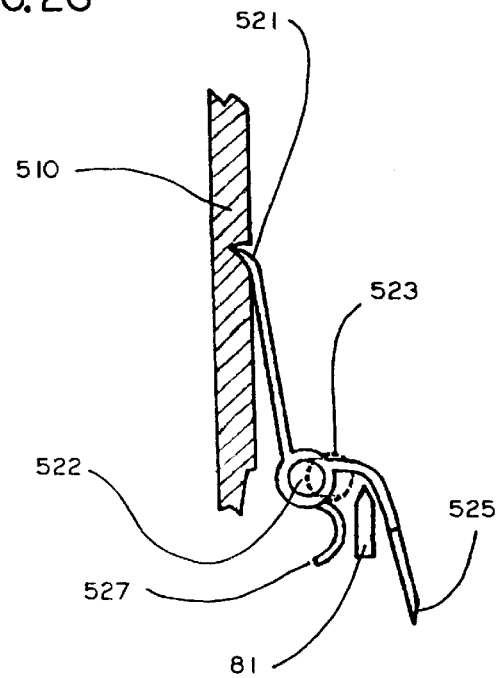
FIGS. 26 and 26A are a sequence of partial side views of an embodiment similar to that shown in FIGS. 22–25 but also having an activation catch, showing how the catch ensures unlocking of the brake when the frame is moved towards the wall.
Figure 26A:
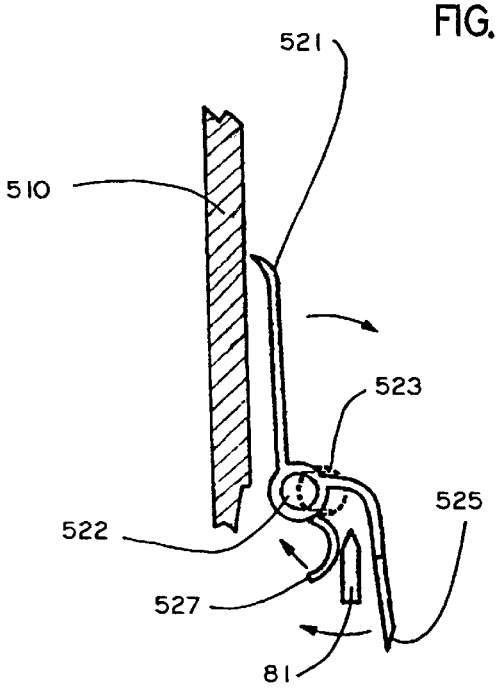

FIGS. 26 and 26A show a second sequence wherein the engaged and locked assembly is activated for adjustment. In the depicted embodiment, when the top of frame 70 is pushed inward (i.e., towards the wall) and upward, brake foot 521 disengages from brake pad 510. This disengagement is ensured through the force of gravity acting on hook 525 and/or the force exerted through hook 525 as it impinges more immediately against the wall. FIGS. 26 and 26A also show an optional catch mechanism 527 which provides further insurance that, when desired, brake foot 521 can be unlocked from brake pad 510. When locked, catch 527 does not impinge on bar 81; however, when the top of frame 70 is pushed marginally towards the wall, bar 81 hits catch 527, helping brake foot 521 to rotate out of engagement.

Figure 27:
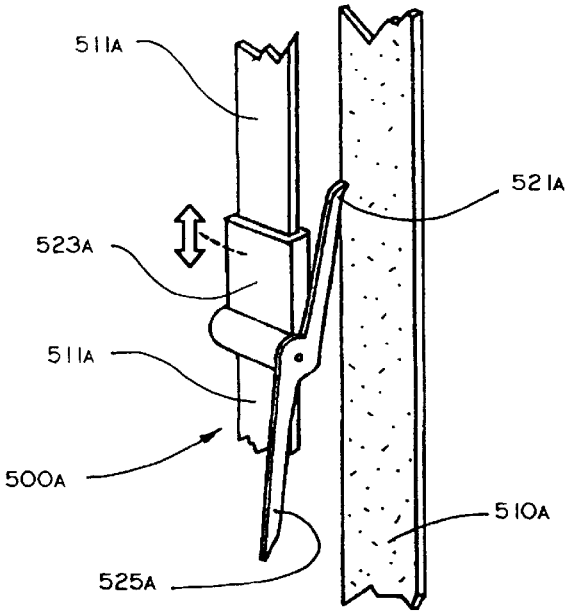
FIG. 27 is a perspective view of part of an embodiment similar to that of FIGS. 22–26 but having only one guide rail and a brake pad articulated therefrom, showing how the hook forces the brake pin/foot into the brake pad under load.

FIG. 27 shows a single guide rail embodiment wherein brake pad 510*a* is separated from guide rail 511*a* except at the top and bottom (not shown). An embodiment such as this could be used in dual, opposing fashion, to better distribute the weight of the hanging item. Embodiments could also readily be imagined with one or more guide rails, wherein the rails were not directly attached to brake pad 510*a* at all, but instead independently attached to the rear of the hanging item. In such an embodiment, brake pad 510*a* may also be glued to the rear of the hanging item.

Figure 28:
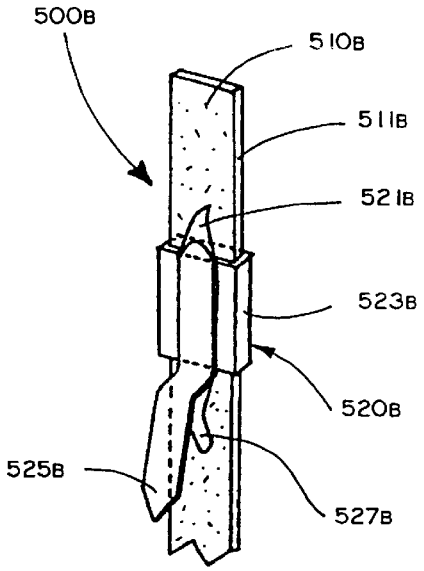
FIG. 28 is a perspective view of an embodiment similar to that of FIG. 27 but having the brake pad and guide rail integrated, showing how the hook forces the brake tooth into the brake pad under load.

FIG. 28 shows a simplified mechanism 500*b* wherein hook 525*b* is integrally connected to a sliding grip 523*b* and brake tooth 521*b*, and brake pad 510*b* is integrated into guide rail 511*b*. Similarly to what is shown in the previous Figures, loading hook 525*b* causes brake tooth 521*b* to engage brake pad 510*b*. The underside of an optional activation catch 527*b* (similar to that in FIGS. 26 and 26A) should be formed so as not to catch in brake pad 510*b*.

Figure 29:
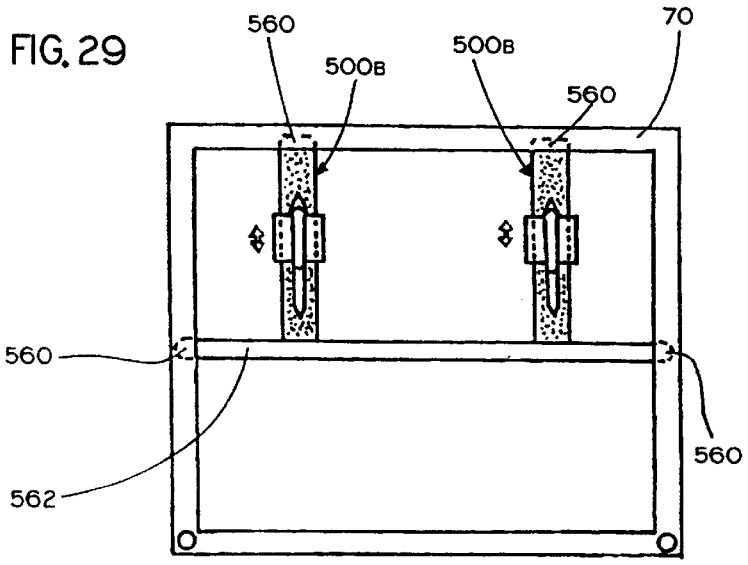
FIGS. 29 and 29A are a front view and a side perspective view of an embodiment similar to that of FIG. 28 but integrated with a frame, and dual, showing how the devices are integrated with the frame, and how the hooks engage the wallbars mounted to the wall.
Figure 29A:
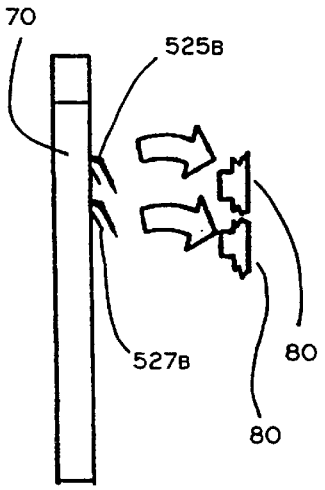

FIGS. 29 and 29A show other ways of attaching or integrating the vertically adjustable assembly into the rear of a frame 70. The invention could be designed to be manufactured into frame 70, or it could be designed for retrofitting in bulk based on standard frame sizes. For example, it could be provided with knife edges 560 which wedge into the inner edge of frame 70, and/or it could be provided with a lower cross member 562 with similar knife edges 560. It should be noted that this integration helps minimize the degree to which there is a physical obstruction between frame 70 and the wall, and also provides the consumer with an easier, more professional approach. Also, as shown, the invention can be doubled (or more) so as to provide a further measure of leveling, stability, and strength. It is not only the vertically adjustable assembly of the embodiment of FIG. 29A that is susceptible of being incorporated into or attached to a frame-back in the aforementioned ways either by a manufacturer, retrofitter, framer, or consumer, and many other embodiments discussed herein are similarly adaptable.

FIGS. 30 and 30A show an embodiment providing vertical adjustability, wherein upwardly pointing hook 575, mounted on the wall via nail/screweye 574, is trapped by lock trap 570 which slides vertically along vertical bar 580 which may preferably have an elliptical or rectangular cross-section. Lock trap 570 includes pocket 571, which is placed over tip 577 of hook 575 and lowered until frictional region 576 of hook 575 hits frictional strip 581 (indicated by an arrow in FIG. 30A) of vertical bar 580 (mounted to the rear of the item to be hung at screweyes 583) and hook 575 wedges between the interior face of pocket 571 and strip 581. When hook 575 is thus trapped, vertical movement of the trap along bar 580 is prevented, locking the hanging item's vertical position. When the item is pulled upwardly, however, trap 570 moves up just slightly with respect to hook 575, loosening its grip. At this point, pulling outwardly on the hanging item causes frictional region 576 to lose contact with frictional strip 581; it also causes tension to be applied to trap 571 at frame-facing side 582 of bar 580. The frame-facing side 582 of vertical bar 580 may be a slick surface so as to foster vertical sliding of trap 570 along bar 580 when hook 575 is not trapped in trap 570. In this fashion, while an outward tension is maintained on the hanging item, hook 575 can be used to pull or push trap 570 upwardly or downwardly (respectively) along bar 580. When adjustment is completed, outward tension on the hanging item is discontinued, and a slight push inward on the hanging item is applied along with a slow and firm downward nudge to lower trap 570 over hook 575. A slight shake may also encourage the trap to "set." Hook 575 should be at least as long in its vertical upward extent as the vertical length of pocket 571 to ensure sufficient wedging action is available (rather than being obstructed by the lower extent of trap 570 hitting the crotch of hook 575). Also, simplified versions similar to the embodiment of FIGS. 30 and 30A can readily be imagined, such as one wherein trap 570 is simply a heavy rubber ring, bar 580 is simply a rod, and hook 575 has a fish-hook shape and a cylindrical cross-section.

FIGS. 31 and 31A show part of an embodiment similar to that of FIGS. 30 and 30A, but which also provides horizontal adjustability. Upwardly pointing hook 595 is slidably mounted in horizontal slider 590 which is affixed to the wall. Horizontal slider 591 includes slotted slider 591 and nail or screw screweyes 594. Slotted slider 591 has slot 592 in which hook 595 slides horizontally. Hook 595 is connected by connector 598 (which may be embedded in hook 595) to endpiece 593 which prevents hook 595 from rotating or being pulled upwardly and out of slot 592. As with the hook in the embodiment of FIGS. 30 and 30A, hook 595 includes a frictional region 596 and a tip 597. As shown in phantom in FIG. 31A, the side of hook 595 where frictional region 596 resides may extend further out than the face of slider 591 so that hook 595 may be trapped in pocket 571 without the face of slider 591 impinging upon vertical bar 580.

Figure 32:
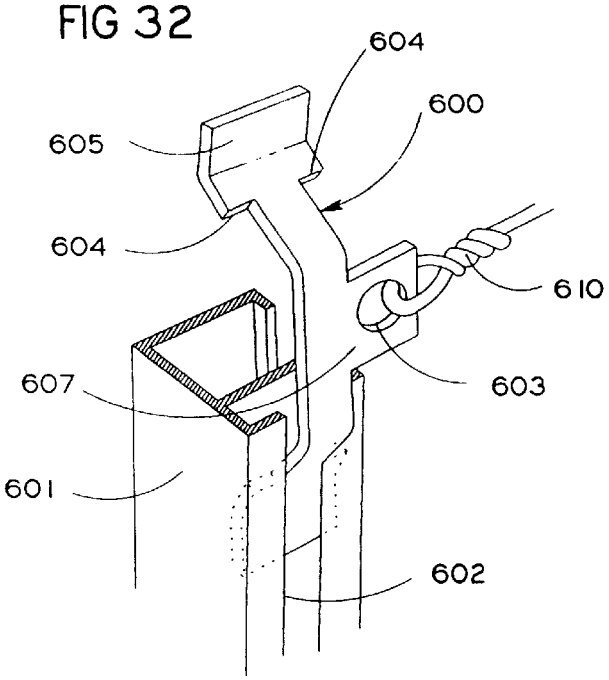
FIG. 32 is a perspective view of a prior art device commonly used to hang cable across the backs of frames made from aluminum channel.
Figure 33:
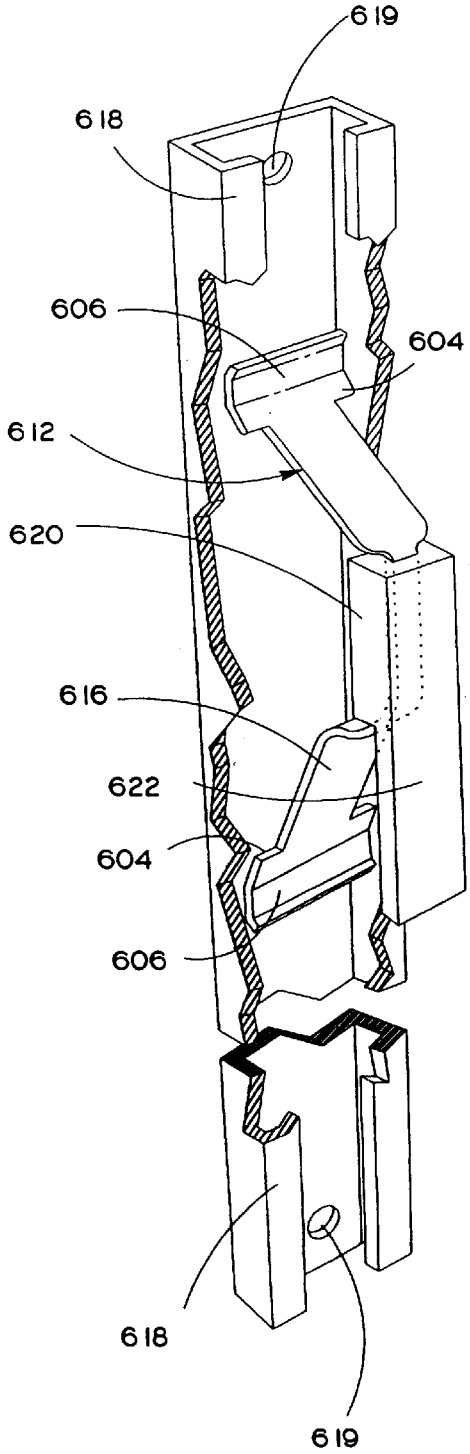
FIG. 33 is a cutaway perspective view of a two-way adjustable embodiment wherein vertical adjustment is activated by pressing the hanging item in toward the wall.
Figure 34:
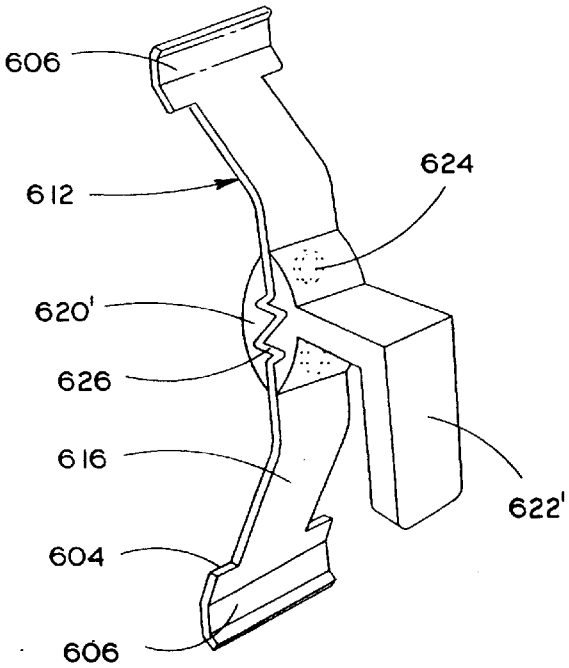
FIG. 34 is a partial perspective view of an embodiment similar to that of FIG. 33.

FIGS. 33 and 34 show two versions of a two-way adjustable embodiment wherein vertical adjustability is activated by pressing inward against the hanging item and into the wall. FIG. 32 shows a prior art hanging device that relies in part on a similar mechanism which will be described here first for reference. This prior art device is now commonly used to secure a conventional horizontal hanging cable to the rear of hanging items having an aluminum channel frame such as that shown here as 601. In these devices, a sliding grip 600 is placed in a channel of each side of the frame 601, and has attachment point 603 to which one end of the horizontal cable 610 is attached. A similar mirror image sliding grip (not shown) placed in the opposing side of frame 601 secures the other end of the cable 610. The sliding grip 600 is metallic and biased so that its front surface 607 and uppermost extensions 604 of the feet 605 urge outwardly at rest, with the extensions 604 forcefully impinging against the opposing interior edge of the channel 602 so as to strongly inhibit sliding movement of grip 600 with respect to channel 602 at rest. Both sliding grips 600 can be adjusted upwardly or downwardly by manually pressing on surface 607 against the bias of grip 600, which allows the feet 605 to move away and unlock from the opposing edges of channel 602, allowing the grip 600 to move more freely up or down in channel 602. Pressing against the grip's bias may make more oblique the angle at which the distal tips of feet 605 impinge on the interior of channel 602 further rendering sliding more facile. In any event, when the grip 600 is pressed, moved, and located at a desired position, the inward pressure on the front surface 607 is released, and the feet 605 lock into the channel 602 again. This procedure allows the height of the hanging cable 610 (and thus the hanging item) to be adjusted, however it requires the user to remove the item from the wall (or to at least inconveniently reach behind the frame at both sides) in order to make any such adjustment.

The embodiment of FIGS. 33 and 34 incorporate a similar biased lock mechanism, however, direct manual pressing of the mechanism behind the frame is not required, and removal of the hanging item is not necessary to accomplish vertical adjustment. Instead, to vertically adjust the hanging item, the user simply pushes inwardly on it enough to cause the front surface 622 of hook portion 620 to be pressed inward by the wall to and unlock feet 606 from the inside of track 618. Then, the user simply pushes the hanging item up or down while maintaining inward force against the hanging item so the hook assembly 612 remains unlocked from the inside of track 618 with its front surface 622 frictionally held in position against the wall. When the desired vertical position is found, the user releases the inward pressure, allowing the feet 606 of biased portion 616 to again lock in the track 618. Biased portion 616 may be metallic and have a waisted central portion around which hook portion can be insert molded from plastic.

The track 618 vertically extends along the hanging item's center of gravity (or "weight centerline") from the top to the bottom of the rear of the hanging item, and is attached with screws or the like through holes 619. Track 618 can be provided with suitable alternate mounting means known in the art (not shown), instead of or in addition to holes 619, depending on the hanging item to which it is to be attached (e.g., aluminum channel frame versus wood frame). Depending on the weight of the item, the track may be open for its entire length, or to prevent excessive torque and/or pitch and/or structural stress in the case of heavier hanging items there may be a closure or block at or below the track's vertical midpoint to prevent the hook from sliding below that point. The track can of course be constructed for recessed mounting in the case of hanging items that have sufficiently recessed backings to accommodate the track.

The prong of hook portion 620 seats on a wallbar constructed generally as described with reference to the foregoing embodiments, however, the seating portion of the wallbar should reside far enough from the wall so as to create a gap large enough to accommodate the degree of inward flexion of biased portion 616 required to unlock feet 606 from the interior of track 618. Of course, the wallbar permits free horizontal adjustment of the hanging item.

FIG. 34 shows a similar embodiment to that of FIG. 33, however, the prong of the hook portion 620' extends out from the middle of the hook assembly 612'. Here, the center of the biased portion 616' is wrinkled and includes holes 624, both to improve the connection of the biased portion 616' to the hook portion 620' in which it is insert-molded.

Although the embodiments of FIGS. 33 and 34 adjust without requiring any disengagement of the item from its support that would permit the item to fall to the ground if it were let go of, it should be noted that the item can be removed from the wall and the hook portion directly manipulated to effect adjustment. Further, a variation only permitting such direct adjustment could also easily be made (e.g., by compressing the size of the hook so that it could not hit the wall), and such an embodiment permitting continuous vertical adjustment and automatic continuous horizontal adjustment is also not taught in the prior art known to applicant. Such embodiments could alternately utilize many other clamping mechanisms known in the art to permit similar linear adjustment, including means that are only directly manually activatable.

FIGS. 35–41 show a two-way adjustable embodiment of the invention wherein vertical adjustability is activated by simply pulling directly up or down on the hanging item sufficiently. Vertical activation occurs when there is a pull sufficient to create a resulting (taking into account the downward force exerted on the hanging item by gravity) upward or downward force that is a bit greater than the force ordinarily exerted on the hanging item by gravity. Preferably, the resultant force necessary for activation is sufficiently greater than the force ordinarily exerted by gravity that there is a minimal likelihood of unintended vertical adjustment caused by vibrations or the like. FIGS. 35–41 are basically taken directly from scale technical drawings of a prototype. While it has been demonstrated to function quite well, it should be readily apparent that certain parts are designed to facilitate prototyping and could be modified, simplified, or even eliminated for more economical manufacturing.

Figure 35:
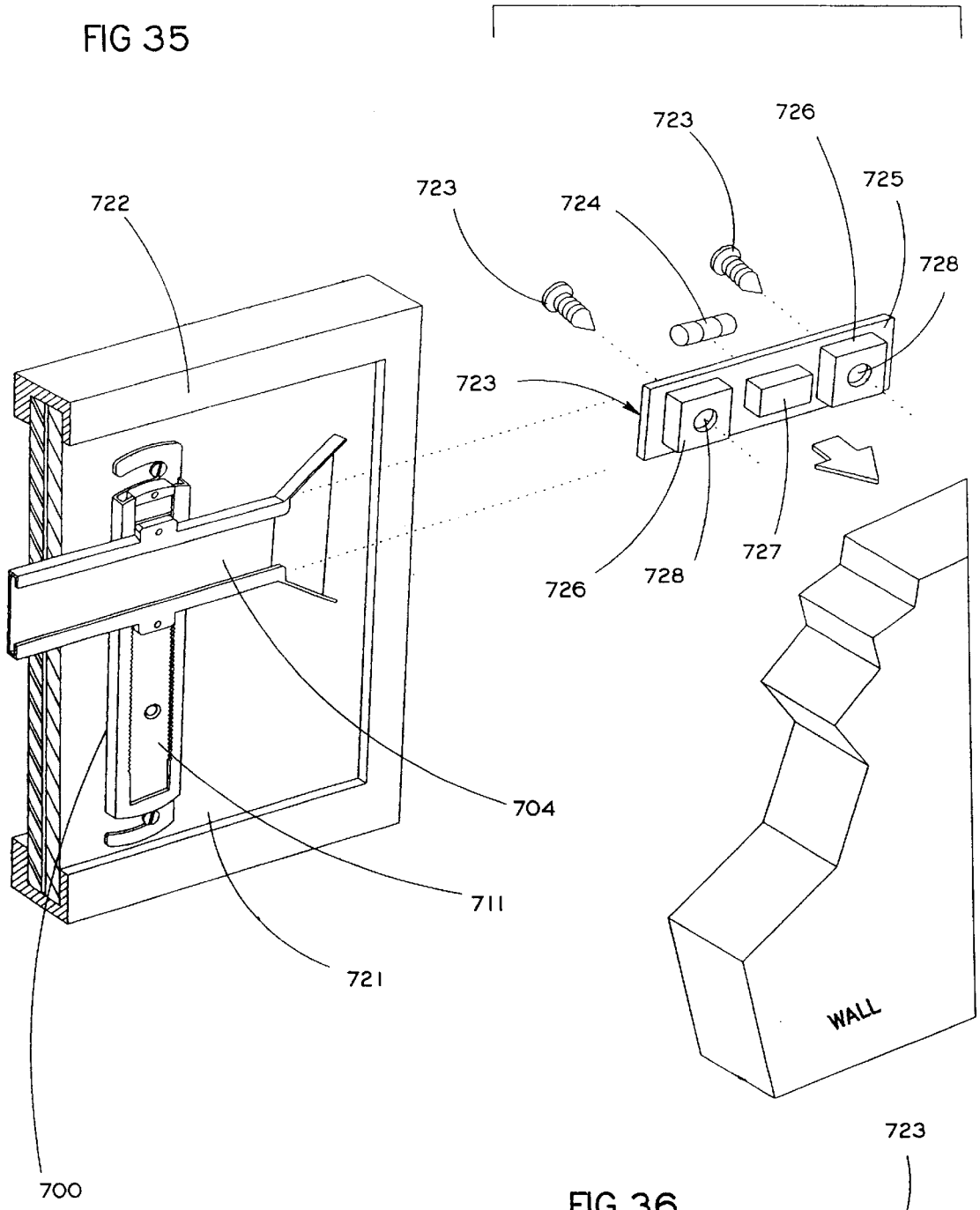
FIG. 35 is an exploded perspective cutaway view of a two-way adjustable embodiment wherein vertical adjustment is activated by exerting a predetermined force upward or downward, with the reverse side of the wall slide shown.
Figure 36:
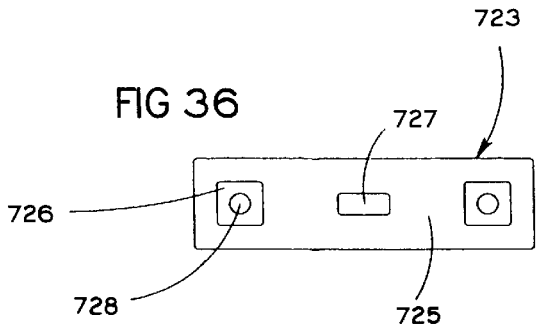
FIG. 36 is a front view of the obverse of the wall slide of the embodiment of FIG. 35.

FIG. 35 shows a cutaway exploded perspective view of the embodiment. Adjustable portion 700 is attached to the rear of the hanging item, for example, as shown, to a rigid backing 721 placed in a typical frame 722. Alternately, portion 700 could be modified to attach directly to the top and bottom frame edges. Portion 700 includes a vertical track 711 and a horizontal track 704. Vertical track 711 vertically slidingly connects to horizontal track 704, and horizontally slides on horizontal wall slide 723. Slide 723, the obverse of which is shown in FIG. 36, is attached to the wall with screws 733 at holes 728. Front face 725 of slide 723 is spaced a selected distance from the wall by protrusions 726 (which appear as indentations from the front). The slide is hung on the wall by the user in a level fashion, optionally assisted by reference to the optional vial 724 which is friction fit into niche 727, or by equivalent level indicating means.

Figure 37:
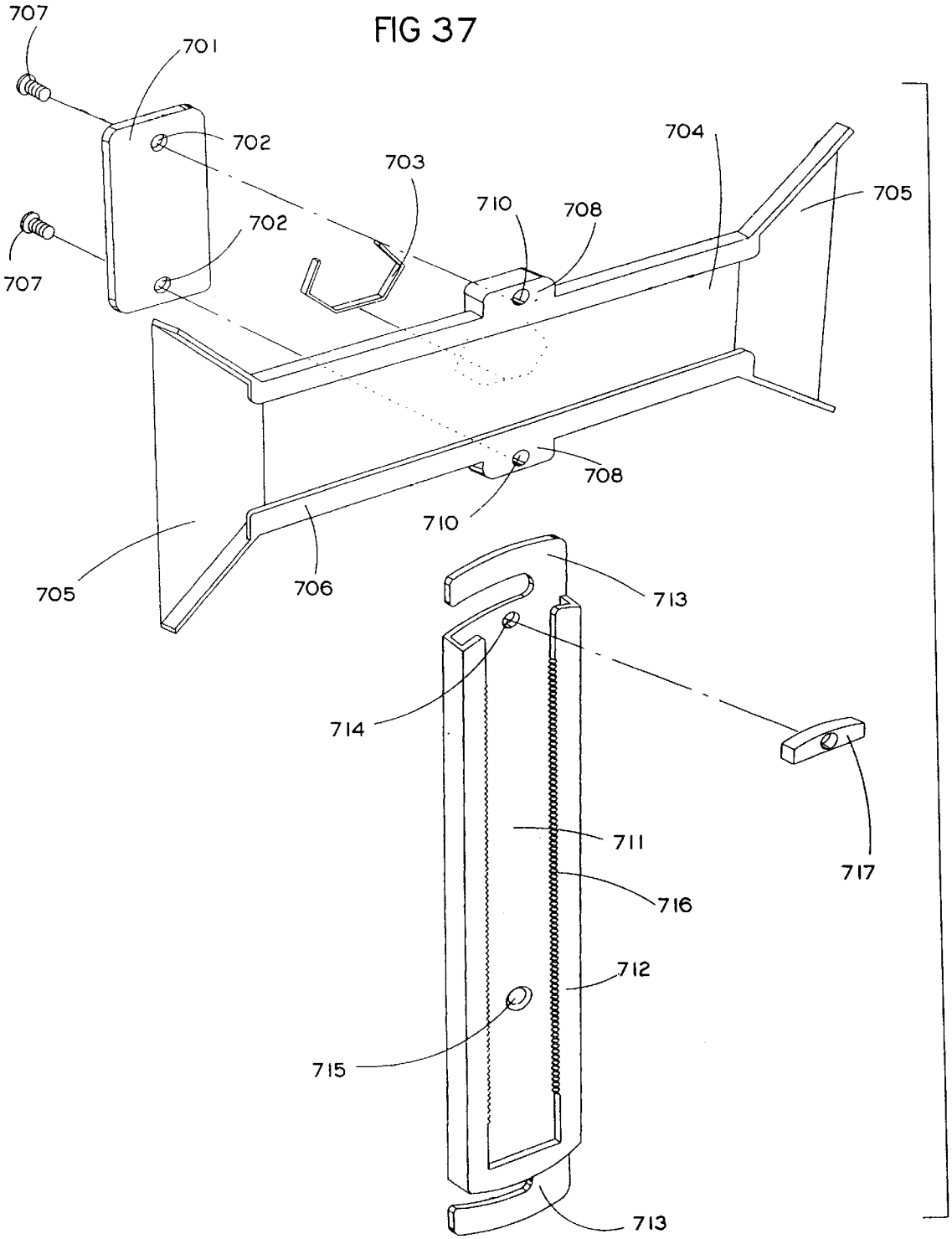
FIGS. 37 is a partial exploded perspective view of the portion of the embodiment of FIG. 35 that mounts to the rear of the item to be hung.
Figure 38:
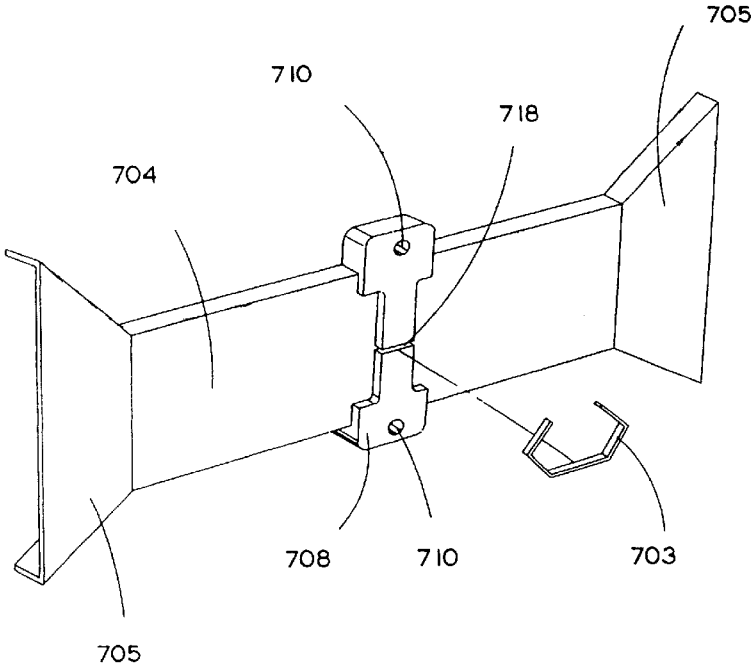
FIG. 38 is a partial exploded perspective view of part of the portion shown in FIG. 37, viewed from the other side.

FIG. 37 shows an exploded perspective view of portion 700. Vertical track 711 includes vertical lips 712 with frictional holding edges 716 that may optionally (as shown) be formed with teeth. Tines 713 are formed at the ends of track 711, to permit fixed attachment of track 711 to the rear of the hanging item, e.g., with screws. Track 704 includes horizontal lips 706, and flared ends 705 which distally widen and bend slightly inward towards the hanging item. Plate 701 holds spring 703 in place against the rear surface of track 704. As shown from the other side in FIG. 38, the bottom part of spring 703 is held in channel 718 between hubs 708 to which plate 701 is fixedly attached with a pair of screws 707 engaged through holes 702 and 710. Once track 704 is assembled, it is mated with track 711 by sliding the edges of plate 701 underneath lips 712 at their open end and then fastening block 717 to track 711 with a screw at hole 714.

Figure 39:
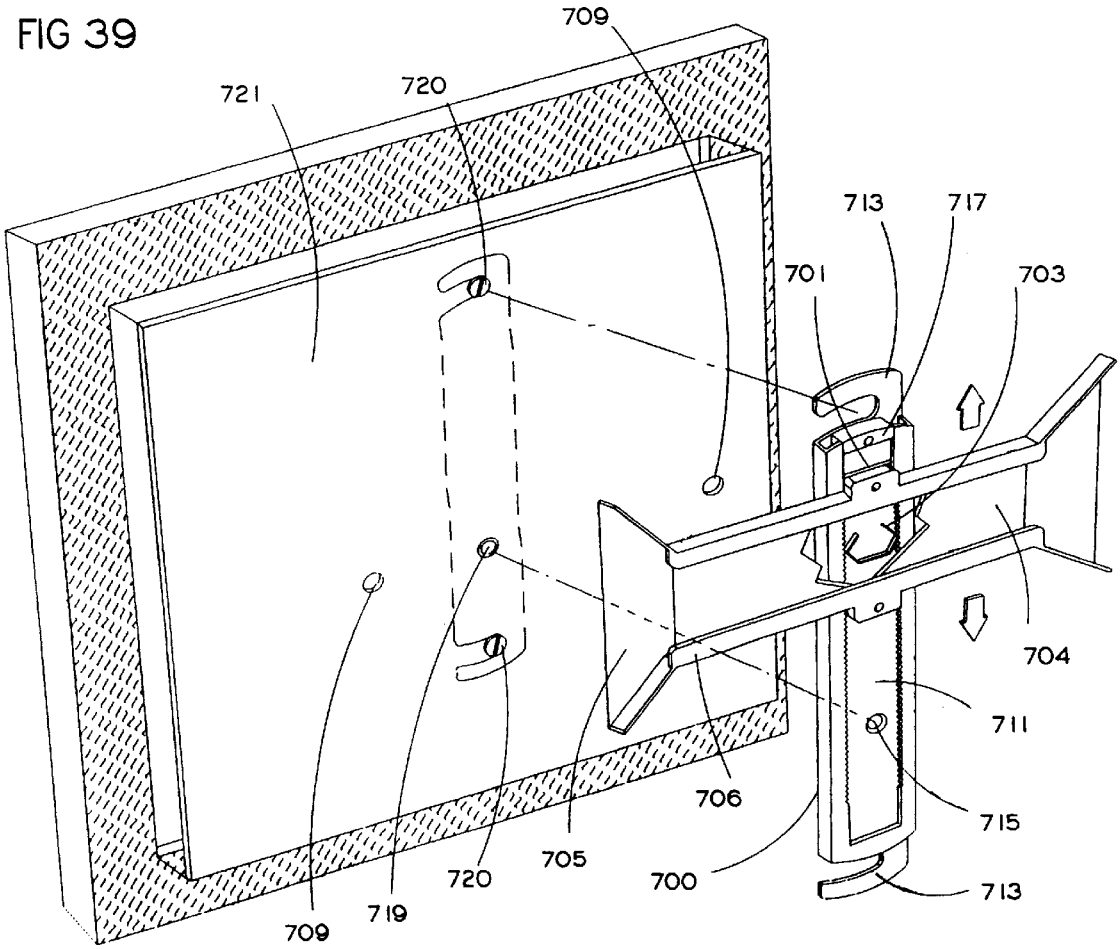
FIG. 39 is an exploded perspective and cutaway view of the portion of the embodiment of FIG. 35 that mounts to the rear of the item to be hung.
Figure 40:
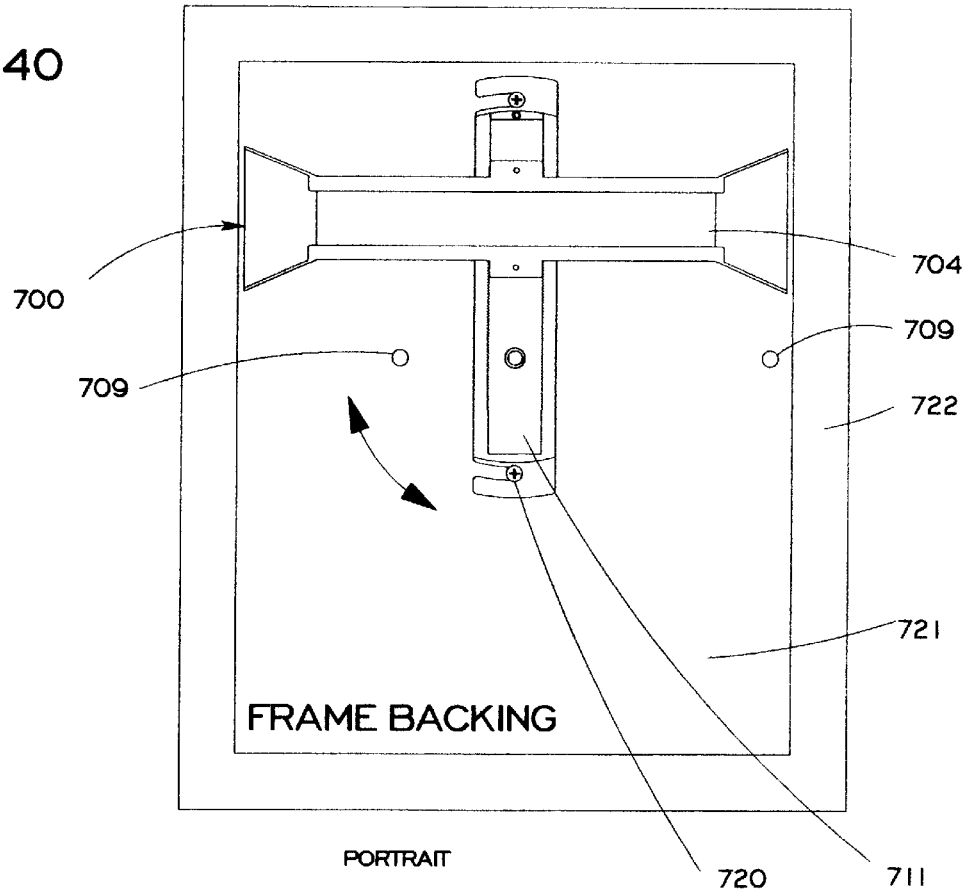
FIGS. 40 and 41 are front views of the portion of the embodiment of FIG. 35 that mounts to the rear of the item to be hung, shown respectively in two alternate mounting positions.
Figure 41:
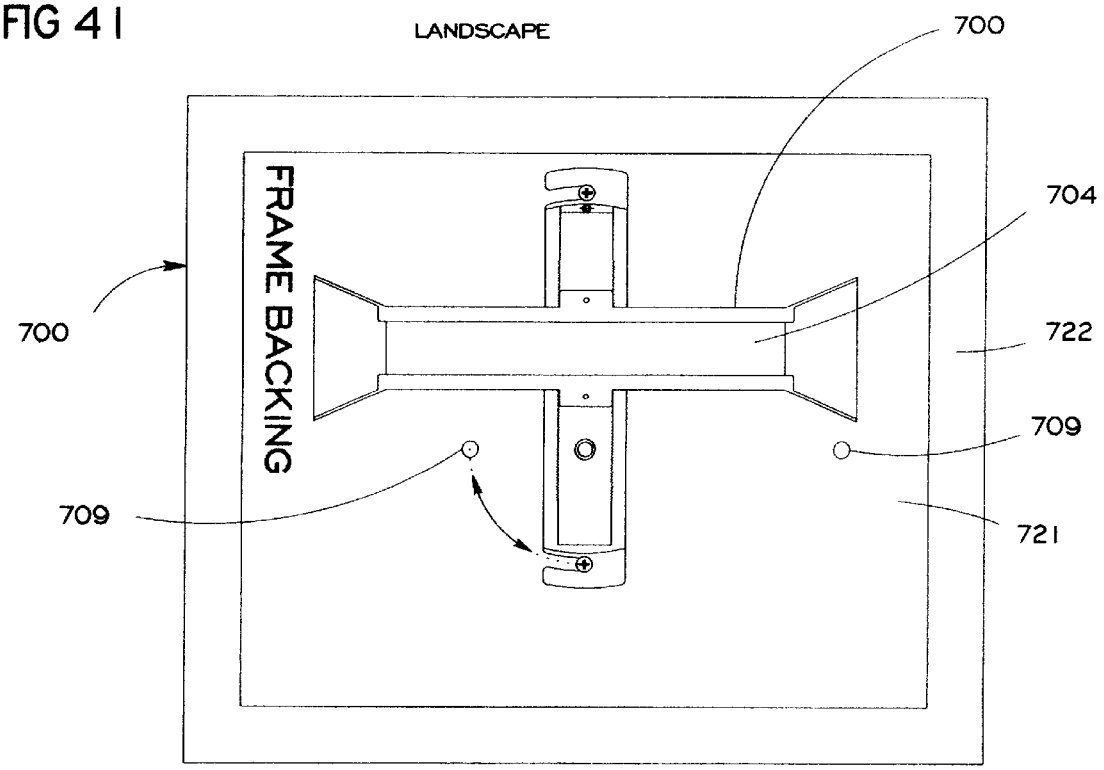

FIG. 39 is an exploded cutaway perspective view showing how the adjustable portion 700 can connect to the rigid backing 721 placed in a conventional frame 722. Portion 700 can be connected in a rotary fashion to backing 721, with a rivet (shown in FIGS. 40 and 41) or other suitable means rotatably connecting hole 715 to hole 719. Alternate holes 709 are provided, so that either a landscape or portrait hanging orientation can be selected by removing screws 720, rotating portion 700 ninety degrees at the rotary connection point between holes 715 and 719, and reaffixing screws 720 in the alternate holes 709. This rotary attachment method is optional but not necessary to the invention, however, and a simple fixed attachment to the backing or to the top and bottom of the frame, can be used. Also, with non-square items, using the rotary connection will reduce the adjustability (without visible overhang) available in one orientation.

In use, portion 700 is affixed to the rear of the item to be hung (by a manufacturer, custom framer, consumer, etc.), and wall slide 723 is affixed to the wall. The proper orientation of portion 700 (landscape versus portrait) can be selected and fixed as described above. Then, the item to be hung is positioned so that the left flared end 705 is adjacent to and aligned with the right end of slide 723 (or right with left). Flared end 705 is then moved further toward slide 723 until it hits the end of the slide 723 and is funneled along so that lips 706 slide into engagement around the corresponding top and bottom horizontal edges of front face 725 of slide 723. This funneling action is assisted by the slight inward bend of end 705 which allows the user to press the item fully against or very close to the wall during the process just described while preventing end 705 from going behind face 725, and by the flaring of end 705 which reduces the likelihood of lips 706 missing and thus failing to engage with slide 723. Once the item has begun to be engaged in this way, it is moved further until slide 723 provides sufficient support to hold the hanging item (support is best when the full horizontal length of slide 723 is engaged between lips 706). With the item hung on the wall in this fashion, its horizontal hanging position can be adjusted by simply moving the item laterally (until the limit is reached where slide 723 no longer is sufficiently engaged as described above), which occurs freely.

The item's vertical hanging position is frictionally locked by the pressure of spring 703, which is outwardly biased to lock against frictional holding edges 716. The tips of spring 703 contacting edges 716 can be modified, e.g., by providing them with more surface area, to increase the gripping of edges 716. Or, optionally (as shown), edges 716 can be formed with teeth corresponding to the tips of spring 703, to provide a supplemental mechanical locking action. (By "supplemental" it is meant that such mechanical means' surfaces which prevent vertical movement form an angle with that direction of vertical movement that is significantly less than ninety degrees, e.g., forty-five degrees). In any event, the item's vertical position is adjusted by pulling the item directly upward or downward with enough force to overcome the locking of spring 703 along edges 716. The item then moves up or down, with plate 701 sliding vertically underneath lips 712 and maintaining the orientation of the item. When the aforementioned force is withdrawn, the hanging item no longer moves vertically. The item can be removed by simply sliding it horizontally far enough to one direction so that the slide 725 is no longer held within lips 706.

It should be noted that as depicted in FIGS. 35–41, this embodiment relies on the vertical captivation of slide 725 created by its engagement with horizontal track 704 to permit vertical activation. This would be possible only in the downward direction if an unmodified downward pointing hook and wallbar (as described elsewhere herein) were substituted for the horizontal track 704 and slide 725. However, a hybrid version of the depicted embodiment can readily be created by replacing track 704 with a modified hook and replacing slide 725 with a modified wallbar. The hook would be modified (in addition to being modified to form an appropriately stable connection to the spring) by providing a barb at its end similar to a fishhook arrangement, and by making the tip of the hook slightly flexible. The hook and/or wallbar would be modified so that, during the process of seating the hook on the wallbar, the hook tip would need to flex slightly outwardly (toward the wall) in order to permit the barb to pass over the rear surface of the wallbar. The hook tip would have a length such that the barb could just pass below the bottom edge of the wallbar, and the hook tip would have to be resilient so as to then flex back to its original shape causing the barb to catch under the wallbar preventing the hook from passing back up over the wallbar's rear surface if the item were pulled upwardly. Also, the wallbar would include an escape for the barb to permit disengagement of the item from the wallbar (e.g., a portion of reduced thickness of the wallbar's edge provided at the left or right end of the wallbar, or some manual security means).

The depicted embodiment has the advantage (vis-à-vis the hybrid just discussed) of allowing horizontal adjustment (without visible overhang of the device) of more than one half the horizontal length of the item to be hung. While this advantage is more applicable to lighter items (since undue torque may be created on the assembly by a heavy item that is supported horizontally too far from its center of mass), the depicted embodiment is generally more useful with lighter embodiments anyway due to the relatively high force that would be necessary for upwardly adjusting a holding mechanism suited for a heavier items. On the other hand, the holding mechanism of the depicted embodiment could readily be replaced by an alternate holding mechanism that relies on an activation force that is not aligned with gravity, which would greatly reduce the user's force required for upward activation in the case of embodiments made for heavier items. For example, spring 703 and plate 701 could be replaced by a biased portion and locking feet (similar to those described in FIGS. 32–34) running in track 711, with vertical activation occurring when the item is pressed against the wall.

FIGS. 42–66, 70–91, and 96–109 show two-way adjustable embodiments wherein vertical adjustability is activated by applying slight pressure on an activation trigger placed at or near an edge of the rear of the hanging item. These embodiments are similar to many of the embodiments described above in that they utilize a downward pointing hook on a vertically adjustable assembly attached to the rear of the item to be hung, and a horizontal wallbar attached to the desired support.

Figure 54:
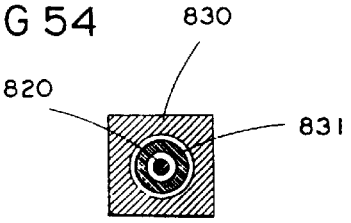
FIG. 54 is a sectional view taken through the line I—I of FIG. 43.
Figure 55:
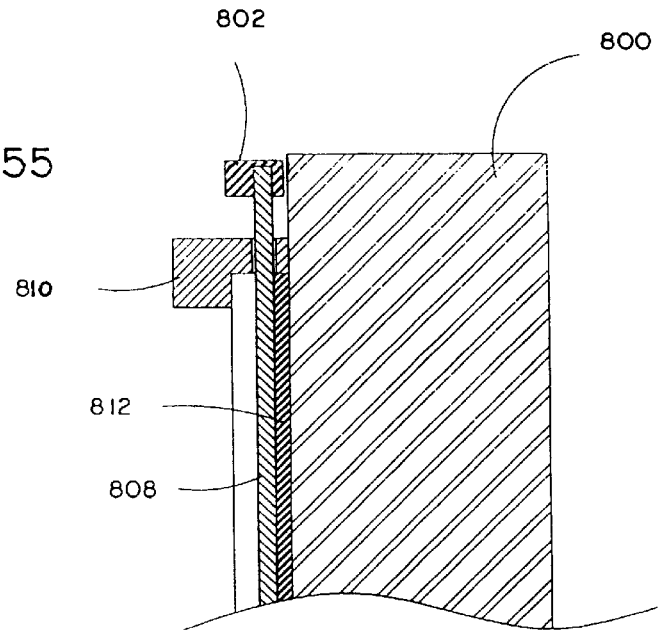
FIG. 55 is a sectional view taken through the line E—E of FIG. 43.
Figure 56:
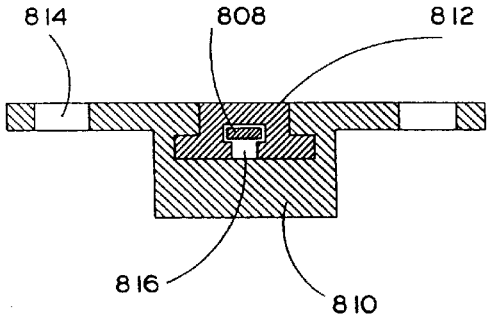
FIG. 56 is a sectional view taken through the line F—F of FIG. 43.

FIGS. 42–61 show the first of these embodiments. These Figs. are basically taken directly from scale technical drawings of a prototype that has been demonstrated to function quite well. It should nevertheless be readily apparent that certain parts are designed to facilitate prototyping and could be modified, simplified, or even eliminated for more economical manufacturing. As shown in the partial perspective cutaway exploded view of FIG. 42, the front view of FIG. 43, and the side view of FIG. 44, this embodiment includes a vertically adjustable assembly comprising a vertically adjustable downward pointing hook 824 that is formed to mate with a wallbar (further described in connection with FIGS. 57–61). The hook 824 adjusts vertically on a track 812. Vertical adjustability is activated by pressing trigger head 802 down a slight amount, which causes trigger rod 808 (which transmits its force onto the annular top 843 of the upper cylindrical projection of ball cage 831) to force ball cage 831 down so that bores 841 move adjacent to a larger diameter portion of conical inner surface 845 of lock clamp body 830, allowing balls 832 to move outwardly in bores 841 thereby releasing their lock on hookrod 820 which is fixedly connected to hook 824. The lower end of track 812 (cutaway) is fixedly connected into the correspondingly female shaped upper portion 833 of clamp body 830, and endcap 837 is secured to lock clamp body 830 with threads 836 screwed into threads 838. Coil spring 834 is contained at its lower end by the top of endcap 837, sheathing the lower cylindrical projection 835 of ball cage 831, and abutting the bottom of flange 842. Coil spring 834 thus urges ball cage 831 upwardly towards the smaller diameter portion of the conical inner surface 845. Endcap 837 also includes aperture 839 which permits the end of hookrod 820 to pass through when hook 824 is adjusted downwardly. At the top of track 812, cap 804 is fixedly connected and includes projection 810 which may abut the top surface 818 of hook 824 when hook 824 is adjusted to its uppermost extent. Cap 804 also includes an aperture for trigger rod 808 to pass through it, and also includes screweyes 814 through which screws 806 can mount cap 804 to the top of the rear surface of the item to be hung (in FIGS. 42–44, frame 800). As shown in FIGS. 55 and 56, only trigger rod 808 extends upward through cap 804. Cap 804 could optionally include a pair of angled ramps (not shown, but similar in nature to the ramps 844 on the alternate endcap depicted in FIGS. 54A and 54B) extending along the two distant side edges of the cap (just beyond the screweyes) and extending a bit below its bottom edges, to physically prevent the wallbar 860 from ever catching directly under projection 810 in such a way that a user might be misled into releasing the item thinking the hook had seated on the wallbar.

Figure 89:
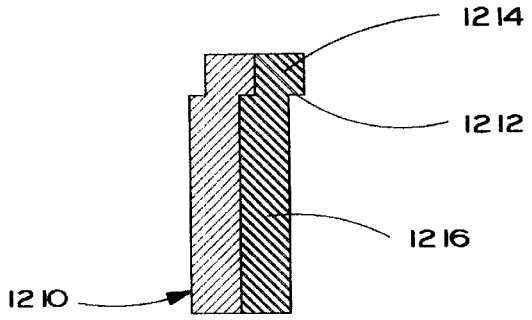
FIG. 89 is a sectional view taken through line C—C of the shims of FIG. 90.
Figure 90:
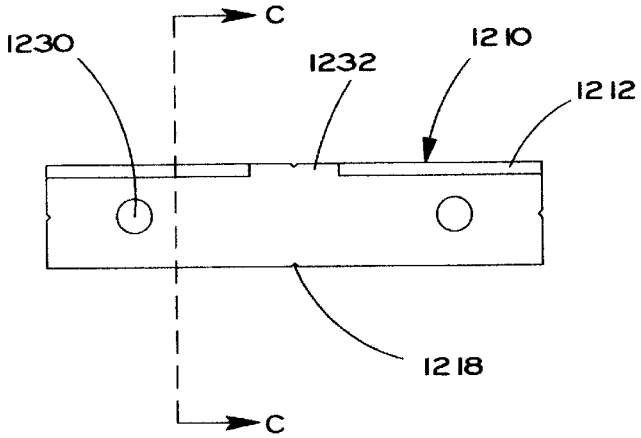
FIG. 90 is a front view of two stacked shims for use with the topcap of FIG. 70.
Figure 91:
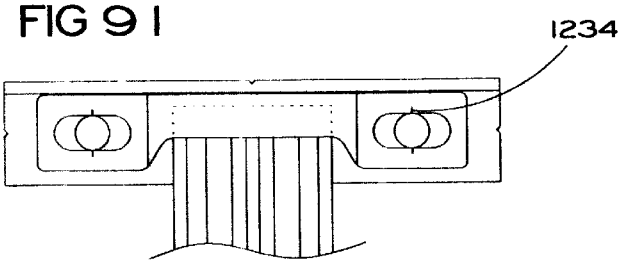
FIG. 91 is a front view of the shims of FIG. 90 together with the topcap of the hanger of FIG. 70.

In use, a custom framer attaches the vertically adjustable assembly of FIGS. 42–44 to the rear of a frame by affixing screws 806 to the top of the frame so trigger head 802 is flush or slightly above or below the top of the frame, and so that track 812 is along the center of weight line of the frame. A cable 840 (which is preferably approximately 1.0 mm braided wire) is then threaded through bore 821 and horizontally attached to the rear of the left and right sides of the frame in a fashion similar to that conventionally used in hanging frames (using screweyes or the like) except that cable 840 is pulled taut. Alternately, cable 840 can be attached straight to the bottom center of the item, or down to the bottom corners of the item so as to form an upside-down "Y" together with the track. As another alternate, a more rigid lower connection means can be used instead of cable. If cable is used, the custom framer should if possible tape the clamp body 830 to the backing, placing a shim (not shown) of appropriate thickness between the clamp body 830 and backing if necessary to keep track 812 aligned with the plane of the rear of the item. A toothpick tip may be wedged in bore 821, or other suitable means may be used, to lock cable 840 in place. To prevent visible underhang of the end of hookrod 820 and maximize adjustability, the framer should select an appropriate-sized vertical assembly for a given item (vertical adjustability should be just less than half the vertical length of the item), and mount it so that the trigger head 802 is about flush with the top of the item. This is also important with heavier items, because if support from the wall (which goes through the wallbar and into the hook at whatever vertical level the hook is placed) is too low on the item, undue torque and thus undesirable pitch or failure can result. With non-recessed mountings, felt or rubber bumpers (preferably adhesive-backed) are preferably placed at the bottom corners of the frame to minimize pitching and torque. With items having a rear that protrudes further out at the middle than at the top (e.g., a framed item with a taped-in-place backing that protrudes further out than the rear edge of the frame), a shim, block, or spacer can be placed under cap 804 to permit it to be secured to the top of the rear of the item without track 812 damaging or unduly pressing into the protruding rear of the item. A shim of this nature is shown in FIGS. 89-91. Then, the framer selects a wallbar (see FIGS. 57–61) that is preferably about one half as long as the horizontal length of the item to be hung, and provides it along with the item to the customer. The framer may demonstrate the system to the customer using a demo in the frame shop. Finally, the customer affixes the wallbar to the desired wall or other support, makes sure the hook is at or near the top of the track, and slides the item to be hung down the wall until the hook hits and seats on the wallbar. The item freely moves sideways. To accomplish vertical adjustment, the user supports the weight of the item by holding its top edge with the dominant hand, applies slight downward finger pressure on the trigger head, and moves the item up, down, or diagonally on the wall. Preferably, the user's free hand is used to support another edge of the item during adjustment. When a possibly suitable position is found, pressure on the trigger head is released and the hanging item is gently released.

Figure 42:
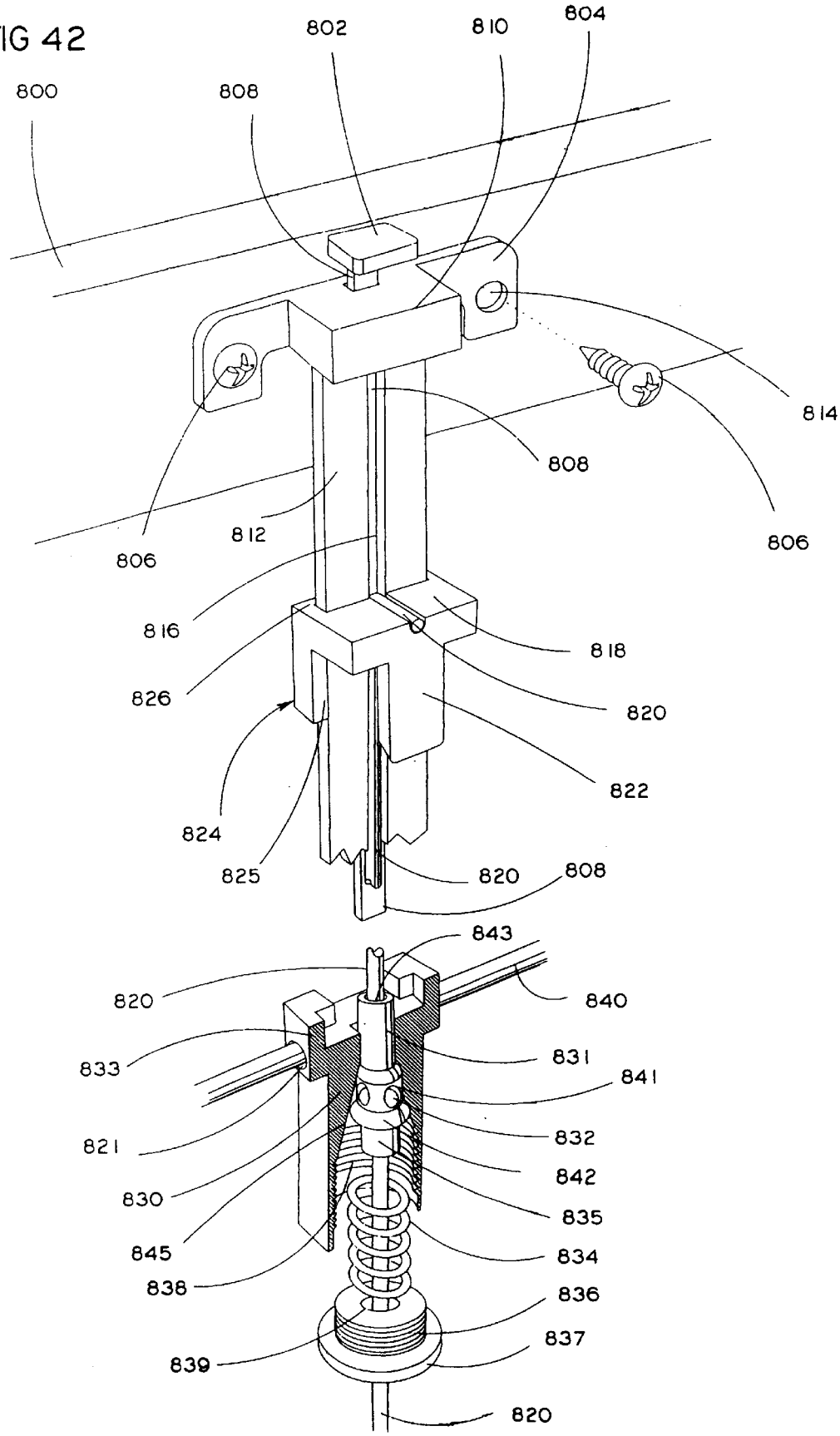
FIG. 42 is a partial perspective cutaway exploded view of a two-way adjustable embodiment wherein vertical adjustability is activated and maintained by pressing on a button placed at the top edge of the frame.
Figure 43:
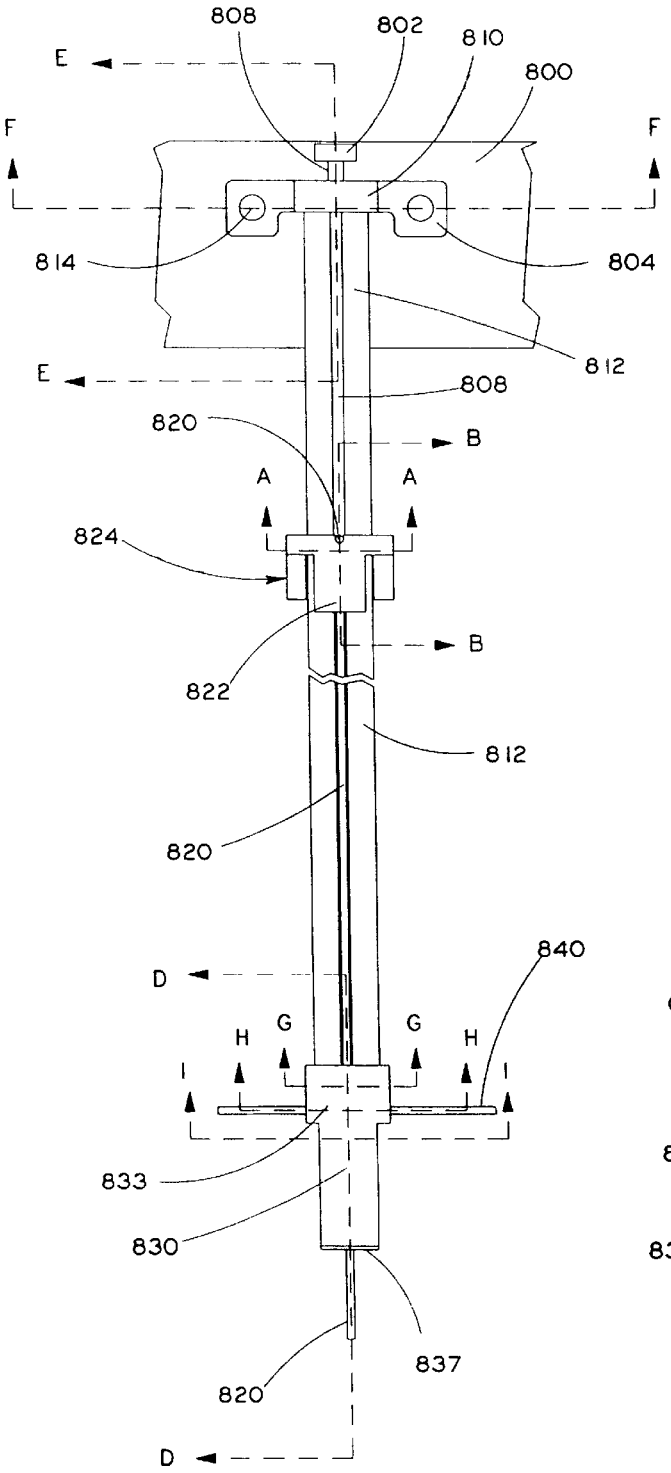
FIGS. 43 and 44 are front and side views, respectively, of the embodiment of FIG. 42.
Figure 44:
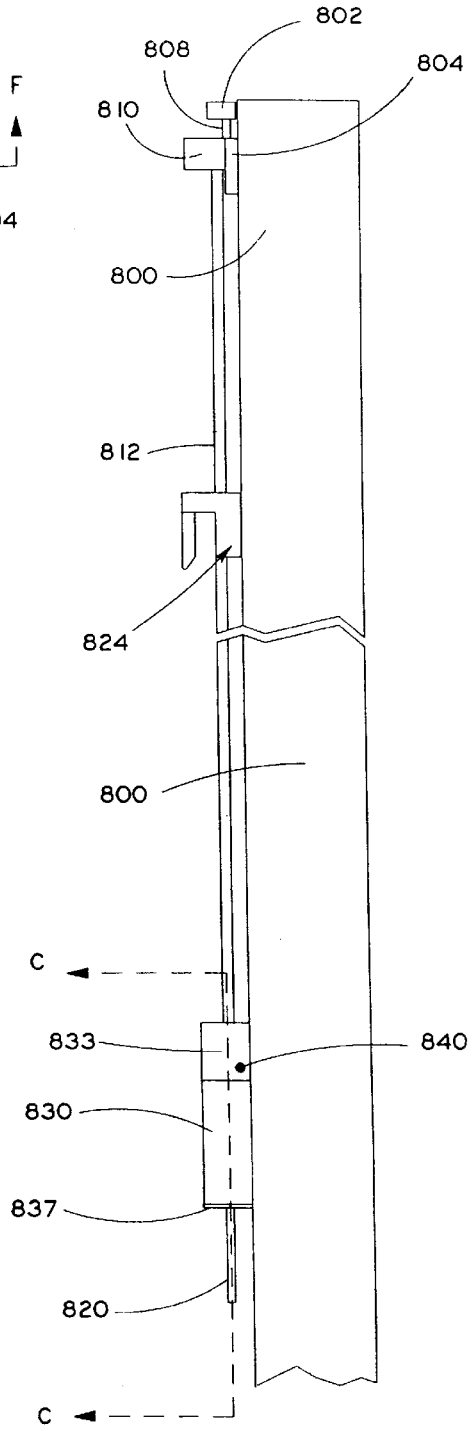
Figure 45:
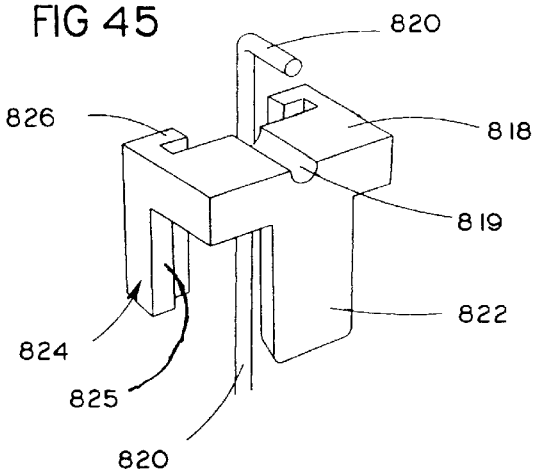
FIG. 45 is a partial exploded perspective view of the hook of the embodiment of FIG. 42.

Turning to FIGS. 45–61, the various parts of the embodiment of FIGS. 42–44 are shown in more detail. From FIGS. 45–49, it can be seen that hookrod 820 runs within channel 816 defined in the front of track 812 and has a ninety degree bend at its top (thus forming an upside-down "L" shape) where it attaches (e.g., by soldering, glue, or welding) to hook 824 at niche 819. Alternately, an upside down "U" -shaped end of hookrod 820 could be insert molded or cast into hook 824 at a central or other internal position lower than where niche 819 would otherwise be, and a barb could be placed at the end of the hookrod 820 for use with a wallbar such as that shown in FIGS. 86–88. As is clearly shown in FIG. 46, hook 824 is maintained in position on track 812 because it has a complementary shape, with rear extensions 826 wrapping around and behind track 812, and sides 825 running alongside the sides of track 812. Trigger rod 808, which has a rectangular cross section, is held captive within the correspondingly shaped but slightly larger channel 809 in track 812. Trigger rod 808 could also be shaped differently, and for example may be formed of two cylindrical rods side-by-side and forming a central indentation between them which allows a little more space for hookrod 820 to nestle inwardly. As clearly shown in FIG. 47, hook 824 may have a pointed tip 827 to facilitate the seating of prong 822 behind the wallbar.

FIGS. 50–54 are sections taken through the clamp of the embodiment of FIGS. 42–44, showing its clamping mechanism in more detail. For further detail on such mechanisms, the disclosure of U.S. Pat. No. 4,656,698, issued to Arakawa on Apr. 14, 1987, is incorporated herein by reference in full, and particular attention drawn to that patent's FIGS. 1–3 and 9–13 and corresponding description. Also incorporated herein by reference is the disclosure of U.S. Pat. No. 5,359,870 issued to Reutlinger on Nov. 1, 1994 and disclosing similar ball detent or "ball and cage" lock clamps. While the present embodiment (and that of FIG. 70 discussed below) is obviously amenable to the use of any suitable lock mechanism permitting a remote trigger adaptation (including ones with a hookrod of non-circular, e.g., rectangular, cross-section), the ball detent clamp is illustrated as it is particularly reliable, capable of supporting significant weight, and easily triggered.

Figure 50:
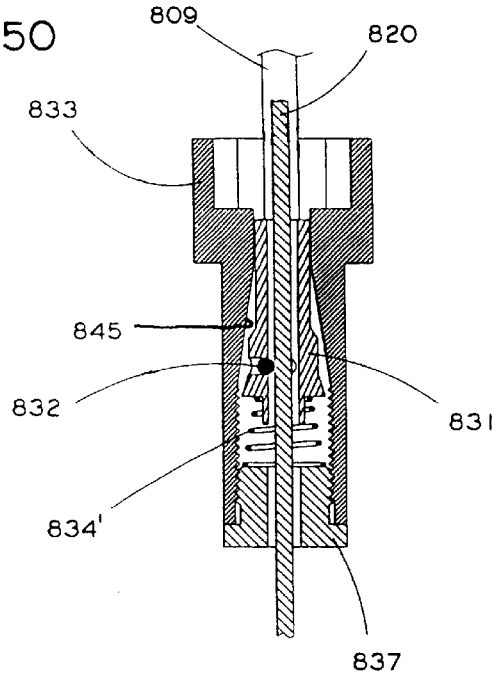
FIG. 50 is a sectional view taken through the line C—C of FIG. 44 (the arrows for line C—C should point in the opposite direction)
Figure 51:
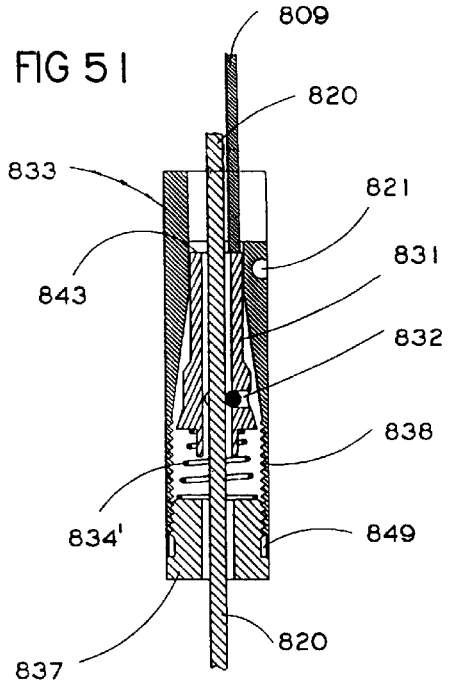
FIG. 51 is a sectional view taken through the line D—D of FIG. 43.
Figure 52:
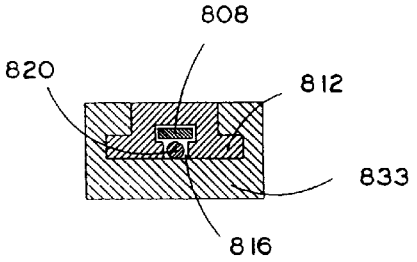
FIG. 52 is a sectional view taken through the line G—G of FIG. 43.
Figure 53:
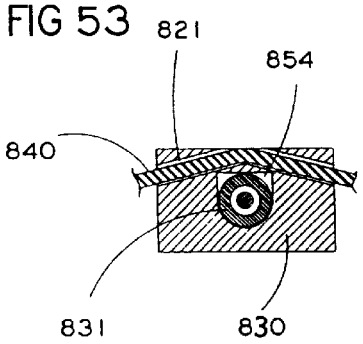
FIG. 53 is a sectional view taken through the line H—H of FIG. 43.

FIGS. 50 and 51 show an alternate spring 834' that is conical rather than cylindrical, and show that a cylindrical gap 849 may be provided for the introduction of glue to more securely bond endcap 837 to clamp body 830. As shown in FIG. 52, upper portion 833 of clamp body 830 is bonded to the bottom portion of track 812. As shown in FIG. 53, the portion of clamp body 830 below the bottom of track 812 but above conical inner surface 845 has an internal aperture 854 with a uniform "mailbox"shaped cross-section, permitting the end of the (rectangular cross-sectioned) trigger rod to fit and travel down thereinto. The bottom of aperture 854 meets the top of conical inner surface 845 which has an ordinary circular cross-section as shown in FIG. 54, and which is sufficiently narrow at its top to prevent the flared portion of cage 831 from passing up through clamp body 830. Aperture 854 should extend far down enough to at least allow the trigger rod to travel far enough downwardly to fully unclamp a hookrod 820 of a predetermined widest diameter (e.g., 1.5 mm). In this regard, it should be noted that as the diameter of hookrod 820 is increased, cage 831 must be pushed further downward along conical inner surface 845 to unclamp. Conversely, there should be sufficient leeway above annular top 843 to permit cage 831 to move upward enough to cause clamping of a predetermined narrowest diameter hookrod 820 (e.g., 1.0 mm). For example, in an embodiment using 1.0 to 1.5 mm hookrod, the mailbox shape aperture section should extend vertically about 4 mm or more.

Figure 54A:
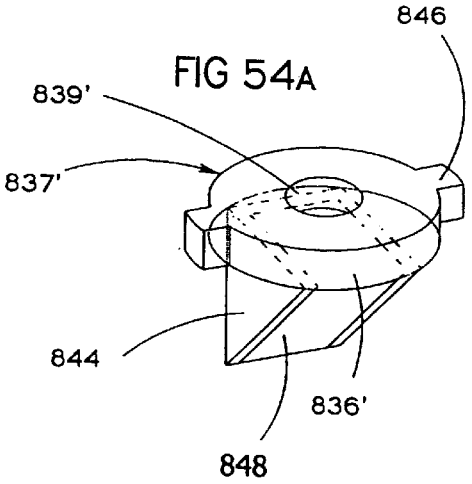
FIG. 54A is a perspective transparent view of an alternate endcap for use with an embodiment similar to that of FIG. 42.
Figure 54B:
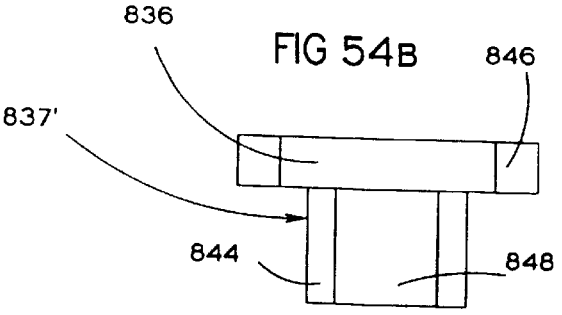
FIG. 54B is a front view of the endcap of FIG. 54A.

As shown in FIGS. 54A and 54B, unthreaded endcap 837' could be used as an alternate for threaded endcap 837. Instead of threads 836, endcap 837' would have a smooth mating portion 836' which friction fits into a corresponding non-threaded interior of the end of a modified clamp body (not shown), and could be glued, soldered or otherwise fixed in place. Also, tabs 846 could be provided (along with a corresponding further modification to the interior of the end of the clamp body) to allow more secure fixation of the endcap. Tabs 846 would also prevent rotation of the endcap 837', which prevention would be beneficial if, as shown, optional ramps 844 are provided. Ramps 844 are oriented such that connecting rear wall 848 goes nearest the rear of the item to be hung, and are angled so as to slip past the wallbar if it is contacted during hanging. This prevents unwanted catching of the wallbar by the bottom of the clamp, which might otherwise mislead a user into letting go of the item before it is properly seated on the wallbar.

Turning to FIGS. 57–61, a wallbar 860 particularly suited for use with the embodiments of FIGS. 42–56A is shown. Wallbar 860 is preferably symmetric, so that only one of its ends need be shown in each of FIGS. 59–61. Wallbar 860 includes a hook supporting wall 862 spaced a predetermined distance, or gap, from the wall by sides 865. Sides 865 in turn have either (or optionally both, as shown) nailholes 872 or screwholes 866 with nailhead bevels 874 and countersunk screwhead bevels 868 respectively, with the nailholes being downwardly angled to provide more secure attachment to the wall. Since the studs used to support walls in home and other building construction are conventionally spaced a standard distance apart, the length of a preferable wallbar 860 can be such that screwholes 866 are separated by a standard stud spacing. (As noted elsewhere herein, however, it is important that the wallbar have a length that is well-matched to the item to be hung, although the selection of a slightly unmatched wallbar may be preferable if it permits dual stud support). Also as shown, wallbar 860 optionally includes a lower support rib 864 to reduce bowing of wallbar 860 away from the wall. An adhesive backing can be applied to the wall-facing surface of rib 864 to improve affixation to the support, and may indeed be preferable if screwholes 866 are omitted from wallbar 860. The gap between the wall and wallbar 860 is selected to correspond to the thickness of prong 822 of hook 824, with some leeway added. Correspondingly, the distance between the inside surface of prong 822 and the front surfaces of sides 825 (and/or the front surface of track 812, to the extent that the front surfaces of sides 825 are below or flush therewith) is selected to correspond to the thickness of wall 862. Some leeway should be added to this distance as well, and can be reduced or increased (by appropriately varying the dimensions of the respective parts) to result in freer relative movement, or conversely, some degree of frictional holding of the hook to the wallbar once seated. Alternately, a magnet (not shown) could be incorporated into the hook, and a ferrous material could then be included in or could comprise the wallbar (or vice versa). More preferably, a slight horizontally extending ridge (see, e.g., FIGS. 86–88) could be formed on the rear surface of the supporting wall 862 of wallbar 860, and a corresponding barb (see, e.g., FIGS. 76–78) could be formed at the end of prong 822 of hook 824. Such a ridge could end a bit before reaching the right- or left- most end of the rear side of supporting wall 862, so that the hook could be moved to that side to allow its barb to escape the ridge, permitting removal of the hook from the wallbar. The barb and ridge embodiment induces vertical holding of the hook to the wallbar, while not (significantly) impairing the hook's freedom to slide horizontally.

Track 812 can be any suitably rigid material, including metals such as extruded aluminum or high strength alloys, steel, or, for lighter applications, an injection-molded plastic of high strength (especially rigidity) and durability. Hook 824 can be metallic, such as die cast zinc, or it can be injection-molded of high strength plastic, preferably with the end of hookrod 820 bent into an upside down "U" shape and insert-molded into it. Cap 804 can be metallic, such as die cast zinc, or high strength plastic, preferably insert-molded with the top end of track 812 therein. Trigger rod 808 can be metallic, such as extruded aluminum, or depending on the dimensions, extruded or molded plastic. Trigger head 802 can be plastic, preferably an ergonomic textured polymer molded, dipped, or glued onto the end of trigger rod 808. Hookrod 820 should be metallic, preferably a metal of high hardness and low ductility. Clamp body 830 can be metallic such as die cast zinc with machined threads (and optionally with a machined-smooth conical inner surface 845), or a durable and high strength plastic insert molded on the lower end of the track 812. If clamp body 830 is made of plastic, a relatively thin conical metallic insert may optionally be placed inside clamp body 830 to provide a more durable conical inner surface 845. Cage 831 could be machined steel, or molded durable plastic. Endcap 837 can be plastic or metal and need not be that strong unless it forms part of an alternate lower connection means (which is preferably extruded aluminum or steel). The wallbar should be light but durable and rigid, and can thus be an injection-molded plastic such as Lexan®, a glass fiber or carbon filled plastic, or a metal such as a strong aluminum alloy. It may also be insert molded with a straight edged metallic strip fully embedded or protruding slightly as in a wooden ruler. All materials should be chosen for non-reactivity with each other and common frame materials, and exposed metal moving parts that might contact the wall should be painted or sprayed with a polymer or other suitable coating, or painted, etc.

In an alternate embodiment (not shown), hookrod 820 could be replaced with a non-rigid cable. Such a flexible cable's lower end could be gathered in by a biased rotary uptake means (such as in an automatic hand-held tape measure) or manually tucked behind the hanging item on a suitable post or the like, allowing for vertical adjustment in excess of half the item's vertical height without visible underhang of the cable. (Without some lower support extension which would of course be visible, however, it is not preferable to support heavier items with the wallbar support being too far below the midpoint of the item, because undue torque is exerted on the hanger and wallbar). Visible underhang of a cable could also be preferable aesthetically and safety-wise to that of a rigid rod. The lack of rigidity of a cable, however, could make seating the hook on the wallbar more difficult since the hook and cable would tend to slide downward prior to seating, so additional means of temporarily keeping the hook in place prior to seating (e.g., manually holding the hook, or provision of a slight holding bump at the top of the track) would be beneficial. A weighted or biased uptake means should also be added to the bottom of the cable as a substitute for the weight of the hook and hookrod. (When a rigid hookrod is used, the hook and hookrod transmit their weight directly down the hookrod, forcing it down through the unlocked clamp, keeping up with the user's adjustment.)

Also, an alternate cap and trigger (not shown) could be made to permit a recessed mounting (in the case of items having an appropriately recessed rear, such as a frame with a sufficiently recessed backing) of the track 812 such that hookrod 820 is flush with the rear of the item, with only the hook protruding when the item is viewed from the side. In such an alternate embodiment, the section of the cap where the holes for screws 806 are provided would have to be farther out relative to the track, and the top of the trigger rod offset at its top (similar in form to a stylized "lightening bolt" with 90° bends) to wrap around the protruding frame edge. Alternately still, a vertical channel can be routed into the rear surface of the top edge of a wooden frame, into which the cap and top of the track would be sunk. With aluminum channel frames, a rigid lower connection means (discussed further below) may be preferable, and known means of connection to channel frames could be incorporated, permitting a recessed mounting in many or most cases. A vertical bore could be drilled at the top of the frame to pass the trigger rod through (the trigger head could be subsequently glued or screwed on by the framer), or an offset could be made in the trigger rod.

Figure 56A:
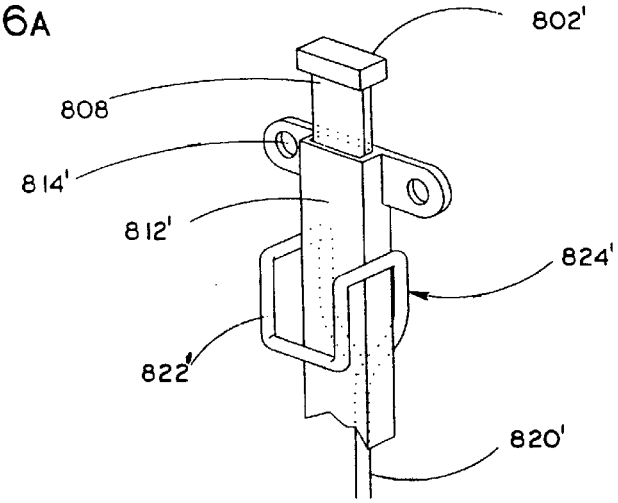
FIG. 56A is a partial perspective cutaway view of an embodiment similar to that of FIG. 42 but utilizing an alternate track, hook, trigger, and hookrod configuration.
Figure 59:
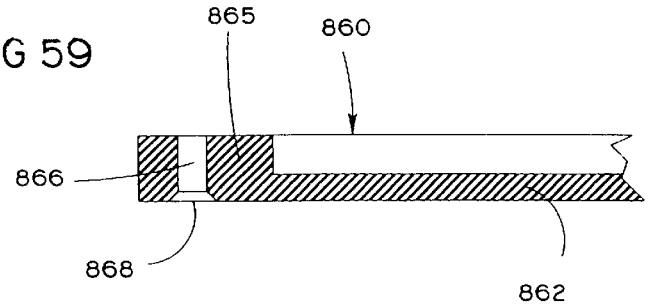
FIG. 59 is a sectional view taken through the line J—J of FIG. 60 (the arrows for line J—J should point in the opposite direction.
Figure 57:
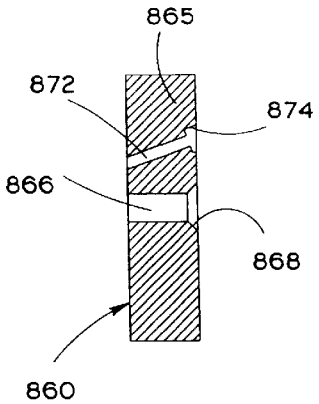
FIG. 57 is a sectional view taken through the line K—K of FIG. 60.
Figure 60:
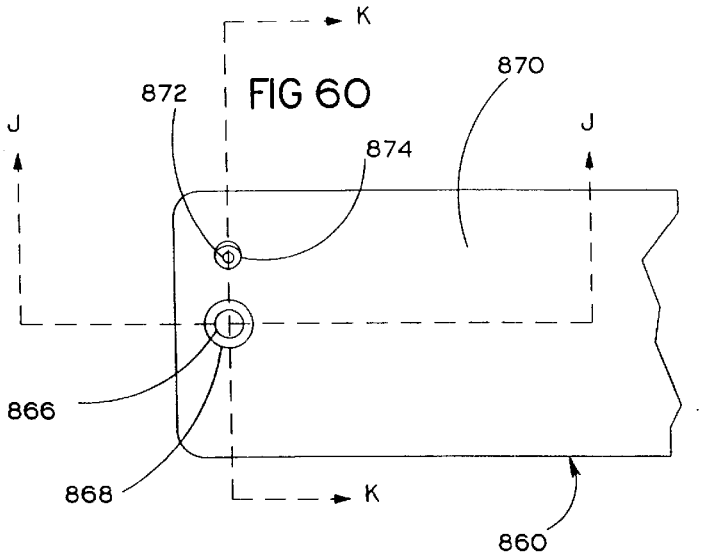
FIG. 60 is a front cutaway view of the left end of a wallbar for use with the embodiment of FIGS. 42–56.
Figure 58:
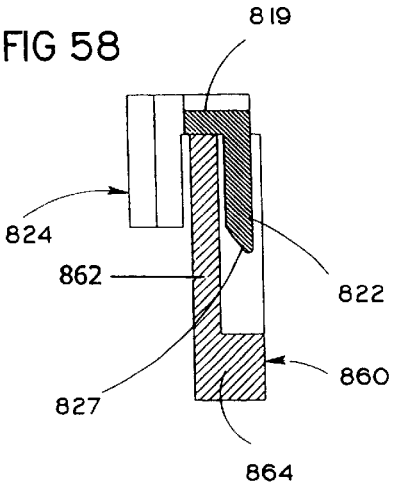
FIG. 58 is a sectional view taken through the line L—L of FIG. 60, showing a hook seated on the wallbar.
Figure 61:
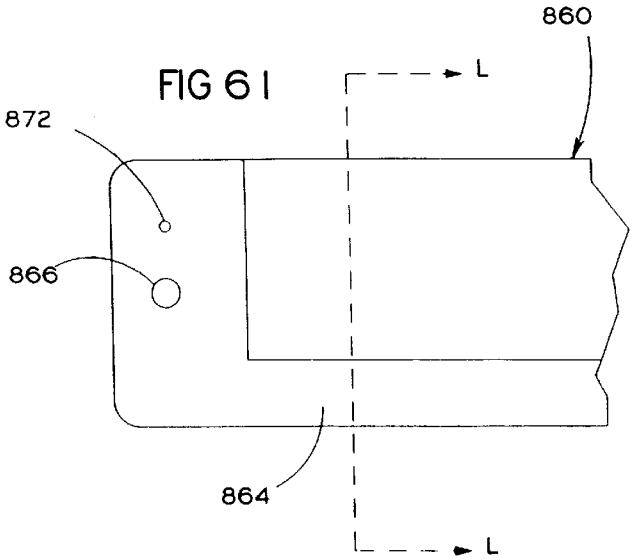
FIG. 61 is a rear cutaway view of the right end of a wallbar for use with the embodiment of FIGS. 42–56.

The relative configurations of the trigger rod/track/hookrod can be modified in many ways that will be apparent to one of skill in the art upon reading this specification. For example, neither the trigger nor hookrod necessarily need be within the track (if the trigger is external, however, it should be suitably rigid and not exceedingly long). FIG. 56A shows an example wherein the hookrod is placed behind the track rather than coplanar with its front face. FIG. 56A also illustrates a simplified hook 824' and prong 822' formed by bending the end of hookrod 820'.

FIGS. 62–64 depict an embodiment with a trigger rod 808' that is separately compartmentalized and set off to one side within track 812'. Also, the hook is simpler, largely internal to the track 812', and has a "T" cross-section when viewed from above or below (as shown in FIG. 64). This allows the hook and its prong 822" to be guided by track 812' without the hook having to wrap around it. To accommodate the axial offset of trigger rod 808' versus that of cage 831, connector 880 is provided connecting the two; similarly, modified trigger head 881 is provided for the top end of trigger rod 808', and includes a lower guiding portion that slidingly mates within the top of the channel of track 812'. Female shaped upper portion 882 of clamp 830' may be welded or otherwise securely bonded to the lower portion of track 812' which is inserted therein. Hookrod 820' is depicted as lying above the surface of track 812' in FIGS. 63 & 64, but this need not be the case, and to conserve room (i.e., gap between the hanging item and the wall), the hookrod can be made flush therewith.

An optional feature shown in FIG. 62 (also applicable to the embodiment of FIGS. 42–61) are the horizontally extended screwholes for screws 806, which allow horizontal adjustments to be made to the position of attachment of the track, e.g., by the custom framer, to compensate for discrepancies in measurement or weighting that might otherwise result in a tendency for the item to hang out of level. This adjustment can be made by loosening screws 806, sliding cap 804 (along with the top of the entire track assembly) left or right as necessary, and retightening screws 806.

In the embodiments of FIGS. 42–64, both the ratios of vertical adjustability vs. vertical item length, and horizontal adjustability vs. horizontal item length (assuming visible overhang of the device is undesirable), are maximized by minimizing the length of non-adjustable portions that obstruct adjustment. Such portions include the vertical length of cap 804, the distance from the top of cap 804 to the top of the frame, the distance between the top of clamp body 830 and balls 832, the vertical length of wallbar 860, and the horizontal length of its sides 865. Generally, a given reduction to any of these aspects results in a corresponding increase in adjustability equal to 50% of the reduction.

It should be noted that embodiments such as those of FIGS. 42–64 are adaptable to a wide range of applications where adjustability of an element is desired. Aside from framed items, another example is the new "flat screen" televisions and computer monitors that are now on the threshold of affordability. In fact, it is foreseen that the remote triggering lock of these embodiments can be effectively utilized in a variety of environments wherein linear adjustment with a one-way lock that is remotely triggered is desired, with or without a second degree of adjustability, and even if the desired support does not include a substantially vertical or flat surface. An office chair having an articulated chair-back of selectable height, adjustable-height free-standing lamps, adjustable height dental and medical apparatuses, are but a few of many examples. It should also be noted that the comments herein concerning the embodiments of FIGS. 42–64 are in most cases also applicable to the embodiments of FIGS. 70–95, and also to other embodiments described herein.

The embodiment of FIGS. 42–64 could also be adapted (not shown) to include a more rigid connection than that afforded by cable 840 alone, reducing pitching when the item is hung at its highest position (i.e., with the hook at its lowest position). For example, if the item permitted, a direct connection (e.g., tape, glue, screw, bolt, etc.) could be made between the clamp and the portion of the rear of the item just beneath the clamp (with or without cable 840). Such a connection could be most preferable in hanging items such as flat screen televisions and other items that have areas of rigidity on their rear inside of the outer perimeter or frame.

As another alternate to cable 840, a rigid vertical rod or track could connect the bottom of the clamp to the bottom of the rear of the hanging item, or a horizontal rod or track could connect the clamp to both sides of the item so as to form an upside-down "T" together with the track. A vertical rod or track may be preferable in most cases, but a horizontal track could facilitate a modification resulting in side-triggered activation. In any event, ,either orientation of such a rod or track could be affixed to endcap 837 or clamp body 830 in such a way that rigidity between track 812 and the rod is maximized (e.g., by extending the bottom portion of the clamp so as to mate with an extended part of the rod). The rod or track could further be optionally adapted to adjust to a few discrete mounting lengths or a continuous range of mounting lengths, so that stock track sizes could be used for all frames. To allow such a continuous range, a basic telescoping connection could be used, or serial attachment holes and break slots or perforations could be provided at the end of the lower connector, for example as taught in U.S. Pat. No. 2,740,603, issued to Wofford on Apr. 3, 1956, the disclosure of which is incorporated herein by reference.

Figure 70:
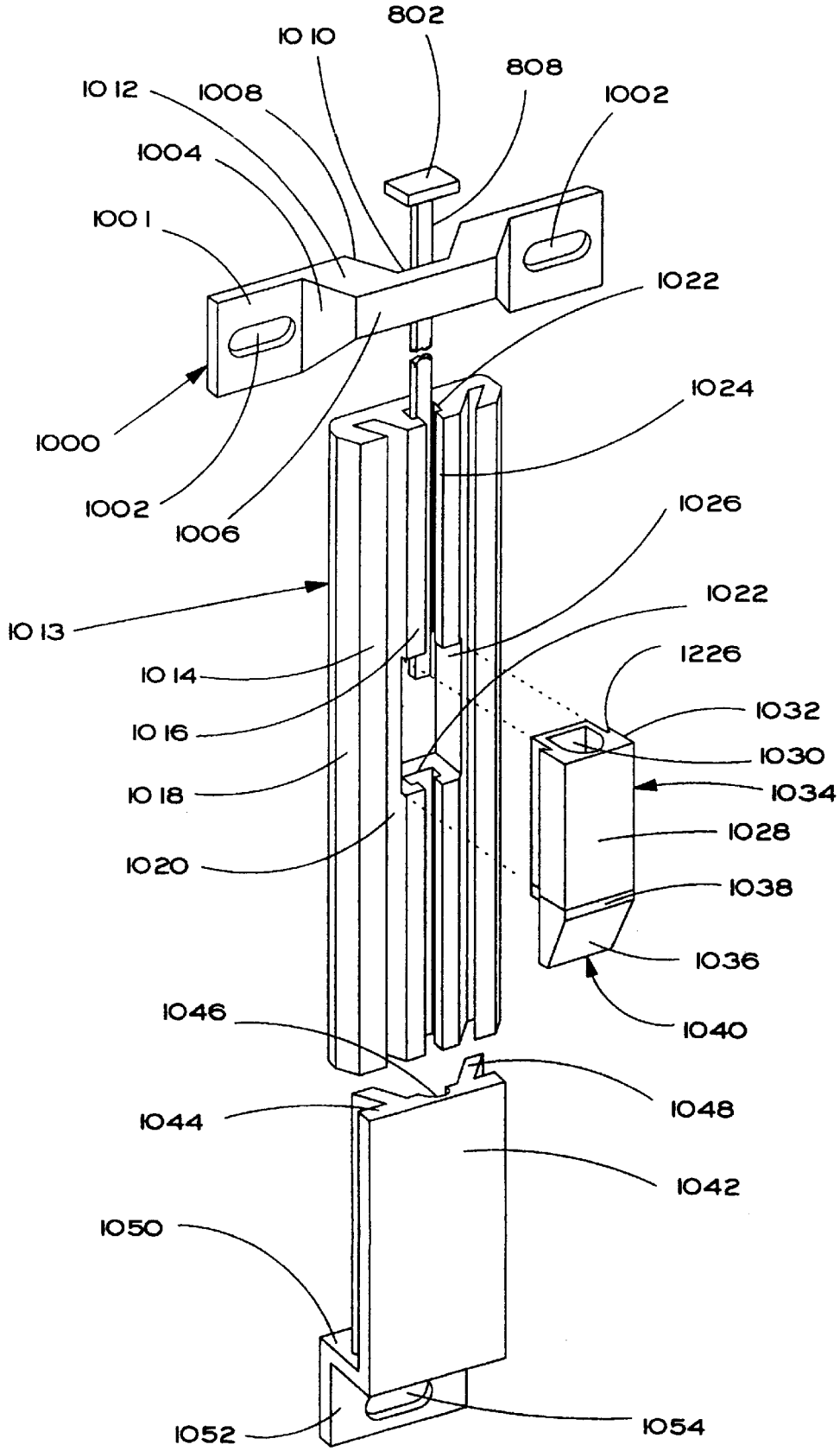
FIG. 70 is a perspective partial cutaway exploded view of a two-way adjustable embodiment similar to those of FIGS. 42–64, but with a full-length vertical track rather than a half-length one.

Indeed, the track can itself extend the full vertical length of the hanging item, and thus be rigidly and integrally connected to the top and bottom of the frame (along the midline or center of gravity of the item). As seen in FIG. 70, a convenient way of modifying the track in this fashion is to widen it sufficiently that a hole can be cut-out (roughly half-way along the vertical length of the track) of sufficient width such that a clamp assembly (mechanically similar to those described in connection with FIGS. 50 and 51, for example) can be inserted into the hole. This widening of the track also affords extra latitude to incorporate frontal grooves vertically along the track, into which the hook can dovetail (as opposed to wrapping-around behind the track as in the embodiment of FIG. 42), eliminating moving parts from the rear surface of the track (which might scrape the rear of the item).

FIG. 70 depicts such an embodiment, in perspective, with an insertable clamp 1034 being exploded away from the hole 1026 in the track 1013, and with substantial lengths at the top and bottom ends of the track 1013 being cutaway in order to vertically fit the illustration on the page while still showing details with some resolution. Disclosure Document No. 453,645, entitled "Disclosure Document," and marked as received in the Patent Office OIPE on Mar. 26, 1999 (mailed on Mar. 20, 1999), is also incorporated by reference as set forth in full herein, particularly with respect to the following discussion of FIGS. 70–91. FIGS. 70–91 are basically taken directly from scale technical drawings of prototypes that function very well, however, it should be readily apparent that certain parts are designed to facilitate prototyping and could be modified, simplified, or even eliminated for more economical manufacturing.

The track 1013 includes a trigger rod channel 1022 and hookrod channel 1024 similar to channels 809 and 816, respectively, of the embodiment of FIG. 42. Together, these channels form a "T" shape as viewed from the top. Track 1013 is fitted at its top end with a topcap 1000, and optionally at its bottom end with a bottom extender 1042. Both the extender 1042 and the topcap 1000 are formed with male dovetails which matingly slide into female dovetail slots 1020 of track 1013, and which are dimensioned to snugly hold in slots 1020 by friction (although they may be affixed more permanently, e.g., by glue). The size and dimensions of track 1013 can be widely varied, but the embodiment shown in FIG. 70 has been found to strike a good balance of material costs and functions if made of aluminum alloy number 6061, at an inch wide by about four or five millimeters thick, with the dovetails measuring about two and a half millimeters deep at the right angle, with channel 1022 measuring about three by 1.3 millimeters, and channel 1024 measuring about 1.8 by 1.3 millimeters, surfaces 1016 each being about two or more millimeters wide, and surfaces 1014 each being about 2.5 or more millimeters wide. Rigidity could be increased without increasing the track's thickness, by making its dovetails at right angles rather than slants (including making sloping sides 1018 orthogonal to the track's front surface), and increasing the width of the sections orthogonal to the direction of easiest bending of the track (in other words, strengthening the track's "ribbing"). In that case, the dovetails would become two back-to-back, upside-down "L" s. An alternate embodiment such as this may be preferably fabricated of cold-rolled or galvanized steel, and the channels 1022 and 1024 could simply be created and defined by an appropriately shaped extruded plastic strip affixed onto the otherwise flat central interior surface of a "C" shaped steel track.

Bottom extender 1042 (also shown in FIG. 75) also may have a sloping notch 1046 cut-out of its top region centrally between dovetails 1048. Then, when the item is adjusted such that the bottom of hookod 820 reaches the top 1044 of extender 1042, even if hookrod 820 has been bent outwardly from the frame, it will not likely get stuck on the top of extender 1042 and will instead quickly fall one way or the other—over the front of or behind—extender 1042. At the bottom of extender 1042, ledge 1050 helps to integrally connect lip 1052 to the rest of the extender 1042, and provides a more secure stopping surface for the extender to prevent it from being damaged through attempts to tap it further into track 1013 than it can go. An aperture 1072 (see FIG. 75) can be placed in ledge 1050 centrally between dovetails 1048, to permit the end of hookrod 820 to go just a bit further down, permitting a bit more vertical adjustability. The hookrod 820 should be long enough such that it can fall through this aperture but not quite long enough to reach the head of the screw connecting tab 1052 to the bottom frame edge through slot 1054. Also, tab 1052 should be sufficiently rigid to prevent it from bending, but preferably thin enough such that the head of a screw large enough for the frame and the slot 1054 would not protrude above the front surface of extender 1042 (because this would unnecessarily require the selection of thicker bumpers for the frame) when attached.

As an alternate to bottom extender 1042, a recessed mounting bottom extender (not shown in the figures, but shown in the illustrations of the aforementioned Disclosure Document) can be butted up to the top edge of the rear of the bottom length of a frame. This permits a more recessed mounting of the bottom of the track, resulting in more of a tilt or pitch to the hanging item (because the bottom of the item can hang closer to the wall) which in some circumstances may be considered a desired conventional appearance. Bottom extender 1042, however, having mounting tab 1052 and screw slot 1054 flush with (rather than above) the rear surface of track 1013, is easy to mount, and is found to not result in much additional gap between the bottom of the hanging item and the wall. Further, appropriate selection of commercially available bumpers for use on the rear of frames will prevent the slightly protruding extender 1042 from scraping the wall when the item is being hung or adjusted. Such bumpers should be selected to be about 1 mm or so thicker than the extender in order to allow for irregularities and bumps on walls that could otherwise stick out far enough to contact the extender 1042, which is undesirable if that part is uncoated metal.

Alternatively still, or additionally, to the option of bottom extender 1042, a hole can simply be drilled into the bottom end of track 1013 (not shown) centrally between slots 1020, for use in cases where vertical extension of the track 1013 is unnecessary in order for it to reach the top and bottom of a frame. Or, rather than a simple hole, a slot (similar to 1054) can be machined in similar fashion. Such a machined slot should extend partially into dovetail slots 1020, and if so, the upwardly protruding surface 1016 is preferably beveled down in the immediately surrounding area so that the head of a panhead screw (used to attach the track to the frame) can recess flush with or below the track's front surface.

Figure 74:
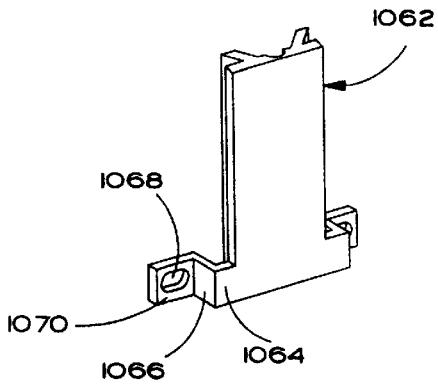
FIG. 74 is a front perspective view of an alternate bottom extender for use with the track of FIG. 70.
Figure 75:
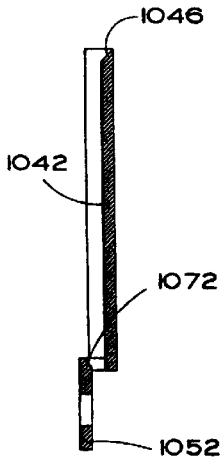
FIG. 75 is a side sectional view taken from top to bottom along the midline of the bottom extender shown in FIG. 70.

As a further alternate to extender 1042, a dual mounting extender 1062 can be used, as depicted in FIG. 74. This alternate extender moves the mounting slots 1068 and tabs 1070 to the sides rather than the center. Thus, it has the advantage that the bottom of hookrod 820 can move all the way to the end of the extender and the bottom edge of the frame, rather than being impeded by the extender or the screw placed therethrough. As depicted, extender 1062 preferably has slots 1068 and tabs 1070 that are flush with the rear surface of the track 1013. One of ordinary skill in the art will note that extended portions 1064 and 1066, which connect tabs 1070 to the rest of the extender, can along with tabs 1070 be appropriately modified with simple features well known in the art so as to insertably and lockingly mate with the slots provided in the edges of many common aluminum channel frames.

In use, different-lengthed track assemblies could be provided to custom framers in bulk, with a couple or few different-lengthed extenders also being available in bulk, and the closest-lengthed track selected for the frame. Then, if the closest-lengthed track is not long enough to reach the bottom section of frame, an appropriate extender can be chosen, and tapped into place until it reaches the desired length at the end of track 1013. If desired, the framer may also purchase some recessed mounting bottom extenders for the appropriate frames and circumstances.

Figure 71:
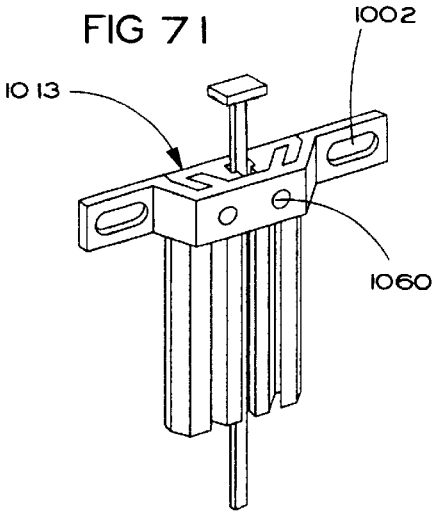
FIG. 71 is a partial perspective view of an alternate topcap for use with the track of FIG. 70.
Figure 72:
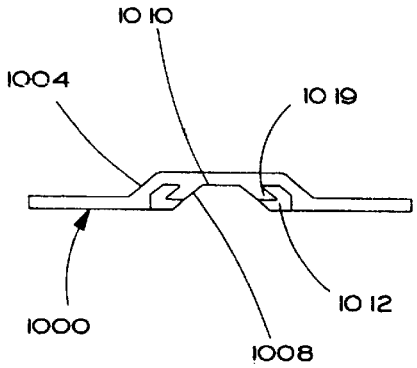
FIG. 72 is bottom view of the topcap of FIG. 70.
Figure 73:
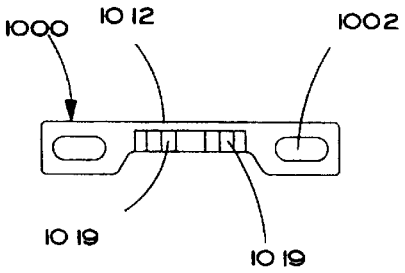
FIG. 73 is a rear view of the topcap of FIG. 70.

Topcap 1000 (shown in perspective in FIG. 70, from the bottom in FIG. 72, and from the rear in FIG. 73) is used to secure the top of track 1013 to the rear of the top section of the frame, and to orient the top of trigger head 802 in position flush with, or just above or below the top surface of the top section of the frame. Trigger head 802 and trigger rod 808 may be the same as described with respect to the embodiment of FIG. 42, and thus the head may preferably be an ergonomic plastic or rubber, and the rod 808 may preferably be an inexpensive metal or a hard plastic, preferably extruded. Topcap 1000 has mounting tabs 1001 with slots 1002 defined therein for attaching the topcap to the top of the frame's rear. Projection 1006 preferably protrudes farther out than the furthest protrusion of the heads of the screws that will be used to attach the topcap to the frame through slots 1002. Topcap 1000 is preferably metallic, in which case the front face of projection 1006 can also preferably be coated, dipped, or taped with polymer or any other substance that will not likely mar, scuff or "write" on a wall surface when in sliding contact therewith. The lower surface of projection 1006 provides an abutment to physically prevent the top of the hook 1076 (see FIGS. 76 and 77) from traveling off the top of track 1013, and is thus preferably formed complementarily with the top surface of the hook, i.e., flat in the case of the embodiment of FIG. 76 (at least over that portion of the bottom of the topcap that makes contact with the top of the hook). As noted above, topcap 1000 mates snugly with track 1013 through the use of complementary male and female dovetails. The tolerance between the dovetails can be selected such that topcap 1000 must be firmly tapped onto the top of track 1013 with a hammer, and will hold in place even if moderately pulled. In use, the primary force between topcap 1000 and track 1013 will be one of compression rather than pulling, so that a stronger connection between the two may be unnecessary depending on the circumstances. Trigger rod 808 and head 802 are preferably selected of a length such that the top of trigger head 802 protrudes above top surface 1012 of topcap 1000 by enough so that when fully depressed, the top of trigger head 802 is about flush with top surface 1012. Accordingly, the cutout defined by edges 1008 and 1010 should be large enough (or conversely trigger head 802 should have a cross-sectional size small enough) so that the cutout accommodates the trigger head 802 when depressed into the cutout. The cutout should not be too large, however (unless alternate connection means are used as shown in the embodiment of FIG. 71), as part of top surface 1012 needs to extend out enough (see FIG. 72) to effectively abut the top of the end of track 1012, preventing any further upward movement of the track into the topcap.

As just noted, an alternate connection means such as glue or welding can be used to more permanently connect the topcap 1000 to track 1013. Or, as shown in FIG. 71, structural connecting means well known in the art, such as rivets (not shown) can be used to connect the two members. Then, the top abutment of the embodiment of FIG. 70 (shown more clearly in FIG. 72) can be eliminated. To facilitate riveting or similar connection means, two parallel rivet holes 1060 can be bored through the mated topcap and track, extending from the front of the protruding front portion of the topcap, through the topcap's male dovetails 1019 and the track's female dovetail slots 1020, and through the rear of track. Rivet holes 1060 should be on either side of the channel 1022 (FIG. 70) defined in track 1013, but they should not impinge into channel 1022 as then the rivets could obviously obstruct the proper vertical sliding of the trigger rod 808 in channel 1022. The rivets (and their holes) are preferably countersunk on the rear side of the topcap so that they do not interfere with the connection between the topcap and the rear of the item to be hung. As with the topcap 1000 shown in FIG. 70, the vertical dimension, or height, of the central region of the topcap should preferably be minimized, in order to increase the amount of vertical adjustability available. It is for this reason that the middle portion of topcap 1000 shown in FIG. 70 is vertically compressed (see FIG. 73 in particular).

Figure 83:
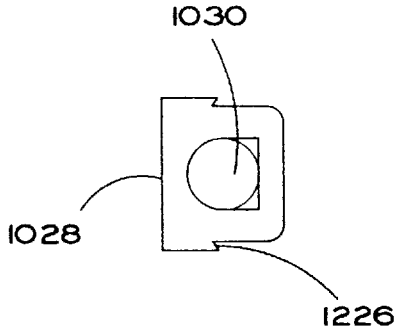
FIG. 83 is a top view of the clamp body of FIG. 70.
Figure 84:
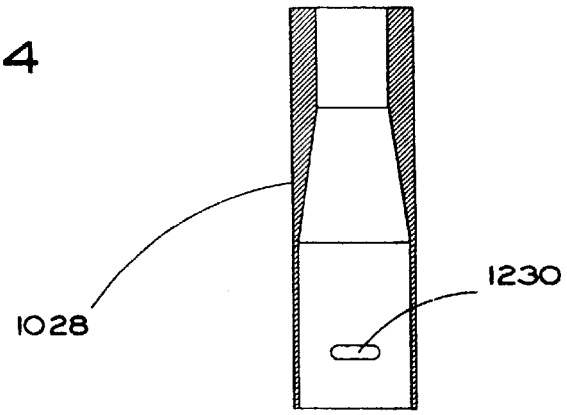
FIG. 84 is a side sectional view taken from top to bottom along the midline of the clamp body of FIG. 70.
Figure 85:
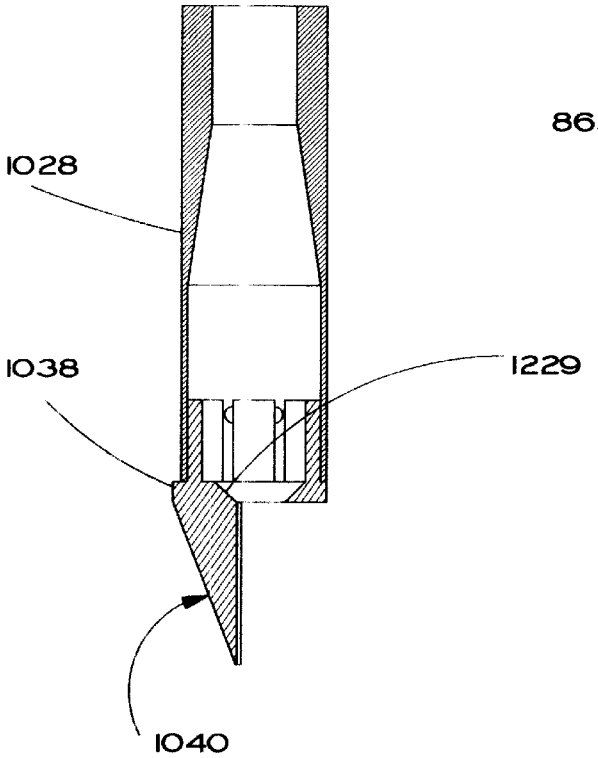
FIG. 85 is the same view as FIG. 84, further showing the endcap locked into the clamp body.

Returning to FIG. 70, the insertable clamp 1034 is shown before insertion into the hole 1026 which is cut into the center of track 1013. Track 1013 is preferably metallic, in which case laser cutting, broaching, punching, or other means well known in the art of machining metals may be used to create hole 1026. Clamp 1034 includes a body 1028 and an endcap 1040. Body 1028 is mostly similar in form and function to the clamp body 830 described in connection with FIGS. 50 and 51, with the most important difference being that body 1028 is formed to mate with track 1013 along the length of body 1028 rather than just at its top end as with clamp body 830. Further detail of body 1028 is shown in FIGS. 83–85; the internal parts are not shown in FIGS. 83–85 since adequate description of the construction and operation of such parts is provided in connection with FIGS. 50 & 51 above. As with the clamp body in those Figs., the upper region of body 1028 has a "mailbox" shaped (half circle, half square) aperture 1030, up through which the upper cylindrical projection of ball cage 831 projects and vertically slides (during activation of adjustability and reclamping), and down through which the rectangular (actually prism) shaped bottom end of trigger rod 808 projects and vertically slides. Body 1028 may include grooves 1226 which are formed complementarily with the front of the left and right edges of hole 1026. Grooves 1226 may flare outwardly a bit (not shown), so that a pair of dowels or shims (not shown) can be inserted in dovetail slots 1020 over top of the respective flared portions of grooves 1226, jamming the insertable clamp 1034 in place in the track. Such dowels can, before insertion of the clamp 1034, be inserted into hole 1026 and slid up slots 1020 and out of hole 1026. Then, after insertion of clamp 1034, the dowels can, with tapping of a hammer or the like, be slid in the slots 1020 back towards the hole and along sides 1032 of clamp body 1028 over grooves 1226, trapping the flared portions of the grooves in place in the track 1013.

Figure 79:
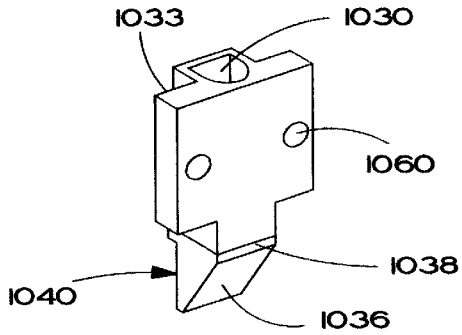
FIG. 79 is a perspective view of an alternate clamp for use with the track of FIG. 70.

Alternately, instead of holding the insertable clamp 1034 in place with dowels, as shown in FIG. 79, an alternate clamp body having tabs 1033 that extend further laterally can be used. In this embodiment, rivet holes 1060 can again be used to more permanently secure the clamp 1034 in place once inserted. Such holes 1060 should continue through the respective portions of track 1013, and should be set wide enough apart to avoid impinging on hole 1026, which could lessen the effectiveness of the rivets. They should also of course not impinge on the cavity defined in the clamp body as this would interfere with the clamping mechanism. Further, the rivets are preferably countersunk on both the front and rear if possible, so as to avoid scraping the wall and the rear of the hanging item. Alternately still, the clamp can simply be glued, soldered, or welded in place. It is found in use that the clamp will still perform reasonably well even when secured in place only by friction, and without the aid of dowels, rivets, glue, or other means. Preferably prior to locking the clamp 1034 in place, the bottom end of trigger rod 808 is preferably attached, by glue, snap-lock, welding, or other means, to the annular top 843 of the ball cage 831, so that it cannot be pulled out of the top of the track 1013.

Figure 80:
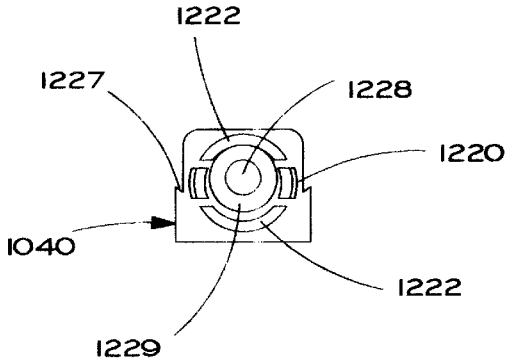
FIG. 80 is a top view of the endcap of the insertable clamp of FIG. 70.
Figure 81:
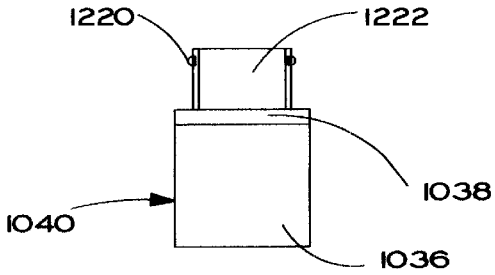
FIG. 81 is a front view of the endcap of FIG. 80.
Figure 82:
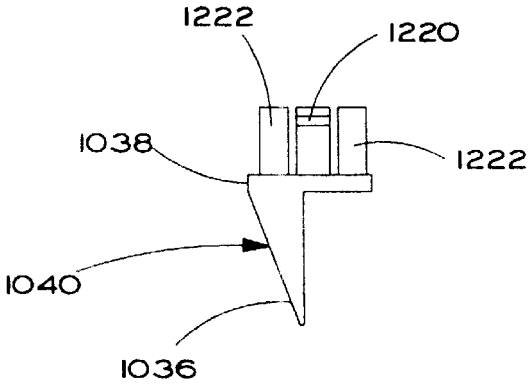
FIG. 82 is a side view of the endcap of FIG. 80.

The bottom end of body 1028 is closed off (after insertion of the cage, ball bearings, and coil spring) by endcap 1040. Shown in more detail in FIGS. 80–82 & 85, endcap 1040 includes a sloping front surface 1036 to prevent a false seating of the item to be hung (wherein the wallbar is inadvertently caught on the clamp assembly rather than the hook). This surface 1036 acts similarly to the ramps 844 described in connection with FIG. 54A. The endcap also includes a front surface 1038 which may optionally protrude further out (as shown in FIG. 85) than the front surface of body 1028. Body 1028 is preferably metallic, such as die cast aluminum, aluminum alloy, or zinc, and endcap 1040 is preferably molded plastic; thus, a protruding front surface 1038 can help prevent the clamp assembly from scuffing, marring, or "writing" on the wall surface during hanging or adjustment of the hanging item's position. Endcap 1040 can also include a pair of snap locks 1220 that mate with corresponding slots 1230 at the bottom of body 1028. Locks 1220, along with walls 1222, define a generally cylindrical protrusion (although locks 1220 are separated from walls 1222 and are thus free to flex more easily due to their shorter length) that inserts into the correspondingly cylindrical female bottom of body 1028. The two are shown locked in place in cross-section in FIG. 85. Also, at the bottom of endcap 1040 is a bottom aperture 1228 through which the bottom of the hookrod 820 exits the bottom of the clamp 1034, permitting vertical adjustment. Note that bottom aperture 1228 has sloping sides 1229, which, similarly to notch 1046, prevent the bottom of the hookrod 820 from hanging up or catching on what would otherwise be a perpendicular surface (that is, the edges of bottom aperture 1228). Also, as shown in FIG. 80, grooves 1227 can be formed into endcap 1040, generally as colinear continuations of grooves 1226 of body 1028.

Figure 46:
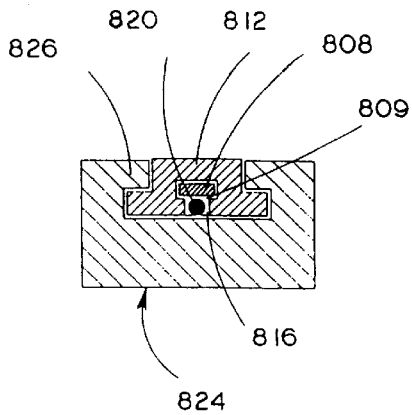
FIG. 46 is a sectional view taken through the line A—A of FIG. 43.
Figure 47:
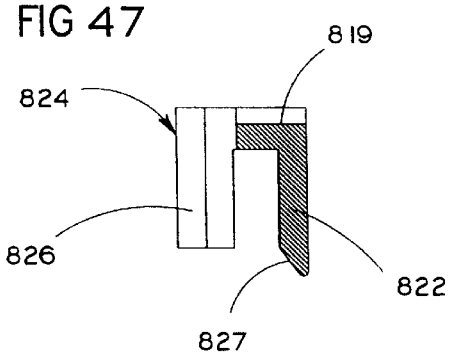
FIG. 47 is a sectional view taken through the line B—B of FIG. 43 (hookrod omitted)
Figure 48:
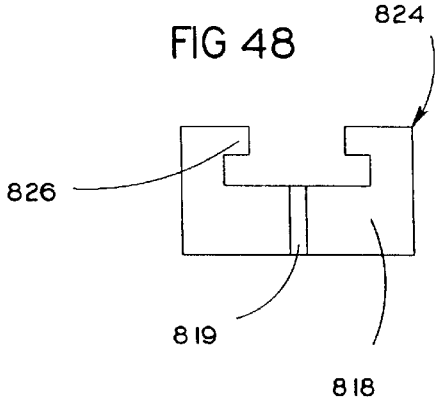
FIG. 48 is a top view of the hook of FIG. 42.
Figure 49:
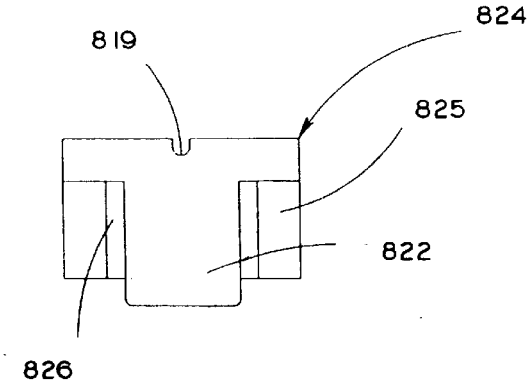
FIG. 49 is a front view of the hook of FIG. 42.
Figure 76:
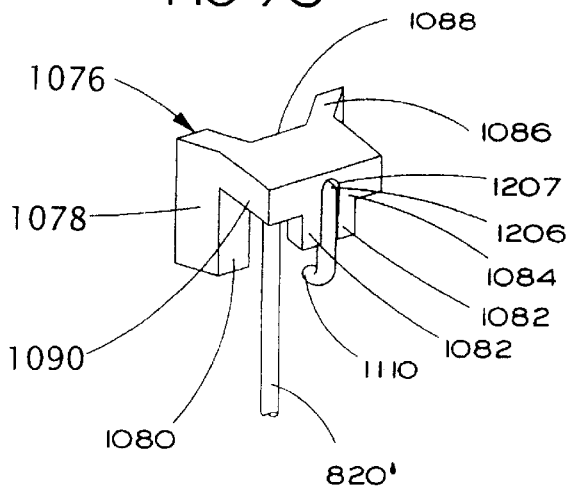
FIG. 76 is a front perspective view of a preferred hook and hookrod for use with the track of FIG. 70.

Moving to FIG. 76, a preferable hook for use in the embodiment of FIG. 70 is shown. Hook 1076 includes male dovetails 1086 which slidingly mate with female dovetail slots 1020 in track 1013. The angle (a 40° to 50° angle is found to work well) of the male and female dovetails of this embodiment ensures that hook 1076 is held in aligned engagement with the track, and surfaces 1078 physically prevent hook 1076 from being pulled out of the front of the track without a very large outward force (assuming the track and hook are constructed of metal) that would not be exerted by even a rather heavy hanging item. The male dovetails 1086 are preferably dimensioned to correspond to the internal dimensions of the slots 1020, with a bit of leeway (one or a few tenths of a millimeter or slightly more depending on the materials and manufacturing tolerances) to allow free vertical sliding in slots 1020. The orientation of hookrod 820' with respect to hook 1076 and track 1013 is similar to that of hookrod 820 in FIG. 42 et cetera. As such, hookrod 820' should be basically flush with or just barely protruding above the front surface of track 1013 when hook 1076 is pulled outwardly as far as the inherent "play" (afforded by the aforementioned leeway) will allow. Similarly, hookrod 820' should not forcefully impinge against trigger rod 808 when hook 1076 is pushed fully inwardly against track 1013. Also, the tips of dovetails 1086 preferably extend almost, but not quite all the way, to the corresponding remote ends of slots 1020, when hook 1076 is pushed fully inwardly against track 1013. As generally shown in FIGS. 46 and 47, there is preferably a slight amount of leeway (e.g., one or two tenths of a millimeter or slightly more) between the hook's upper central rear surface 1088 and the front surface 1016 of track 1013, when hook 1076 is in the middle of its range of inward/outward play. Front surfaces 1080 of dovetails 1086 are preferably parallel to the front surface of hookrod 820'. If metallic, the front surface 1084 of hook 1076 can preferably be painted, coated, taped or dipped with plastic or any other suitable substance that will not scuff, mar, or "write" on typical wall surfaces. Downward projections 1082 (which are transparent outlines in the background of the sectional view of FIG. 78) seat behind the wallbar 860', firmly preventing the hook from being pulled directly outwardly from the wallbar, and guarding against bending of the extended hookrod at bend 1206 that might otherwise be caused by pulling in that direction. Narrowing downward projections 1082 increases horizontal adjustability a bit.

To construct the hookrod 820' and connect it to hook 1076 economically, a section of straight stainless steel wire can be used. First, a barb 1110 can be formed at the tip of the hookrod 820', and then a right angle bend made at 1206. Then, the long straight end of hookrod 820' can be inserted through channel 1207, and finally bend 1217 can be made, firmly (or if desired, with some minor set degree of inward-outward play) locking hookrod 820' in place onto the hook. Top ledge 1090 is shown to extend horizontally a substantial distance in FIG. 76, which helps the hook rest level on the wallbar. Alternately, ledge 1090 may be narrowed significantly (e.g., to match the span of downward projections 1082) as long as it provides enough support to prevent distortion in the right angle bends of the hookrod (by application of weight of the hanging item), and to prevent bending or breakage of downward projections 1082. In this way, the hook is freer to rock or rotate somewhat (in the plane parallel to those of the wall and hanging item) where it is seated on the top surface of the wallbar, permitting leveling to be accomplished by gravity rather than being determined by the orientation of the wallbar. In instances where a user may be expected to not hang a wallbar properly, this ability to rock or rotate may be utilized beneficially, to allow leveling, as long as the track has been attached properly along the center of weight of the item. Additionally, the play in the dovetails adds to the aforementioned ability of the hook to rock or rotate on the top of the wallbar. It is found in practice that readily noticeable errors in hanging the wallbar can be overcome with this effect alone, as long as the track is attached centeredly.

Alternately (not shown), the hook body can be all molded plastic, and the hookrod insert molded or inserted and bent into place through a channel in the hook, although it may require high strength plastics (such as injection molded polycarbonate) and/or increasing the dimensions of the dovetails and slots, et cetera. In such an alternate, the connection of the hookrod to hook should be sufficient to ensure that the weight is smoothly transmitted from the hook to the hookrod, without causing a substantial bending moment in the hookrod or stresses on the hook. In any event, the use of plastics can reduce scraping of metal on metal, potentially reducing unpleasant high pitch noises during adjustment. This mode of noise reduction may be enhanced by incorporating a front running plate 1107 as shown in FIGS. 77A; plate 1107 separates the metallic track from the metallic wallbar and if it is made of plastic, then only plastic-on-metal sliding occurs. If plastics are not used (for the hook, or at least plate 1107), however, it is found that use of aluminum alloy 6061 for all vertically or horizontally major sliding surfaces can result in a rather low degree of noise. In any event, the addition of plate 1107 makes a modification of the track preferable in which surface 1016 is lowered (compared to surface 1014) by an amount equal to the thickness of plate 1107.

Figure 77:
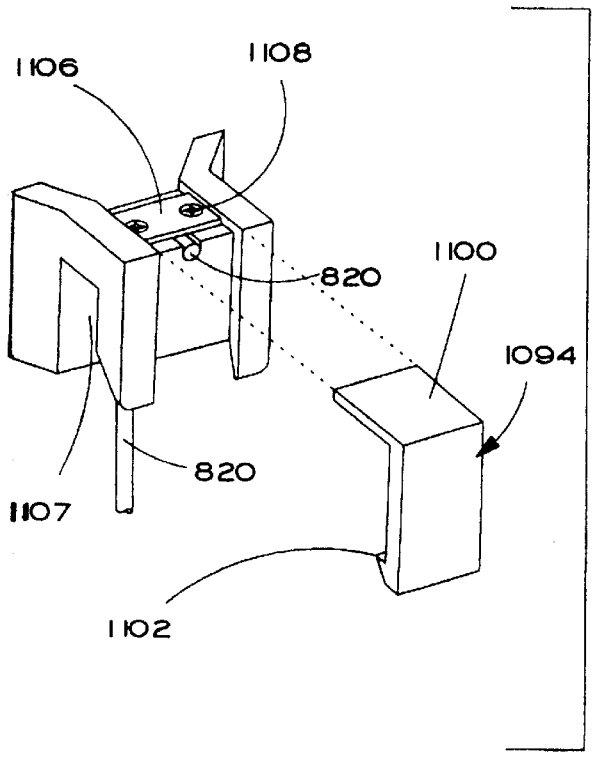
FIG. 77 is a front exploded perspective view of an alternate hook similar to that of FIG. 76.
Figure 77A:
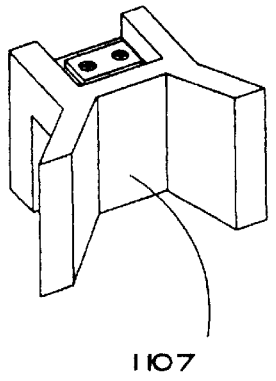
FIG. 77A is a rear partial perspective view of the hook of FIG. 77.

The hook depicted in FIG. 77 also shows an alternate barb 1102, which is a strip at the end of a plastic insert 1094 that glues or otherwise fixedly attaches onto the hook. Underneath this insert 1094, as an alternate means of connection of the hookrod to hook, a small metal plate 1106 and screws 1108 can be used to clamp hookrod 820 onto a niche (like 819 in FIG. 49) in the hook. Alternately, plate 1106 can be eliminated and insert 1094 screwed or otherwise firmly attached to the hook. Top surface 1100 of insert 1094 is preferably flush with the top of the rest of the hook, however, the front surface of insert 1094 preferably protrudes a half millimeter or so beyond the rest of the front surface of the hook, if the hook is metallic. This ensures that the plastic insert will hit the wall rather than metallic portions of the hook, which can mar, scrape, and "write" on typical wall surfaces.

Figure 78:
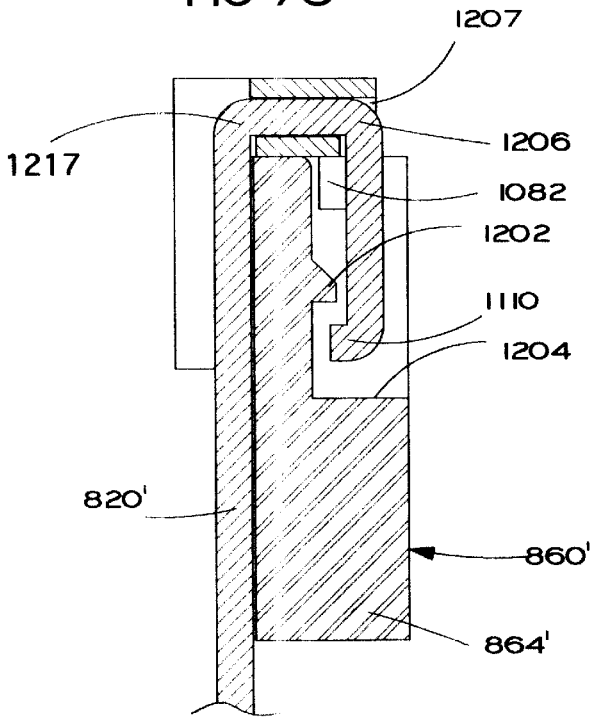
FIG. 78 is a side sectional view of the hook of FIG. 76 seated on the wallbar of FIGS. 86–88.
Figure 86:
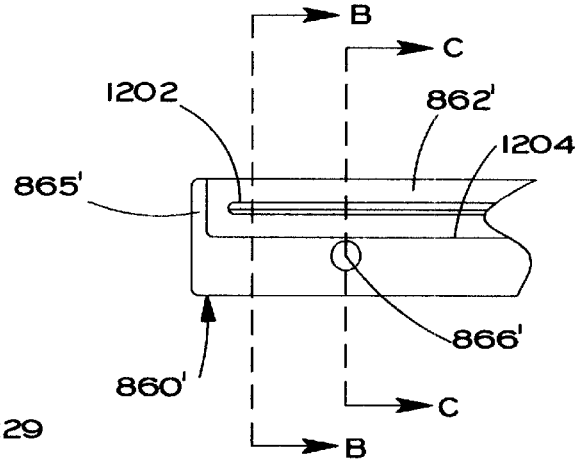
FIG. 86 is a rear cutaway view of the right end of a wallbar modified for use with the hook of FIG. 76.

Moving to FIG. 78, a sectional side view of hook 1076 seated on a modified wallbar 860' is shown. Modified wallbar 860' (also shown in FIGS. 86–88) includes a catch ridge 1202 which prevents barb 1110 at the end of hookrod 820' from moving upward once engaged. The barb 1110 is easy to engage in practice, because the top of ridge 1202 is sloped downwardly, but its bottom surface is flat. During seating of the hook on the wallbar, the weight of the hanging item pushes down on the tip of barb 1110, forcing it to slide down and over the sloping surface of ridge 1202, and causing a clicking noise to be emitted upon engagement. As shown, there should be a slight gap (e.g., two tenths or a few tenths of a millimeter or so) between ridge 1202 and the portion of the hookrod adjacent to the outward-most protruding portion of ridge 1202, in order to prevent scraping of the two and consequent noise and less smooth sliding. The barb 1110 should be slightly below the ridge 1202, e.g., a millimeter or so, so that there is some play to permit slight rotation and leeway during lateral sliding, but should be close enough to prevent too much momentum from being developed before barb 1110 hits the bottom of ridge 1202 during vertical upward adjustment. (Too much momentum could cause an undesirable amount of stress on the barb, hookrod and ridge, and could possibly allow unintended disengagement of the barb from underneath the ridge.) Ridge 1202 is preferably cut away at one end (alternately it can be cut away at both ends) enough so that if the hanging item is slid all the way to this end, barb 1110 will be directly below the cutout region and can be disengaged from the ridge 1202 by simply sliding it directly upward and through the cutout region. As shown in FIG. 86, ridge 1202 can be cutaway one or two millimeters less than just described, so that the hanging item must be pushed all the way to the end of the wallbar having the cutout, and, then, rotated a bit (in the plane parallel with the wall, with the bottom of the hanging item being pushed horizontally away from the wallbar and the top horizontally towards the wallbar) before the barb 1110 can be pulled up and disengaged. In this way, when the hanging item rotates, barb 1110 rotates slightly and moves below the cutout region, where it can never reach unless the item is rotated appropriately when pushed all the way to the end having the cutout. Such a modification can reduce the likelihood of unintended disengagement by a child or earthquake, et cetera.

A further feature of wallbar 860' is that its support rib 864' is taller than rib 864 of wallbar 860. In this way, the thickness of the wallbar can be reduced somewhat while retaining the same rigidity against bowing when the center of the attached wallbar is pulled outwardly from the wall. The top 1204 of rib 864' can be extended up to almost reach the tip of barb 1110, but some gap (e.g., half a millimeter) should be left between the two. Supporting wall 862' need only be thick enough to reliably support the anticipated weight of the hanging item without the hook causing indentations or failure in the top surface of wall 862'. A further feature of wallbar 860' is that its screwholes 866' extend through rib 864' rather than through sides 865'. Thus, sides 865' need only be thick enough to physically prevent the hook from derailing off the end of the wallbar, without sides 865' breaking or distorting. And, reducing the width of sides 865' affords increased horizontal adjustability, as noted above. Since track 1013 and hook 1076 slide in contact or close proximity with the front of rib 864', screwholes 866' are preferably beveled to accept a countersunk screwhead that can thus be sunk flush into the wallbar. Also, it should be noted that by placing the screwholes through the rib rather than through the sides, standardized uniform screwhole separation distances could be utilized throughout different ranges of wallbar lengths. In this way, a customer could remove an existing wallbar of a particular length from the wall, and replace it with a somewhat larger or smaller wallbar (e.g., to hang a new picture having a different width), while still utilizing the existing holes in the wall and thus not needing to place a third hole. Further still, this feature can be especially useful in conjunction with the standard stud separation screwhole spacing mentioned above, since it renders a greater range of wallbar sizes capable of dual stud support. However, screwholes 866' should not be placed too far from the left and right ends of the wallbar (too close together), as this could undermine stability of affixation of the wallbar to the wall. Alternately, rather than being integrally formed with the wallbar, sides 865' could be made of separate pieces that are threadedly inserted, glued on, or otherwise secured to the ends of the main piece of the wallbar. In this way, a uniform main section of the wallbar can be economically extruded (rather than the whole wallbar being cast or molded), screwholes 866' and the cutout region at the end of the ridge 1202 then machined in it, and finally, separate side pieces attached.

The wallbar of this embodiment (and many or most of the others taught herein) is susceptible to being integrated directly into or onto the wall surface. For example, a continuous, full wall-length wallbar can be formed directly into the surface of the wall, either protruding from, or flush therewith. This could be done by incorporating a wallbar seating surface, exposed by a horizontal slot above the surface, into horizontal brackets matching the length of standard sheetrock, and using the brackets to butt the ends of upper and lower sheets of sheetrock together. The slot exposing the wallbar seating surface should extend far enough above the surface to permit a hook—whether directly (i.e., with the item in the orientation it is desired to be hung), or rotated some amount, e.g., 90° (to prevent unintended disengagement)—to enter and seat on the surface. Also, with a flush incorporation of the wallbar, the hook should be made to protrude out sufficiently, and the clamp's protrusion should be minimized sufficiently, that the clamp would not impinge on the wall. Alternately, for a non-flush wallbar surface, a wallbar, or a molding incorporating an exposed wallbar seating surface, could be formed in long stock lengths, cut to a desired length, and then attached onto the wall. Such a wallbar or molding would preferably be attached at each stud support and run the full length of the wall, and would preferably be painted or otherwise incorporated into the wall's overall permanent aesthetic treatment. Such a molding could be fabricated of wood in conventional fashion, with a simple metal bar inserted (like the metal edge found on many wooden straight edges) into the molding to form the wallbar seating surface. Such a molding could alternately be formed of a durable plastic, depending on the weight of the items to be hung, and the depending on the particular configuration and materials of the corresponding hook and track. Particularly useful in art galleries, studios, and museums, two or more moldings (or sheetrock brackets) could be placed at different heights on a wall, so that medium to large sized items could be hung essentially anywhere on the wall and moved at any time to any other position without the user ever having to place or remove a nail or screw.

Figure 92:
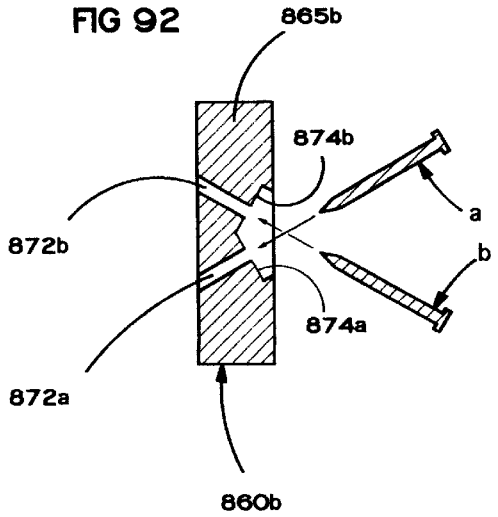
FIG. 92 is a side sectional view similar to that of FIG. 57 of an alternate wallbar to that of FIGS. 8–88.

As noted above with respect to FIG. 57 and its description, the wallbar (or at least its sides 865, be they integral or separate endpieces that are connected to a main extruded piece) can alternately be designed to be connected to the wall just with nails, in which case nailhole 872 is preferably placed at an angle. Further, as shown in FIG. 92, to improve holding into the support during repeated adjustments and stresses, dual opposing-angled nailholes 872*a* and 872*b* may be provided at each side 865. As shown, top nailhole 872*b* can be angled down and bottom nailhole 872*a* can be angled up, with the bevels 874*a* and 874*b* placed so that the nailheads will be next to each other and just in contact with each other when the nails are fully sunk into the bevels. In this case, if nail "a" begins to jiggle out of place, its head will tend to be physically obstructed by the head of nail "b" (since their lines of escape intersect within or just above the wallbar due to the closeness of bevels 874*a* and 874*b*. Alternately still, the downwardly-angled nailhole could be placed at the top rather than bottom, and vice versa with the upwardly-angled nailhole, although care should be taken that the lines of support projected into the wall by these nailholes not overlap when nails of an anticipated maximum length are used (either the angles should be sufficiently slight that this will not happen with the anticipated nails, or a slight right and left angle can be used to offset the nails from each other). As another alternate modification to the configuration of FIG. 92, bevel 874*b* could be set slightly further in than 874*a,* and both bevels could be brought just slightly closer together. In this case, nail "b" would be placed first, and then nail "a" would be placed with its head slightly overlapping that of nail "b" due to the different depthed bevels. This would further insure that nail "b, " which is upwardly angled and thus more prone to jiggling out due to the added force of gravity, is held in place (by nail "a," the affixation of which is only assisted by gravity).

As shown in FIGS. 89–91, a shim 1210 can be used to support the topcap 1000 for frames where the top rear edge of the frame does not protrude out rearwardly as far as other parts of the frame that are further toward the center of the frame. By building up the frame surface below the topcap 1000 with the appropriate number of shims 1210, the track can be securely attached to the rear of the frame, while not impinging upon any projections coming out of the rear of the frame, and without tending to bend the track in order for it to be securely attached. The body 1216 of shim 1210 is preferably about a millimeter or two in thickness, molded of plastic, and shaped so that the topcap nests into it, and multiple topcaps lockingly nest into each other when stacked. As shown in the side cross-section of FIG. 89, ridges 1214 have on their front a male protrusion that corresponds to and mates with the female indentation on their rear. As shown in FIGS. 90 and 91, shim 1210 is wider than topcap 1000, so that it will fully support topcap 1000 when topcap 1000 is slid all the way left or right. In this regard, the male protrusion of ridge 1214 is cutaway at central region 1232 enough to permit the trigger rod and trigger head to slide up and down therethrough; the cutaway region extends far enough left and right to accommodate the trigger head when the topcap is slid all the way to the left or right. Also, shim 1210 is preferably formed so that when the top of topcap 1000 is pushed all the way up to the bottom surface 1212 of ridge 1214, screweyes 1230 are fully visible within the slots of topcap 1000. Shim 1210 may also include alignment notches 1218 to assist in the identification of where screwholes should be placed in the frame (whether or not shimming is needed), and topcap 1000 may have center markings 1234 to also assist in alignment. Also, an alternate shim (not shown) could be made with slots (instead of holes) that mirror those of topcap 1000. In this case, the topcap 1000 and shim(s) below it would slide left or right as an integral unit (rather than the topcap sliding on top of the fixed stack of shims), allowing horizontal adjustment of the track and thus centering.

Additionally, a measuring tape can be fashioned to best facilitate the alignment and positioning of topcap 1000 and track 1013. For example, as shown in FIG. 123, a measuring tape 1380 can be made with a slot 1381 at its center, left and right eyelets 1382 on either side of the slot. Eyelets 1382 should match up with, and be spaced apart from each other by the exact same distance as, the separation of the midpoints of slots 1002 of topcap 1000. A convenient length for tape 1380 is three feet, given the size of common frames and other items to be mounted, and tape 1380 can be similar in construction to measuring tapes commonly used by tailors. By placing tape 1380 along the top of the item, one can locate and mark the best positions for placing screws with which to mount topcap 1000 (through slots 1002) to the frame. Specifically, the left and right sides of the tape may be marked with inch dividers 1388, numbers 1386 (starting at "0"), and tenth markings 1387, with numbers 1386 counting upwardly in a mirror-fashion in the direction away from the center slot 1381 (both right and left). Thus, by pulling the tape until the same exact reading is found (e.g., 6 inches and 7 tenths, or "6.7") on both sides, the center slot 1381 is placed exactly at the horizontal midpoint (which should correspond with the center of gravity) of the frame. The user should see precisely the same thing (same numbers, same orientation, etc) on each end of the tape when the midpoint is found. To facilitate even quicker readings, tape 1380 can include an unmarked portion 1383 extending six inches to the left and six inches to the right of center slot 1381 (since few frames if any would be narrower than one foot), a horizontally marked portion 1384 (which generally corresponds to the orientation of the eyes when looking in this more central region of the tape), and a vertically marked portion 1385 (which likewise corresponds better to the orientation of the eyes viewing this more remote region of the tape). Further, tape 1380 is preferably of a width such that, with the centers of eyelets 1382 provided equidistant from the top and bottom edges of tape 1380 (so that the tape will still mark an appropriate location even if used upside-down), eyelets 1382 will be positioned at an appropriate level for the mounting of screws through slots 1002 when an edge of tape 1380 is placed flush along the top of the frame. (By "an appropriate level," it is meant that the topcap 1000 would be affixed to the top of the frame such that trigger head 802 is approximately flush with the top surface of the frame). Once the midpoint has been located, and the tape made flush with the top edge of the item, the user can then insert a pencil or felt tip pen through eyelets 1382 and mark the spot, or could even drill right through them. Slot 1381 can be used in a similar way, to locate and mark a short line for where the lower screw should be placed, for attaching the bottom of the track, or its bottom extender if one is used.

The track of FIGS. 70–91 is preferably one continuous piece that can be extruded of aluminum alloy (preferably 6061 or 6063) or stainless steel, processed (preferably heat treated, and optionally anodized), cut to various lengths corresponding to specific ranges of frame sizes, and machined (with a hole or slot machined at bottom, and a hole for the clamp punched, laser cut, or broached in the center of the track). The topcap and bottom extender can be preferably die cast of aluminum alloy, and the clamp body can be preferably die cast of zinc or aluminum alloy. The wallbar is preferably extruded of aluminum alloy (6061 or 6063) and cut to various lengths, the holes and ridge cutaway machined, and side pieces applied. The hook can preferably be die cast of aluminum alloy or insert molded of high strength plastic. The endcap can be molded of any suitable plastic.

It should be noted that the full-length track embodiment of FIGS. 70–91 are particularly amenable to the addition and support of an overhead display light such as are commonly used on better paintings. The support of many overhead lights can be modified to attach to, e.g., the screws/slots of the topcap 1000 while permitting room for the trigger head to be accessed. Preferably, the topcap is strengthened and dual upright supports added to its left and right sides for attachment of the light apparatus, with a sufficient gap left between the supports to permit convenient manual access to the trigger head.

It should also be noted that in the case of heavy and relatively wide items (e.g., two and a half feet or wider), greater stability and leveling can be obtained at the expense of a loss of some horizontal adjustability, by employing two tracks and two wallbars instead of one. The tracks can be attached vertically on the rear of the item so as to divide it into three equal sections (although the tracks could be placed closer or farther apart), and the wallbars hung on the wall with their centers roughly far enough apart to match the separation of the tracks. In this way, more stud attachments could be utilized, and greater stability and strength obtained. Further, leveling would be precisely adjustable (by differentially adjusting the two respective vertical positions), and unshakable.

As noted above in the discussion of the clamp mechanism depicted in FIGS. 50–54, although the ball and cage mechanism is focused on for purposes of explaining the concepts of the invention and what is presently considered its best mode, one of skill in the art should now readily see that many other clamp mechanisms can be used in various apparent embodiments of the present invention. While the ball and cage mechanism is smooth, reliable, and strong, there are many other simpler and more complex mechanisms that can be used to achieve clamping, within the scope of the invention.

For example, as shown in FIGS. 96–99, a simple one-way lock similar to a ball and cage clamp but with only two moving parts can be used, and may be best suited to medium weight items, e.g., frames up to a large sized diploma or so. In this embodiment, a simple cone-shaped clamp body 1208*b* is used to house conical spring 834*b,* part of hookrod 820*b,* the lower end of trigger rod 808*b,* and node 832*b,* forming clamp 1034*b*. Trigger rod 808*b* can be integrally connected to spring 834*b* by simply winding the end of trigger rod 808*b* to form such a conical coil shape. Node 832*b* can be integrally formed on trigger rod 808*b,* by for example melting trigger rod 808*b* until a ball or node shape forms, or by welding, soldering, gluing, etc. Preferably, node 832*b* has an upper leading surface with an incline that easily slides along (but is not parallel with) conical inner surface 845*b* of clamp body 1208*b* so that when spring 834*b* forces node 832*b* upward, it rapidly wedges in between hookrod 820*b* and one side of conical inner surface 845*b* just below ellipsoid top aperture 1030*b*. Clamp body 120*b* is connected to the end of a half-length vertical track (see, e.g., FIG. 42 et seq. and accompanying description) or to the middle of a full-length vertical track (see, e.g., FIG. 70 et seq. and accompanying description), and the track is attached in a vertical orientation to the rear of the item to be hung. For example, for lighter applications, clamp 1034*b* can be molded as an integral part of a full-length plastic track. In that case, the track's topcap could also be molded integrally with the track to reduce parts, and the lower half of the track could provide full enclosure for the hookrod. Also in that case, a wallbar would be preferably molded of plastic, and the rear surfaces of both the vertical track and the wallbar could have an adhesive layer covered by a paper or polymer layer that readily peels off prior to affixation to the item to be hung and to the wall of the respective part.

The top end of hookrod 820*b* preferably has a hook (not shown) with downward-pointing prong, and the rear of the hook slidingly mates with the track, such as with a wrap-around or dovetail as described in connection with FIGS. 42 and 70, etc. The bottom of hookrod 820*b* exits through bottom aperture 1228*b,* which can be offset (not shown) slightly to the front of endplate 837*b* since hookrod 820*b* is in front, and trigger rod 80*b* is toward the rear. Trigger rod 808*b* is preferably held in place by the track and terminates at its top in a trigger head (not shown) that is to be placed flush or near flush with the top edge of the rear of the hanging item, generally as described with respect to the embodiments of FIGS. 42 and 70. Ellipsoid aperture 1030*b* is oriented so that the top of clamp 1034*b* appears narrower when viewed from its front or rear and wider when viewed from the side; conversely, to reduce the overall gap between the hanging item and the wall, endplate 837*b* is elliptical and oriented so that the bottom of clamp 1034b appears narrower when viewed from the side and wider when viewed from the front or rear. Both hookrod 820*b* and trigger rod 808*b* pass through ellipsoid aperture 1030*b;* when at rest, node 832*b* is forced upward by spring 834*b* toward the narrower region of conical inner surface 845*b* so that it wedges hookrod 820*b* in place, which wedging is enhanced by the pull of gravity on the hanging item, which forces clamp body 1208*b* downward with respect to hookrod 820*b*. The bottom of spring 834*b* abuts the top of endplate 837*b* and is too large to exit through bottom aperture 1228*b*. For easier manufacture, spring 834*b* could be inserted inside clamp body 1208*b* by inserting the top end of trigger rod 808b (before placing a trigger head on it) up through bottom aperture 1228*b,* passing node 832*b* through aperture 1228*b,* and then rotating spring 834*b* such that it winds or screws up into bottom aperture 1228*b* until all of spring 834*b* enters clamp 1034*b* and the bottom end of spring 834*b* snaps out into its natural state of expansion, thus laying on endplate 837*b* and being prevented from exiting aperture 1228*b.* Bottom aperture 1228*b* may also have sloping edges on its upper side, so as to prevent the bottom of hookrod 820*b* from getting hung up on endplate 837*b* during adjustment. Spring 834*b* is coiled around hookrod 820*b* and shaped so that it fits within clamp body 1208*b* without contacting conical inner surface 845*b.* As shown in the Figs., clamp body 1208*b* can be made of a uniform thickness. Note that conical inner surface 845*b* in this embodiment is not strictly conical due to the ellipsoid (rather than circular) shape of apertures 1030*b* and 1228*b.* Various other cross-sectional shapes of the clamping region of the conical inner surface, the node, and the hookrod and trigger rods, resulting in different clamping dynamics, will be readily apparent to one of ordinary skill in the art. For example, the hookrod could have a rectangular cross-section with its larger aspect visible from the front or rear, and the upper ellipsoid aperture of the clamp body could be rotated 90° so that the conical inner surface would have a uniformly ellipsoid cross-section from top to bottom. Similarly, the hookrod could have a rectangular cross-section and the clamp body and its inner surface could have a corresponding rectangular cross-section. It should be noted that in this embodiment, the node is preferably integrally connected to the trigger rod, although it could alternately be slidingly connected. In that case, a cylindrical sleeve could be affixed to the bottom of the node, sheath the hookrod, and continue down to the top of the spring, so the spring would cause the sleeve to urge the node upward.

In addition to variations of the ball and cage lock mechanism, one of ordinary skill in the art will by this time recognize that a wide variety of other one- or two-way lock mechanisms are suitable for use in the present invention. For example, with the remote trigger embodiments of the invention, a modification of the one-way lock used on many conventional ironing boards may be incorporated. Ironing boards commonly employ a lock (to lock the board in an upright position with the legs scissored open) that includes a long cylindrical rod passing through a sharp-edged circular aperture in a collar. The collar is almost perpendicular to the rod (such that the aperture is almost coaxial with the cylindrical rod), but is spring-biased away from perpendicular such that the sharp edges of the aperture cut into the rod, locking the rod against movement in the direction of the spring bias. A remote trigger arm is provided (usually with a loop at the end to facilitate manipulation by hand), and when triggered, the arm repels the spring-bias, moving the collar more perpendicular to the rod (and thus the aperture more parallel with the rod). As this happens, the sharp edges of the collar's circular cutout no longer cuttingly grip into the sides of the rod, and the rod is free to move up or down through the cutout. In this way, the ironing board's level can be lowered or raised, or its legs can be folded back and the board stored. As soon as pressure is released from the trigger arm, the spring-bias moves the collar away from perpendicular so that its aperture's sharp circular edges again grip into the adjacent edges of the rod.

An embodiment of the present invention incorporating such a clamping mechanism is shown in FIGS. 100*a* through 102*b.* Collar 1250 inserts into track 812*d,* with pivot 1252 exiting through pivot hole 1260 in track 812*d,* and activation plate 1256 and part of neck 1255 exiting through window 1261 in track 812*d.* To facilitate assembly, window 1261 could have a wider opening at its bottom, large enough to allow activation plate 1256 to pass through, and pivot 1252 could screw into collar body 1253. Then, during assembly, collar 1250 can be slid down into track and activation plate 1256 extracted through the wide section at the bottom of window 1261, and the the pivot end of collar body 1253 lined up with pivot hole 1260, and pivot 1252 inserted through pivot hole 1260 and screwed into collar body 1253. Then, spring 1259 (which as depicted can simply be a piece of wire bent into a loop with extended tag ends forming about a 120° to 170° angle) could be attached to the side of track 812*d,* just below window 1261, and then its top end attached to the bottom of activation plate 1256 such that activation plate 1256 is physically prevented from returning low enough to reach the wider section of window 1261. The rest of window 1261 above its wide bottom section would then be just slightly wider than the width of neck 1255. Aside from preventing the collar from falling out of window 1261, spring 1259 would also urge activation plate 1256 up near the top of window 1261 when at rest. On the top of activation plate 1256 would be attached the bottom of trigger rod 808*d,* which works in similar fashion to the other remote triggers described herein. Trigger rod 808*d* would be held in general alignment with track 812*d* with the aid of holder 1269, which could be a simple screweye attached to the side of track 812*d* at its top. At the top of trigger rod 808*d* is a trigger head 802*d* which is simply a button shaped head with an ergonomic shape for convenient manual pressing. The top of track 812*d* (other features, e.g., topcap, etc., of which are not shown in the Figs.) should be attached to the rear of the hanging item such that trigger head 802*d* is flush or just about flush with the top of the rear of the hanging item when at rest.

Figure 100A:
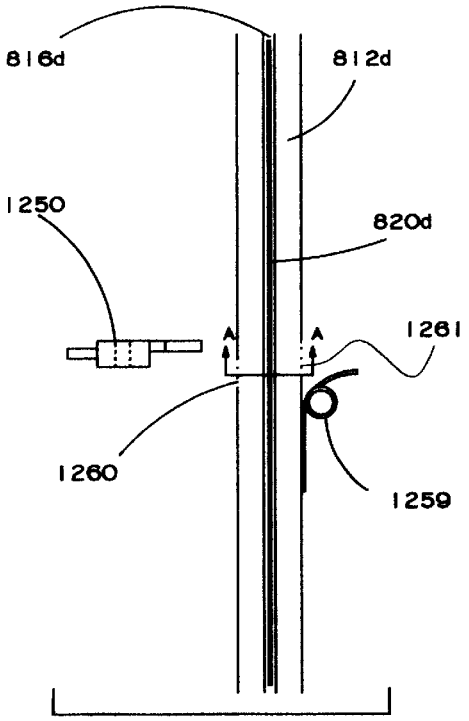
FIG. 100*a* is a front exploded cutaway view of an embodiment similar to that of FIG. 70, but utilizing a different clamp and different-shaped track.
Figure 100B:
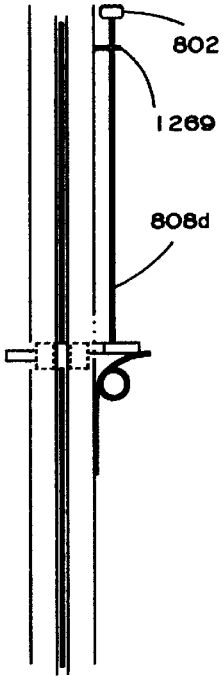
FIGS. 100*b* and 100*c* are a series of front views of the embodiment of FIG. 100*a,* showing the triggering and clamping mechanism of this embodiment, with the clamp triggered (unlocked), and at rest (locked), respectively.
Figure 100C:
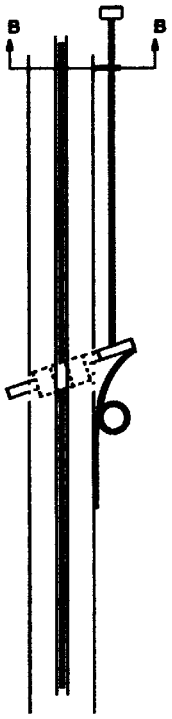
Figure 101:
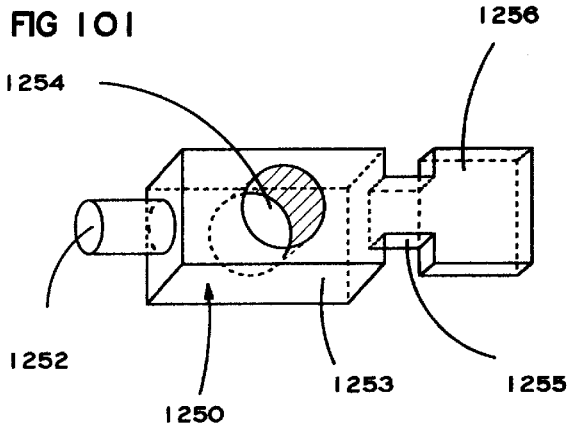
FIG. 101 is a top front left perspective view of the collar used to provide clamping in the embodiment of FIGS. 100*a*–100*c;*
Figure 102A:
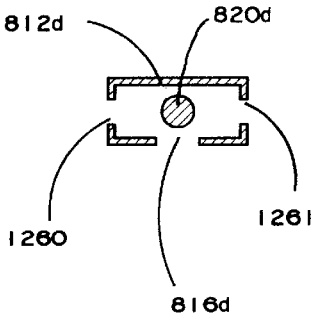
FIG. 102*a* is a sectional view of the track and hookrod of the embodiment of FIG. 100*a* taken through line A—A.
Figure 102B:
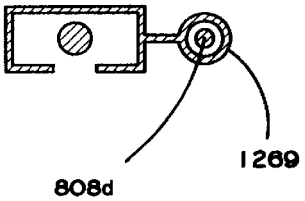
FIG. 102*b* is a sectional view of the track, hookrod, trigger rod, and trigger rod holder, taken through line B–B in FIG. 100*c;*
Figure 103:
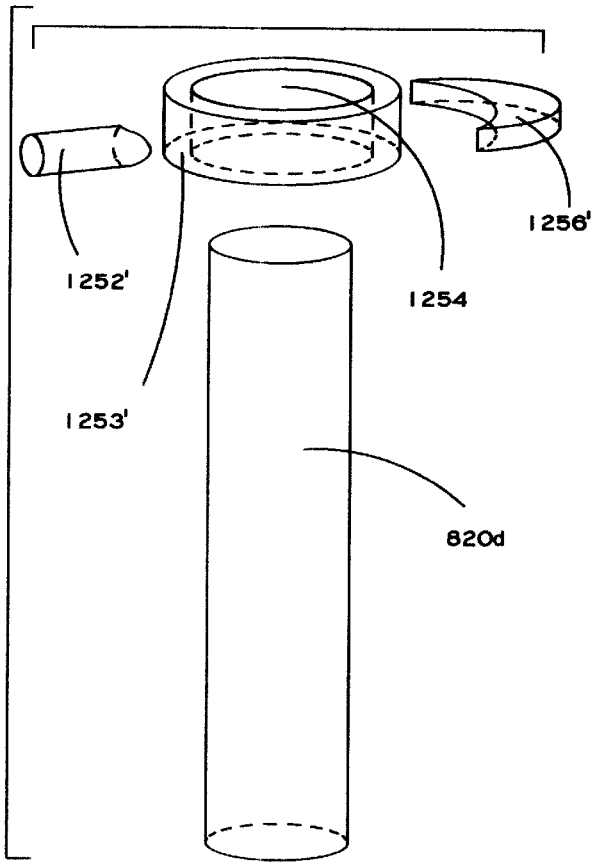
FIG. 103 is a partial transparent exploded perspective view of an embodiment similar to that of FIG. 100*a,* but utilizing a more compact collar and a two-part track.
Figure 104:
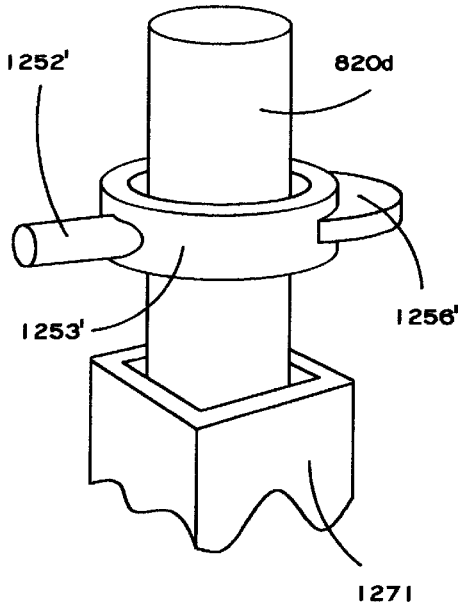
FIG. 104 is a partial perspective view of the embodiment of FIG. 103, showing the hookrod inserted into the top of the lower track half.

In FIG. 100*c,* the track and clamp is shown at rest (the hook is not shown, although it is attached to the top of hookrod 820*d* through channel 816*d,* and is held in sliding connection with track 820*d* by use of a sliding dovetail connection or the like at the rear of the hook). At rest, spring 1259 urges plate 1256 upward, causing aperture 1254 to move out of parallel with hookrod 820*d,* with the edges of aperture 1254 biting into hookrod 820*d* and locking it against upward movement relative to the collar (which is associated with downward adjustment of the hanging item relative to the wall). Note that downward movement of the hookrod relative to the collar (which is associated with upward adjustment of the hanging item relative to the wall) can occur even without activation by the trigger, since pulling downward on the rod causes the rod to push the collar against (rather than with) the spring, moving the collar closer to perpendicular with the rod. At rest, the collar is prevented from overly cutting into and thus damaging the hookrod (under the combined forces of gravity, the spring bias, and any downward force inadvertently applied on the hanging item by a user without activation), because neck 1255 reaches the top window 1261 and the corners of plate 1256 reach the side of track 812*d,* before the collar can deflect too far.

In FIG. 100*b,* trigger head 802*b* has been manually depressed by a user, forcing trigger rod 808*d* down and thus activation plate 1256 down against the urging of spring 1259, and bringing collar 1250 into perpendicularity with hookrod 820*d.* Thus, aperture 1254 is brought into parallel with hookrod 820*d* and thus its edges no longer bite into hookrod 820*d*. Note that collar 1250 should be of a rigid and hard metal in order to maintain the torque and weight that is applied on it and its edges during gripping. Also, since some noticeable angle of deflection of the collar must be made before the hookrod can be effectively grabbed by the edges of aperture 1254, aperture 1254 should be fairly short in length and a bit larger in diameter than hookrod 820*d*. It should be kept in mind that since the collar bites into and exerts a torque on the hookrod, the hookrod is preferably durable and resistant to bending. While a typical ironing board employs a rod with a diameter of about five millimeters, a smaller diameter (e.g., three or four millimeters) hookrod of a sufficiently strong metal can be used for average-sized hanging items.

Figure 105:
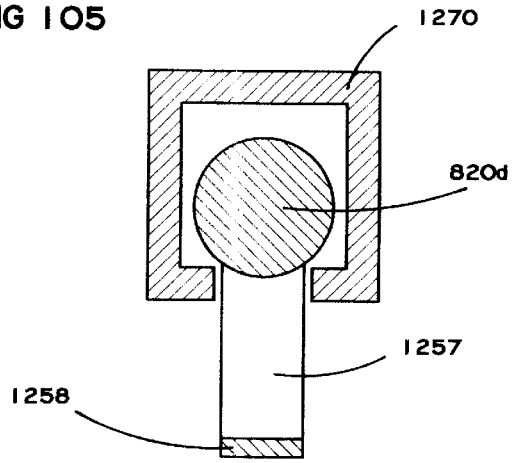
FIG. 105 is a top sectional view of the upper track half of the embodiment of FIG. 103, showing the hookrod therein, and the hook projecting out from the hookrod.
Figure 106:
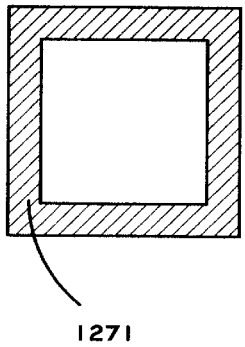
FIG. 106 is a top sectional view of the lower track half of the embodiment of FIG. 103.
Figure 107:
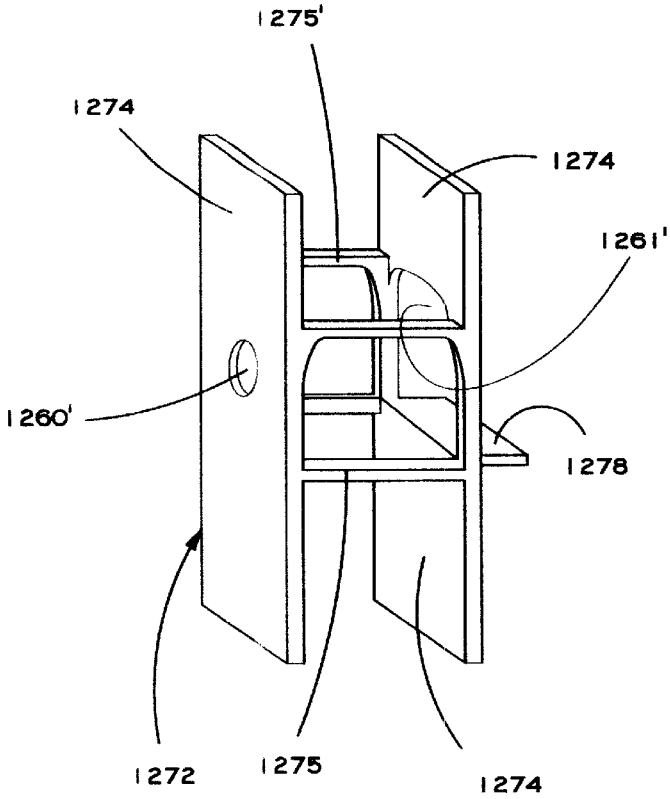
In FIGS. 107–109, shading for solid parts is used and will be deleted in the formal drawings.}
Figure 108:
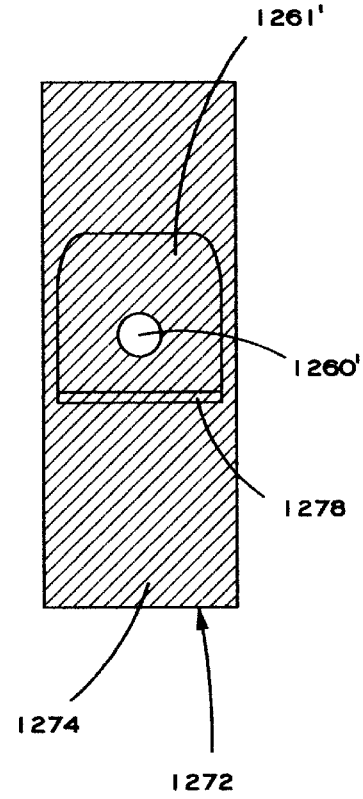
Figure 109:
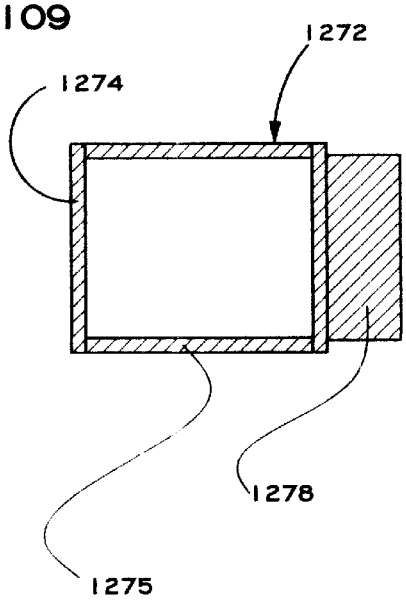

Alternately to the configuration depicted in FIGS. 100*a* through 102*b*, to reduce the tendency of the hookrod to bend under the torque of the collar, the hookrod can be more tightly enclosed by the track, as in the embodiment of FIGS. 103–109. In this embodiment, the track is broken into a lower track half 1271 and an upper track half 1270. As shown in FIG. 106, lower track half 1271 has a simple square cross section, and thus fully encloses the lower end of hookrod 820*d*. As shown in FIG. 105, upper track half 1270 has a similar cross-section, except there is a slot running down its front for the hook 1257 to exit through, with prong 1258 seating behind a wallbar. Hookrod 820*d* is not much smaller in diameter than the interior of track halves 1270 and 1271, and thus when collar body 1253' bites into the sides of hookrod 820*d* thereby exerting torque on it, hookrod 820*d* is prevented from bending unduly under the torque, and thus maintains a generally vertical straight configuration. Pivot 1252' is generally similar to pivot 1252 of the previously described embodiment, and activation plate 1256' is similar to activation plate 1256. A coupling 1272, such as shown in FIGS. 107–109, is used to connect the bottom of upper track half 1270 with the top of lower track half 1271, with the collar pivotingly contained within coupling 1272. Coupling 1272 consists of side tabs 1274 the interiors of which can be integrally affixed to the exterior of the respective top and bottom portions of track halves 1270 and 1271, with connecting bars 1275 lying just above and just below the respective tops and bottoms of track halves 1270 and 1271. Pivot 1252' exits through pivot hole 1260', which is a bit larger in diameter than pivot 1252'. In the front and rear of the coupling, between bars 1275, there is open space, to accommodate the front and rear of collar body 1253'. On the right side of coupling 1272, there is a window 1261', through which activation plate partially projects and pivots. At the bottom of window 1261' is a spring ledge 1278. On top of spring ledge 1278, a coil or other spring (not shown) is connected, the top of which is affixed to the bottom of activation plate 1256', urging it up, and collar body 1253' out of perpendicular, and aperture 1254 out of parallel, with hookrod 820*d*.

Alternately to the trigger and spring configuration depicted in FIGS. 100*a* through 109, the trigger rod can be placed behind the hookrod somewhat similarly to the configuration of FIG. 70, with a spring and trigger and activation plate similar to that of a typical ironing board manufactured by Home Products International (formerly Seymour Housewares). This mechanism could comprise a coil spring that sheathes the hookrod, with the bottom of the coil spring abutting a plate fixedly attached to the track in an orientation perpendicular to the hookrod, and the top of the spring pressing up on both sides of the bottom of collar. The front of the collar is attached to the track at a pivoting connection (e.g., a horizontal slit to accommodate the whole front of the collar can be cut into the front of the track at the appropriate position), sufficiently far from the hookrod that the rear end of the collar can readily move up in response to the spring and down in response to force applied by a user on the trigger. (The rear of the collar could extend almost to the inner rear surface of the track, and the track could be a full-length track shaped like upper track 1270.)

Also alternately, instead of a full-length track as depicted, a half-length track could be used, with a lower support running horizontally between the left and right edges of the rear of the hanging item, resulting in an upside-down "T" together with the track. In this case, the collar and trigger could be modified so as to be similar to that found in common ironing boards, inasmuch as the trigger works by rotation of the trigger rod about its axis rather than by displacement of the trigger rod. Thus, with a loop placed at the left or right side edge of the hanging item, the user could apply pressure manually to the loop. As a further variation, whether with a vertical or horizontal lower support, a rotary trigger could be used, foreshortening it greatly so that the loop is almost adjacent to the clamp, and activation would occur upon pressing the hanging item against the wall. Both the vertical track and the perpendicular bottom track could be extruded and cut to various stock lengths, and could have adjustable-lengthed ends or adjustable-lengthed end attachments (similar to the bottom extender described in connection with the embodiment of FIG. 70) in order to allow for various frame sizes.

As another alternative, the remote trigger of embodiments such as FIGS. 42–64, 70–88, and 96–109 can be eliminated in favor of a configuration wherein the activating force is applied directly through the hanging item itself. As shown in FIGS. 93*a* to 95*b*, this can be done by essentially turning the clamp (of, e.g., FIGS. 50–54) upside-down and modifying it by, among other things, integrating the hook into it. In addition to eliminating the remote trigger, the spring bias can be replaced by a simple washer (not shown) extending around hookrod 820*c*, or even eliminated in appropriate circumstances, as gravity urges the ball bearings into the narrow inverted end of the conical inner surface. (In environments where the mechanism will be placed in a substantially non-vertical orientation, e.g., sideways, the one-way locking effect can still be effectively obtained with the addition of a spring or other bias means in the conventional fashion. Also, irrespective of orientation, a spring enhances the rapidity of clamping, although the trigger should be configured to be activated easily enough that the bias does not hamper triggering.)

Figure 93A:
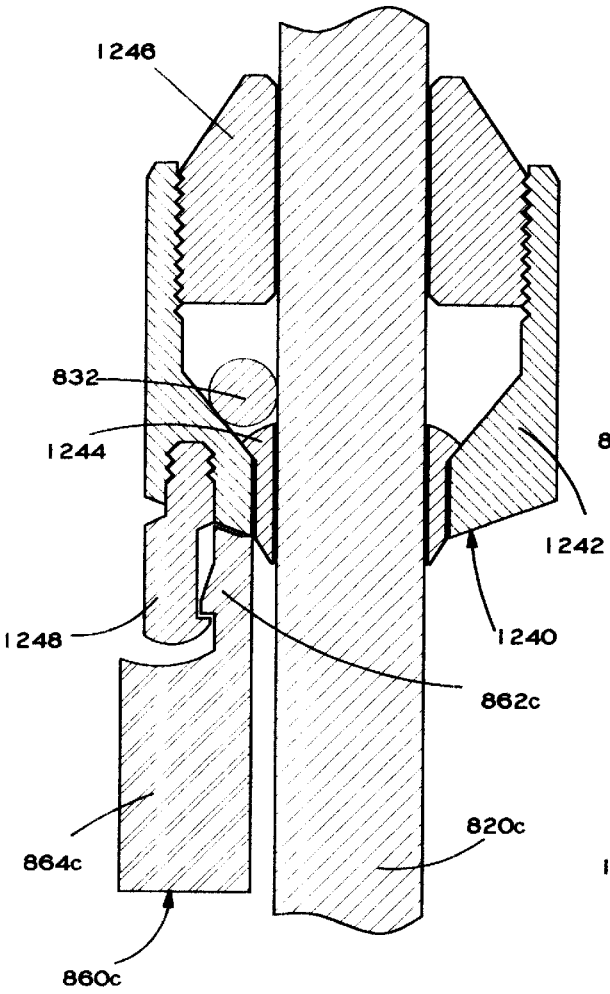
FIG. 93*a* is a side sectional view of a two-way adjustable embodiment wherein vertical adjustability is activated by pressing inward on the hanging item against the wallbar, showing the vertically adjustable integrated hook and clamp locked in place on the vertical rod and seated at rest on the wallbar.
Figure 93B:
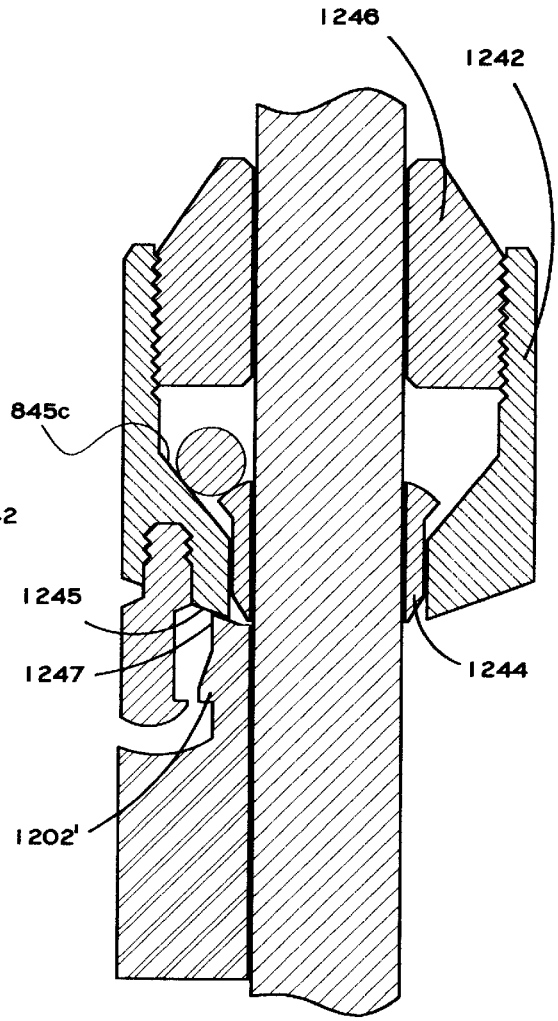
FIG. 93*b* is a side sectional view like that of FIG. 93*a* except with integrated hook and clamp activated for vertical adjustment and thus free to slide up and down with respect to the vertical rod.
Figure 95A:
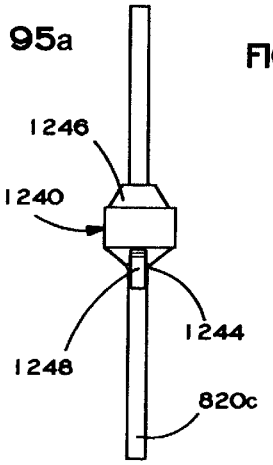
FIG. 95*a* is a front view of the clamp and vertical rod of FIGS. 93*a* and 93*b;*
Figure 95B:
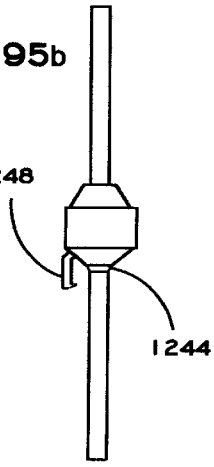
FIG. 95*b* is a side view of the clamp and vertical rod of FIGS. 93*a* and 93*b;*
Figure 96:
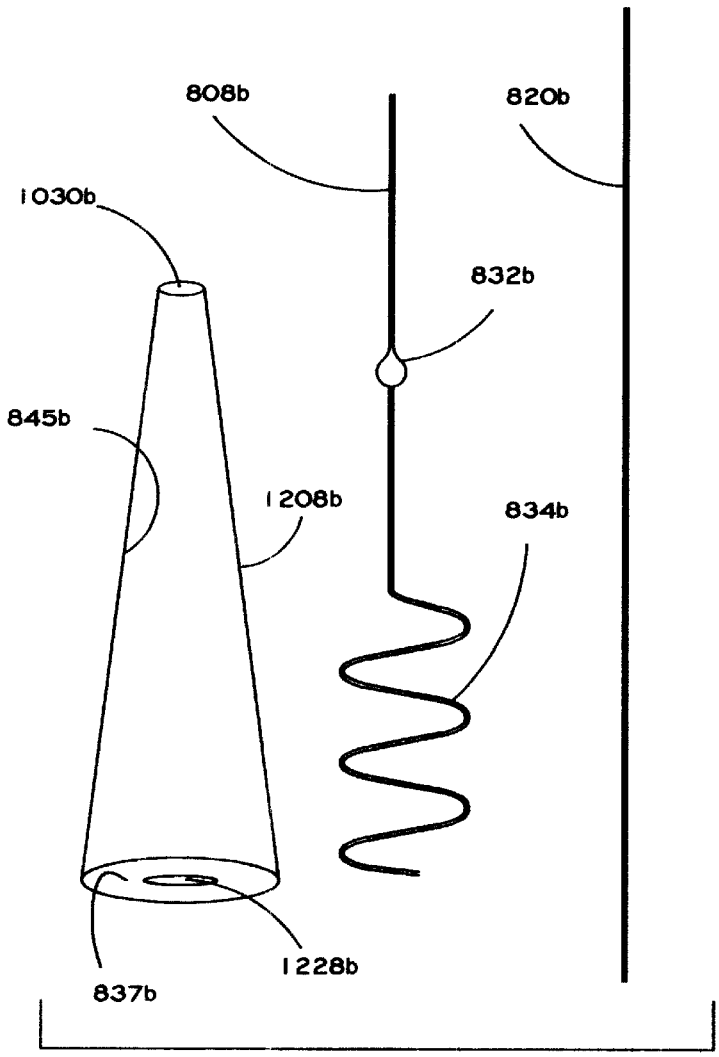
FIG. 96 is a exploded transparent perspective partial view of an embodiment similar to that of FIGS. 42 or 70 but having a single fixed node instead of three ball bearings, and having an integrated trigger rod, node, and spring.
Figure 97:
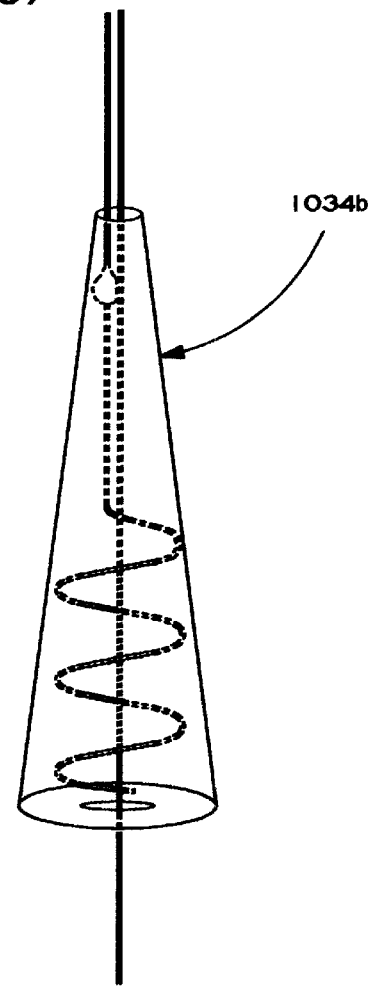
FIG. 97 is a view similar to FIG. 96 but with the various parts placed together inside the clamp body, forming a clamp.
Figure 98:
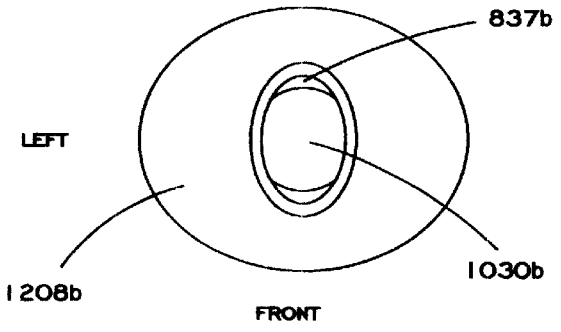
FIG. 98 is a top view of the clamp body of FIGS. 96 and 97.
Figure 99:
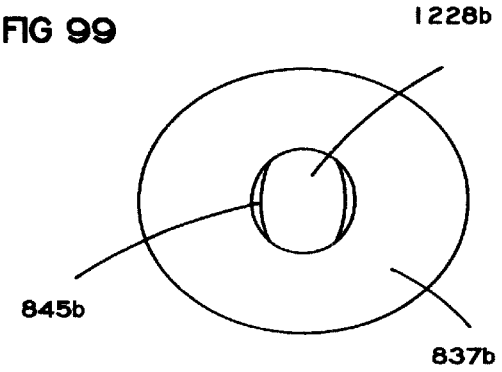
FIG. 99 is a bottom view of the clamp body of FIGS. 96 and 97.

Focusing on FIGS. 93*a* and 93*b*, such an integrated hook and clamp 1240 for use in a vertical orientation is shown in sectional view along with a wallbar 860*c* permitting two-way adjustment. In these Figs., parts 1242 (with the exception of the portion where part 1248 inserts into it), 1244, and 1246 are each radially uniform, and thus appear as two mirror images on either side of hookrod 820*c*, which is circular in cross-section. While only one ball 832 is visible in the illustrations, the depicted embodiment includes three balls, similar to, e.g., the clamps of FIGS. 50–51, but without any cage or detent device. FIGS. 95*a* and 95*b* show the integrated hook and clamp 1240 on the hookrod 820*c* from the front and side, respectively, without the wallbar. In the depicted embodiment, hookrod 820*c* is relatively large in diameter (about four millimeters). Unless alternate rigidity means are used (discussed below), hookrod 820*c* should be stiff over its length, so as to strongly resist bowing (i.e., bending when pressed at its center when its top and bottom ends are held in place). Thus, depending on the height and weight of the item to be hung, hookrod 820*c* is preferably about two to five millimeters or more in diameter, and made of a metal with high bending resistance such as a high-strength stainless or cold-rolled steel. Hookrod 820*c* is connected at its top and bottom ends (not shown), using conventional or other means taught herein, to the top and bottom of the rear of the frame or other hanging item, along the item's center of weight line. As an example, the hookrod's ends can be stamped flat and then punched or machined with an screweye for direct attachment to the item using a screw or nail.

Figure 87:
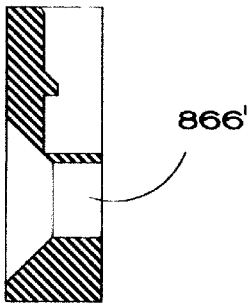
FIG. 87 is a sectional view taken through line C—C of the wallbar of FIG. 86.
Figure 88:
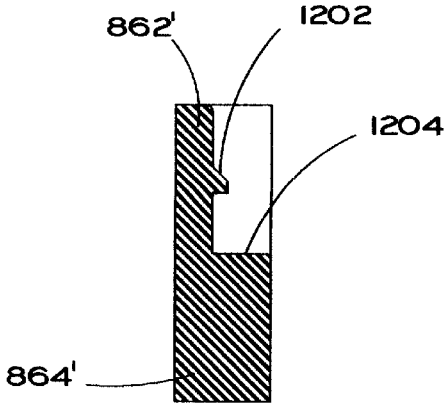
FIG. 88 is a sectional view taken through line B—B of the wallbar of FIG. 86.

In FIG. 93*a,* hook and clamp 1240 is seated at rest on wallbar 860*c* (which is similar to the wallbar of FIGS. 86–88). The rear face of rib 864*c* is flushly positioned against the wall (not shown) or other substantially flat and vertical surface (as the wallbar is nailed or screwed to the wall), and thus there is a small gap (about a half millimeter or so) between the hook prong 1248 and the wall (not shown) when the hanging item is at rest. That this position is reached at rest is ensured by the fact that the bottom surface 1245 of clamp body 1242 has a slight angle that matches the slight angle of the top portion 1247 of wallbar supporting wall 862*c*. The force of gravity acting on the hanging item pulls the integrated hook and clamp (which, as discussed below, is locked against upward movement relative to the hookrod, which is in turn fixedly attached to the hanging item) downwardly, and as bottom surface 1245 hits top portion 1247 and continues to move downwardly, hook and clamp 1240 is forced away from the wall due to the angle of bottom surface 1245 and top portion 1247. Hook prong 1248 has a barb at its bottom tip, which catches under ridge 1202' of wallbar 860*c,* similarly to, e.g., the barb and catch shown in FIG. 78.

At rest, no part of top portion 1247 of hook and clamp 1240 is in contact with cylindrical trigger 1244. Consequently, at rest, gravity urges cylindrical trigger 1244 downwardly until its outwardly flared top portion hits the narrow bottom of inner conical surface 845*c*. At rest, the top of trigger 1244 is thus low enough that balls 832 cannot reach it, as they are first obstructed by hookrod 820*c* and conical inner surface 845*c*. Thus, at rest, gravity urges balls 832 downward to the position depicted in FIG. 93*a,* and exerts a substantial downward force on hookrod 820*c*. Since wallbar 860*c* is providing upward support for clamp body 1242 and thus conical inner surface 845*c,* balls 832 become jammed between the central, downwardly pulled hookrod 820*c,* and the surrounding upwardly supported inner conical surface 845*c*. This jamming effect can be modified for a more secure hold by making part or all of conical inner surface 845*c* steeper, i.e., closer to parallel with hookrod 820*c* (this requires a concomitant increase in the height of cylindrical trigger 1244). As with the other ball and cage embodiments, this mechanism is one-way, and does not lock against upward adjustment of the item. Optionally, to further urge balls 832 downward and thus increase their tendency to lock in place, an annular piece of light foam rubber may be placed in the space above the top of balls 832 and below the annular bottom surface of top plug 1246. Alternately, that space could be heightened, and a weak coil spring placed therein. If this or any one-way embodiment disclosed herein is modified for use in a substantially non-vertical orientation (i.e., one in which gravity does not adequately assist locking), a bias of some sort is required, and the configuration should be chosen or modified such that gravity cannot cause unintended activation.

As shown, top plug 1246 is generally cylindrical although its upper surface may be sloped. The bottom exterior of top plug 1246 is male-threaded, corresponding to the female threads on the upper interior of clamp body 1242. Top plug 1246 preferably has some weight (to provide quicker impetus for downward sliding of the hook and clamp 1240 when activated/unlocked). Top plug 1246 also has some height (e.g., one centimeter) to improve the coaxial alignment of hook and clamp 1240 on hookrod 820*c,* even when hook and clamp 1240 is asymmetrically loaded (which occurs when its front side is resting on wallbar 860*c*). The inner surface of top plug 1246 that contacts hookrod 820*c* is also preferably of a material chosen for a low coefficient of sliding friction with the surface of hookrod 820*c*. Likewise, cylindrical trigger 1244 is preferably of a material chosen for a low coefficient of sliding friction with the surface of hookrod 820*c* and with the adjacent surface of clamp body 1242.

Moving to FIG. 93*b,* a sectional view similar to that of FIG. 93*a* is shown. In this Fig., a user is pressing inwardly on the hanging item, forcing hookrod 820*c* towards the wall (left in the Fig.). As this happens, the leading edge (the right edge of the wallbar in the Fig.) of top portion 1247 of wallbar 860*c,* which has a 90° angle, strikes the inclined or sloped bottom surface of cylindrical trigger 1244. The materials of the leading edge of wallbar 860*c* and the sloped bottom surface of cylindrical trigger 1244 should be chosen to have a low coefficient of sliding friction with each other. Since the sloped bottom of cylindrical trigger 1244 is cylindrical, and the leading edge of wallbar 860*c* is linear, there will be a single point of contact between the two, which should increase the tendency for the two to slide against each other rather than becoming caught on each other. As hookrod 820*c* continues further toward the wall and ultimately to the position shown in FIG. 93*b,* the leading edge of wallbar 860*c* drives cylindrical trigger 1244 upwardly due to its sloped bottom surface. The upward movement of cylindrical trigger 1244 in turn forces balls 832 out of jamming between hookrod 820*c* and conical inner surface 845*c,* freeing hookrod 820*c* to be slid up or down through hook and clamp 1240 until the user releases inward pressure on the hanging item and rests it on wallbar 860*c* again as shown in FIG. 93*a*. A light outward pull on the item just prior to seating may facilitate locking.

Figure 94:
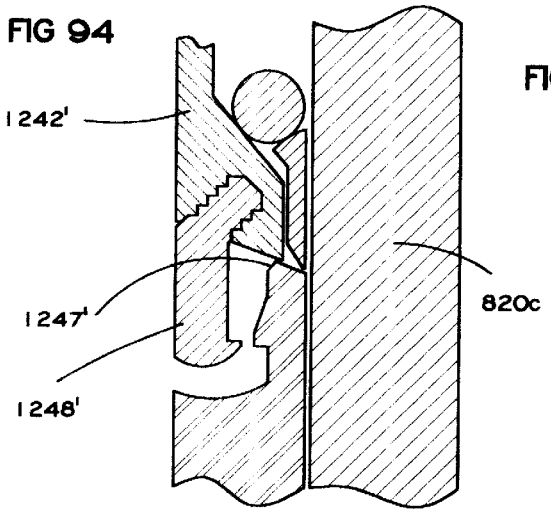
FIG. 94 is a partial sectional view similar to FIG. 93*b,* but showing an alternate hook prong in the clamp.

Note that hook prong 1248 has a cylindrical portion that inserts into a corresponding cylindrical cavity in clamp body 1242. The cylindrical portion of hook prong 1248 has a threaded end which matches female threading on the inside of the clamp body's corresponding cavity. The external portion of hook prong 1248 is offset from the cylindrical internal portion of hook prong 1248, and can be approximately cylindrical or prism-shaped, terminating with a barb at its end, which barb should have enough length (measuring right to left looking at it from the front so that it will not lose functionality if the prong rotates on its threads a slight amount one way or the other). As shown in FIG. 94, instead of the internal and external portions being offset and parallel, an alternate hook prong 1248' can have internal and external portions that are joined at an angle, with the corresponding cavity in clamp body 1242' being appropriately angled and threaded.

Preferably and as shown in FIGS. 93*a* and 93*b,* the respective configuration of top portion 1247, bottom surface 1245, ridge 1202', and hook prong 1248's barb is such that activation is "foolproof" in the sense that the hook prong 1248's barb cannot escape ridge 1202' without wallbar 860*c*'s leading edge striking cylindrical trigger 1244 sufficiently to activate vertical downward adjustability. Further, the weight of hook and clamp 1240 is preferably sufficient that once vertical downward adjustability is activated, it will fall quickly if the hanging item is pushed upwardly, aiding the barb and catch in maintaining bottom surface 1245 nearly adjacent to the top portion 1247 of wallbar 860*c*. Additionally, as shown, hook and clamp 1240 can extend just far enough out so that when hookrod 820*c* is pressed against wallbar 860*c*, the edge of hook and clamp 1240 will make light contact with the wall and thereby be frictionally held at the same level as wallbar 860*c* while the item is adjusted up or down. To increase this means of holding, the surface of clamp body 1242 facing the wall can be made flat (not shown) and chosen to have a high coefficient of sliding friction. Additionally, and/or alternately, to make both activation and deactivation more foolproof, ridge 1202' and hook prong 1248's barb can be extended far enough so that in FIG. 93*b* they would still be in contact. This, however, would require wallbar 860*c* and/or hook prong 1248 to be thicker to accommodate the added play, and may make the selection of a more flexible hook prong 1248 and barb preferable. To further enhance this particular means of foolproofing activation and adjustment, the wall-facing portion of the bottom of hook prong 1248 could be enlarged (not shown) further toward the wall than the rest of hook and clamp 1240, and the external portion (but not the offset connection portion which may bear some of the weight of the hanging item) of hook prong 1248 made flexible so that even when the hook and clamp 1240 are pushed inward to the wall, the barb of hook prong 1248 stays engaged under ridge 1202'. In this case, the extended bottom wall-facing portion of hook prong 1248 should be of a material that will not scratch, mar, or "write" on the wall since during seating of the item on the wallbar, it will forcefully impinge on the wall as the barb slides over and engages under the wallbar's ridge. To further enhance rapid activation, cylindrical trigger 1244 should have a low coefficient of sliding friction, and to enhance rapid clamping upon deactivation, the cylindrical trigger should be of a dense material. Consequently, a suitable material would be a high chromium content stainless steel with silicon (molybdenum, manganese, and/or magnesium may also be preferable additives).

For hanging items of any substantial weight, it is preferable to place a simple stopper device at or somewhere below the halfway point of hookrod 820*c*, so that hook and clamp 1240 cannot be adjusted so far down on the hookrod that the hanging item would be supported from too close to its bottom. As explained elsewhere herein, this can cause an undue amount of torque on the hanging item and its attachment to the wallbar.

In use, hook and clamp 1240 is placed on hookrod 820*c*, the hookrod is attached in a vertical orientation to the top and bottom of the rear of the item, and the hook and clamp is manually slid up to the top of the hookrod. Then the hanging item (preferably with bumpers attached at the two bottom or all four corners) is slid down the wall above the wallbar until the hook prong gets behind the wallbar and the bottom surface of the clamp body hits the top portion of the wallbar, forcing the hanging item just slightly away from the wall (as shown in FIG. 93*a*) as soon as the item is released. If means are used to keep the hook prong's barb constantly engaged with the wallbar's ridge, then a notch should be made in the left or right end of the wallbar's ridge so that the hanging item can be disengaged and taken off the wall generally as described with respect to FIG. 86.

It should be noted that while the embodiment depicted in FIGS. 93–95 is generally radial (with the hookrod having a circular cross-section, and the clamp body and trigger being generally cylindrical), many variations are readily apparent. For example, an otherwise circular clamp could be made eccentric with its axis pushed toward the rear of the hook and clamp to conserve space. Or, to increase rigidity of the hookrod (and thus decrease the likelihood that it might bow too far inward under pressure to permit activation), the hookrod could have a square cross-section, and four or two balls could be used, with the clamp generally being square (if four balls) or rectangular (if two balls) as viewed from the top. On the other hand, in this type of embodiment, the diameters of the clamp body, balls, cylindrical trigger, and the configuration of the top portion of the wallbar, hook prong, and bottom surface of the clamp, are dictated more by the diameter of hookrod that is chosen (and also to a minor degree by the hardness of the clamp body, balls, and hookrod), than is the case with the embodiments of, e.g., FIGS. 42 and 70, wherein the hookrod size can be more easily varied alone.

Instead of using a highly rigid hookrod, the rear of the hanging item could (although less preferably) itself be used to directly push the clamp toward the wall for activation. This would require that the rear of the hanging item be fairly strong from top to bottom (e.g., a strong backing), and not delicate or easily damaged. The rear of the item would in this case need to also have a fairly low coefficient of sliding friction with the material of the clamp body 1242, as in order to adjust the hanging item vertically, the clamp would need to slide along the rear of the item under some pressure.

As another alternate to making the hookrod highly stiff, an alternate rigidity means can be used, and the hookrod's diameter can be reduced (e.g., to one to three millimeters). Such an alternate rigidity means could entail, for example, a track in the form of a "U" shaped vertical channel with its top and bottom ends closed off with endcaps. Such a track could be attached to the item with its flat rear side placed against the rear of the item. The hookrod would be surrounded by the track, parallel with it, and the top and bottom of the hookrod would be tautly attached between the corresponding endcaps of the track (in fact, less preferably, a flexible cable could be used rather than a rigid rod). The hookrod would be connected so that its front surface lies at least marginally above (e.g., a half millimeter or so) that of the front of the track. The track's side members would extend just far enough so that when the hook and clamp is placed on the hookrod, its rear surface would be nearly adjacent to the inside rear surface of the track. The hookrod should be at least rigid and/or taut enough, however, so that pressing inward on the hook and clamp enough to cause activation would not cause the rear of the hook and clamp to impinge against the inside rear surface of the track enough to substantially reduce the ability of the hook and clamp to be slid vertically up or down in the track. To aid this, the rear surface of the hook and clamp could be rounded from top to bottom, and both it and the inside rear surface of the track could be of materials selected for a low coefficient of sliding friction. The track's side members should be strong enough to provide good ribbing against bowing. The rear side of the track need not be too thick, and in a suitable metal it could be well less than a millimeter.

Alternately still, instead of having a hookrod enclosed by a "U " shaped channel, analogous parts can be integrated into a single track. In this regard, Disclosure Document No. 463,928, entitled "Disclosure Document, " and filed by this Applicant with the Patent Office on Oct. 20, 1999, is incorporated by reference as if set forth in full herein (except to the extent that anything in that disclosure is inconsistent with the text and/or drawings expressly set forth herein). An example of such an embodiment that has been found to work very well is shown in FIGS. 110–115.

Figure 111:
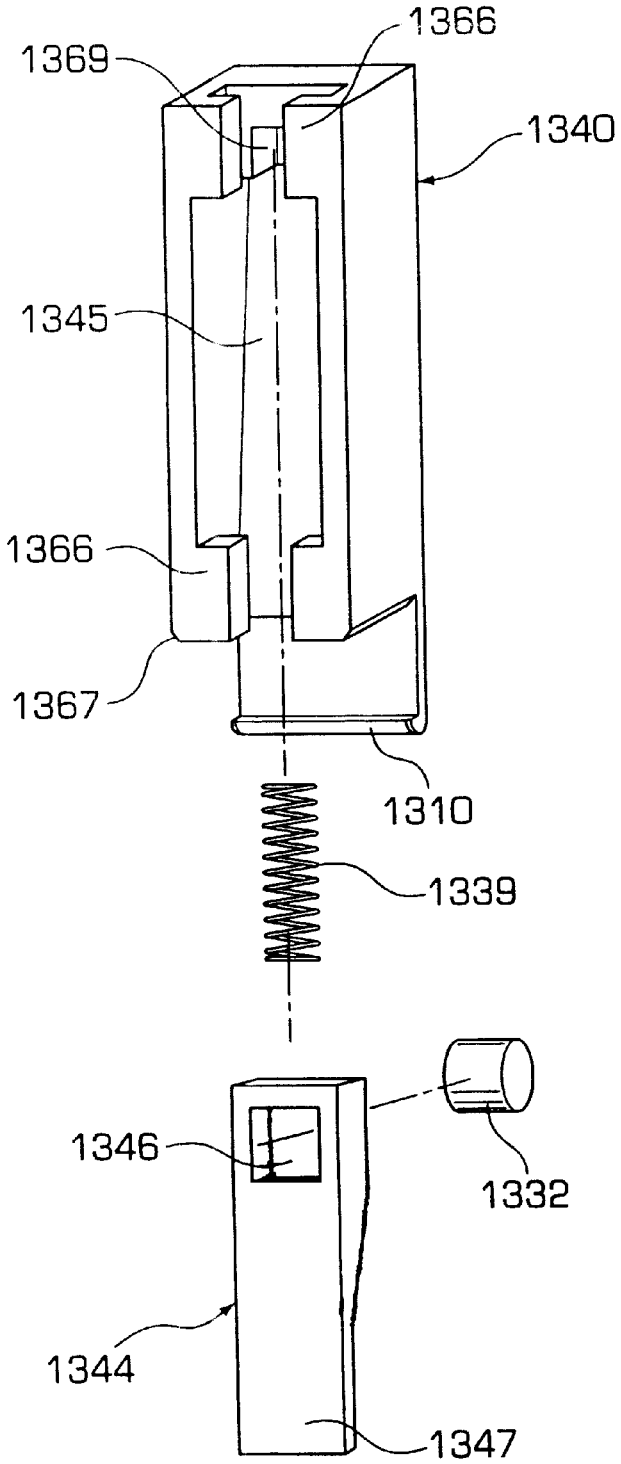

As shown in FIGS. 110 and 111, this embodiment includes a trigger 1344 enclosed inside a hook/clamp 1340, which slides along a track 1312. One-way locking is provided by the interaction of roller 1332, spring 1339, trigger 1344, inclined surface 1345, and the opposing "T" section (see FIG. 115) of track 1312. FIG. 115 shows the cross-section of track 1312, and the mating shape of hook/clamp 1340 and its feet 1366 (trigger 1344 is omitted from FIG. 115 for clarity), which wrap partly around "T" section 1377. "T" section 1377 is thus analogous to hookrod 820*c* of the previous embodiment, but as shown in FIGS. 111 and 115, it is an integral part of track 1312 all along its length (rather than just being connected to its top and bottom), and trigger 1344 does not wrap around it.

Figure 114:
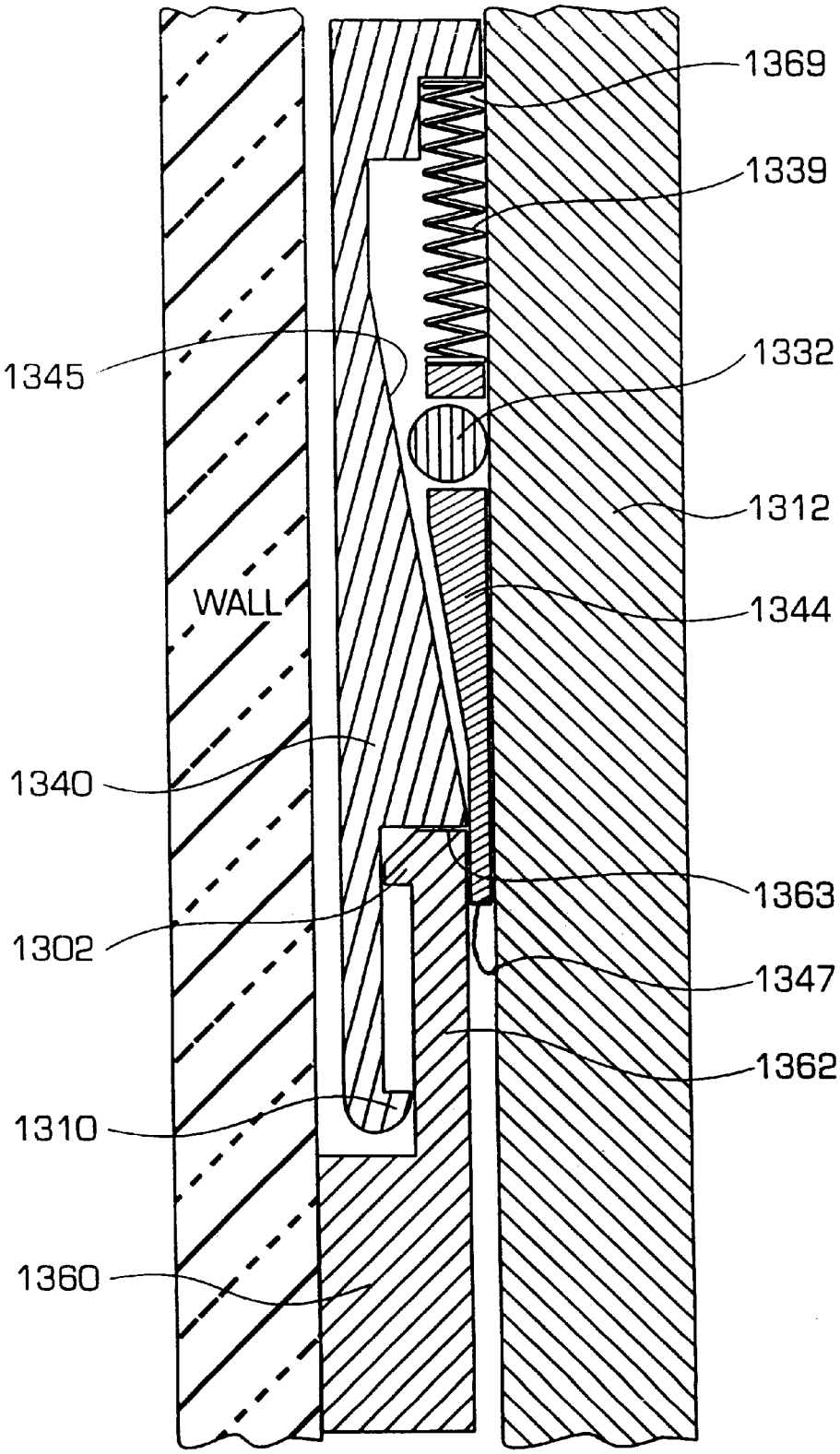

Further, as apparent from the side sectional view of FIG. 114, activation of this embodiment is slightly different than in the embodiment of FIGS. 93–95. Specifically, hook/clamp 1340 is activated for downward vertical adjustment by pulling upward a few millimeters on the hanging item, firmly pressing inwardly on the hanging item against the wallbar 1360 (mounted on the wall), and then allowing the item to slide downwards. (Depending on factors such as the frictional coefficients of the materials chosen and the length of the bottom tip 1347 of trigger 1344, the first step of pulling upward sometimes proves unnecessary, as simply pressing inwardly against the wallbar 1360 may cause bottom tip 1347 to pop upward). The aforementioned motions cause the top edge 1363 of wallbar 1360 to be positioned beneath the bottom tip 1347 of trigger 1344, and then to hit and urge it upwardly. This in turn pushes roller 1332 to a wider, non-clamping position along inclined surface 1345, unlocking the one-way lock of hook/clamp 1340 from track 1312 so as to permit downward adjustment of the hanging item. As soon as the user pulls outwardly at all, the bottom tip 1347 of trigger 1344 slides off the top edge 1363 of wallbar 1360, and is urged back downwardly by spring 1339 such that roller 1332 (which is retained in window 1346) quickly reaches a narrower, clamping position along inclined surface 1345. For upward adjustment, the user simply pulls lightly out on the hanging item before pulling it up to a desired position. This ensures that barb 1310 of hook/clamp 1340 catches on catch 1302 of wallbar 1360, so that hook/clamp 1340 can be pulled downwardly along track 1312 by catch 1302. The lengths of bottom tip 1347, wall 1362 of wallbar 1360, and of the hook, can be adjusted to vary the characteristics of these locking and adjustment processes. Also, a cutout portion 1369 may be provided in the top of hook/clamp to help seat and provide extra room for the top of spring 1339. Also, hook/clamp 1340 is preferably die cast from zinc or another hard metal, with beveled edges 1367 to reduce chafing of the wallbar, and its face toward the wall is preferably coated with a plastic or other non-marking substance.

As shown in FIG. 110, the wallbar 1360 of this embodiment can include strips of double-sided tape 1368 with a peel-off covering, and the strips can be partially embedded in recessions (not visible) in the rear of the wallbar. The wallbar can also include downward and upward projections 1365 and 1364 respectively, to brace the wallbar against torqued rotation on the wall. Further, nailholes 1372 can have a downward angle to increase holding of nails 1307 in the wall. In use, the user finds a general desired area for mounting an item, removes the peel-off covering from tape 1368, and presses wallbar 1360 horizontally on the generally desired mounting area of the wall. Then, nails 1307 are pressed or hammered in place. Wallbar 1360 is preferably molded of high-strength plastic.

Figure 112:
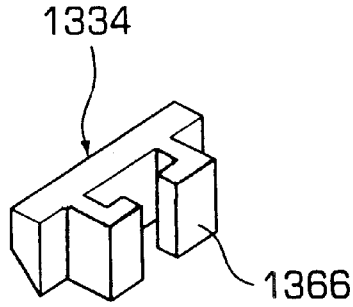
Figure 113:
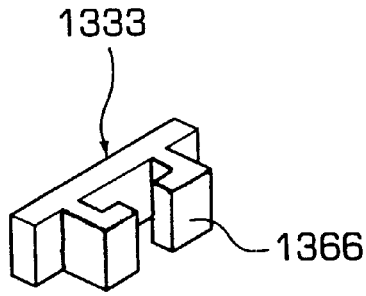

The downward progress of the clamp is preferably terminated at a selected lowest position, preferably about one-third to one-half of the way away from the bottom of the item, depending primarily on how heavy the item is and how strong the track is. As shown in FIGS. 110, 112, and 113, termination at the selected lowest position can be ensured by gluing in place a bottom stopper 1334, preferably made of plastic and preferably having a sloped bottom edge to prevent undesired or inadvertent catching on the wallbar. As a safeguard against the hook/clamp becoming locked in place when manually slid down to stopper 1334 (while the item is off the wall), a safety slider 1333 can also be provided above stopper 1334. Thus, if hook/clamp 1340 is manually slid too low, slider 1333 can be grasped and pulled upwardly until it hits bottom tip 1347 of trigger 1344, permitting hook/clamp 1340 to slide upwardly.

Track 1312 can be extruded, and machined with slots 1314 to provide some leeway for attaching the track to the item in a centered fashion. Also, a bottom extender as described above regarding the embodiment of FIG. 70 can be used to attain non-standard lengths. As shown in FIGS. 115*a* and 115*c*, further variations of the embodiment of FIG. 115 can be made by using two balls 1332*a* instead of cylindrical roller 1332. In this case, more rigidity against bowing is provided by the "T" section 1377*a*, so the ribs 1313 might be omitted. The track could also be modified as shown in FIGS. 115*a, b,* or *c,* and many other track configurations can be devised to modify the ratio of rigidity versus material weight while varying the triggering, reclamping, and other hanging performance characteristics.

In fact, an embodiment can be made in which the "T" section is omitted altogether, permitting the majority of the hook/clamp and its parts to be recessed within the track. Such an embodiment is shown in FIGS. 116–119. Similar to the previous embodiment, a trigger 1344*a* (see FIG. 118) or 1344*b* (see FIG. 120) is enclosed within a hook/clamp 1340*a* (see FIG. 119), which slides along track 1312*a*. Also similarly, one-way locking is provided by the interaction of a roller 1332 (or 1332*a*, see FIG. 120), spring 1339*a*, trigger 1344*a*, inclined surface 1345*a*, and the opposing face of track 1312*a*. In this case, however, instead of the "T" section of the track being used for a clamping surface, the rear inside face of the track is used. And, instead of inwardly opposing feet mating with a "T" section, as shown in FIGS. 117 and 119, hook/clamp 1340*a* is provided with feet 1366*a* that project outwardly and fit inside the "L" ribs 1313*a* of track 1312*a*.

Further, downward vertical adjustment is activated slightly differently. Specifically, the hanging item is lightly pulled outward, then upward a few millimeters, then firmly inward against wallbar 1360. While maintaining the inward pressure, the hanging item can be adjusted downwardly. The aforementioned motions cause protruding face 1357 of trigger 1344*a* to be frictionally pulled upward by direct contact with the opposing face of the wallbar. (Protruding face 1357 may preferably be scored or horizontally grooved, or applied with a high friction surface, perhaps biased downwardly, to assist in frictional holding against the wallbar; the trigger's opposite side, facing the track, may conversely be selected for a low frictional coefficient to aid sliding against the track). When the trigger is pulled upward, it pulls roller (which is held within window 1346*a*, as shown in FIG. 118, or alternately is pulled upward by flared bottom portion 1349, as shown in FIG. 120) out of the narrower clamping region of the inclined surface 1345*a*, undoing the one-way lock against downward adjustment. Once the picture is moved downward to the desired position, the user releases inward pressure on the hanging item, and pulls outward very lightly, allowing the trigger and roller to be urged back into clamping position by spring 1339*a*. For upward adjustment, the user pulls outward slightly and then upward on the item, causing barb 1310*a* to catch on catch 1302*a*.

To attain the most optimal profile of locking, activation, and other characteristics for a particular application, the specific dimensional configuration (which is shown in a suggested preferred relative scale in FIGS. 116 and 117) of the position of face 1357, lip 1348, and barb 1310*a,* and the height of window 1341, wall 1362*a,* and width of wall 1362*a* and hook/clamp 1340*a,* can be fine tuned somewhat. However, protruding face 1357 of trigger 1344*a* must be configured to always (i.e., even when it is pressed as far into the track as leeway permits) protrude slightly out, e.g., 0.4 mm or so, from the track through the window 1341 in hook/clamp 1340*a*). Further, window 1341 should be high enough to permit adequate up/down play for trigger 1344*a,* e.g., a few millimeters, for locking and unlocking. Moreover, there should be enough inward/outward free play between the wallbar and the hook portion of the hook/clamp so that the protruding face 1357 can be pulled out of contact with wallbar 1360 by pulling lightly out on the hanging item. Otherwise, the last movement of the downward adjustment sequence would be ineffective, and the hanging item would drop all the way down. On the other hand, play between the trigger and the inside of the track (and the weight of the hook/clamp), should not be too large or else the hook/clamp may immediately fall downward onto the wallbar as soon as the hanging item is moved slightly upwardly. Otherwise, the first movement of the downward adjustment activation sequence would be ineffective, because protruding face 1357 would never be raised high up enough relative to the opposing face of wallbar 1360 to permit trigger 1344*a* to be frictionally pushed up high enough in window 1341 to permit roller 1332 to unlock before the top of wallbar 1360 hit the opposing top inside face of hook/clamp 1340*a*. Inward/outward play between the parts within the track should also not be too large as this can (among other things) cause the trigger and roller to perform unsatisfactorily. On the other hand, some allowance should be made to permit the parts to roll across surface imperfections and the like, and to ensure clamping and activation can occur even though some minute degree of bending of feet 1366a and/or "L" ribs 1313*a* may occur under load. For example, taking into account the possible variations due to surface imperfections, anticipated bending, etc., the lowest position of trigger 1344*a* permitted by roller 1332 should always be above where trigger 1344*a* would forcefully hit lip 1348, or else clamping cannot be ensured by spring 1339*a*. It is preferable, however, to address such issues more so by selection appropriate stiff and hard materials, and/or providing thicker cross-sections and a smaller distance of separation between feet 1366*a,* as opposed to increasing inward/outward play. In contrast, rotational play, i.e., in a plane parallel to that of the wall, is generally preferable (as long as not excessive) as it can enhance self-leveling of the hanging item.

In light of the foregoing disclosure, one of ordinary skill in the art should recognize as obvious many alternate means of activating a trigger in an integrated hook/clamp. As one of many examples, as shown in FIG. 121, a trigger 1444 can be provided with a projection 1447 protruding out through a window formed in the side of the hook/clamp (not shown). In such a version, rotating the hanging item the proper direction (counterclockwise) will cause the projection to strike the top of the wallbar 1460, forcing the trigger upwardly and unlocking the ball 1432 (which is within bore 1446).

Further, a variation can be conceived in which the hook and trigger are also integrated. For example, as shown in FIG. 122, a hook/trigger 1509 can be connected to a clamp body 1544 at a pivot point 1553. Thus, by pressing inward on the item, hook 1509 will contact the wall, and then be forced by the wall to rotate on its fulcrum, thereby causing the trigger end 1511 (which is incorrectly shown in the drawing as impinging into the ball) to rotate upwardly, unlocking ball 1532. Upward adjustment would be permitted by catching barb 1510 on catch 1502.

Figure 65:
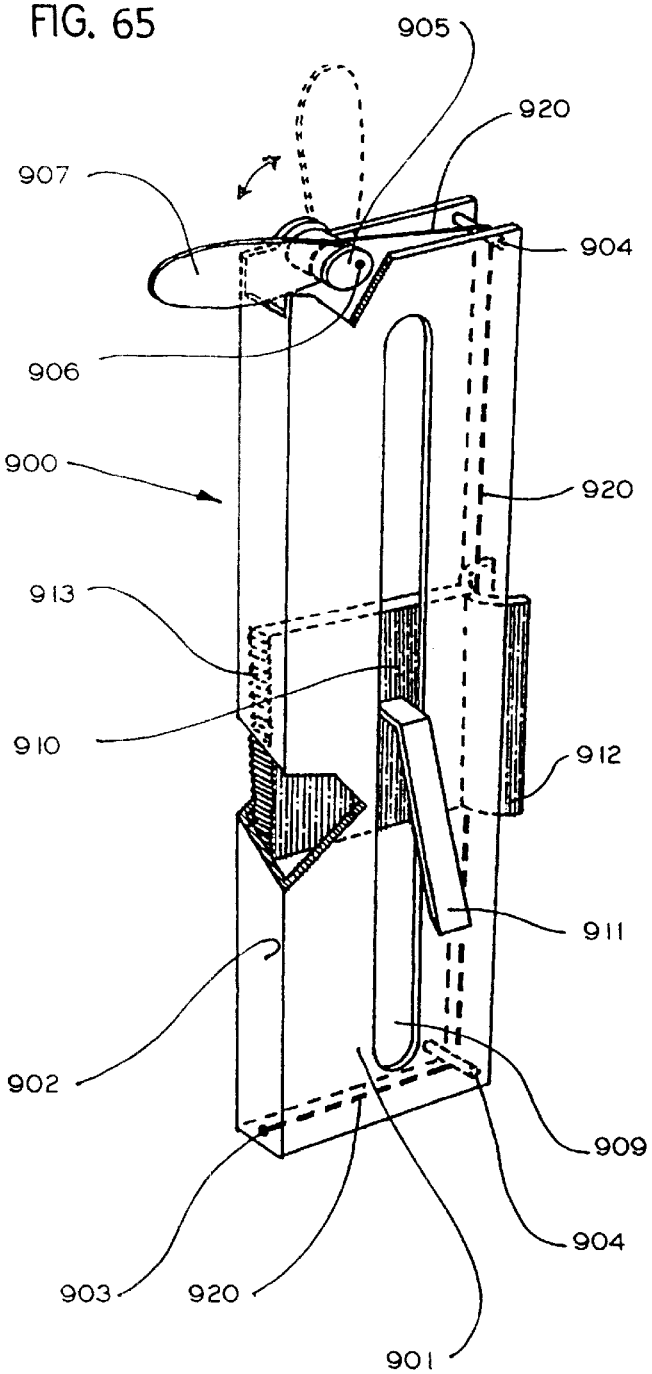
FIG. 65 is a cutaway transparent perspective view of a two-way adjustable embodiment, showing how the vertical adjustability is activated and deactivated by a finger lock.
Figure 66:
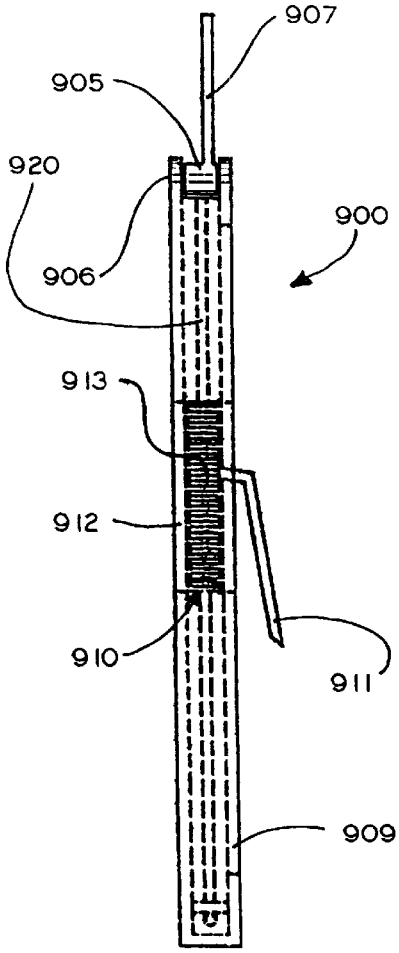
FIG. 66 is a side transparent view of the embodiment shown in FIG. 65.

FIGS. 65–66 illustrate a taut cable and finger locking embodiment 900. This embodiment includes a vertical locking box 901 which is generally prism-shaped with a thin cross-section (shown from the left in FIG. 66) and is attached (attachment not shown) to the rear of an item to be hung (not shown), and includes a vertically adjustable hook 911 which points downwardly and mounts on a wallbar. Box 901 has a closed top and bottom and four sides; the side shown on the left in FIG. 65 is closed, while the opposite side (right) has an opening running down most of its length. The side of box 901 which faces the wall (shown in the front in FIG. 65) has a slot 909 running vertically down its center for most of its length. Hook plate 910 slides vertically along the hollow interior of box 901 with attached hook 911 projecting through slot 909.

The interior of box 901 that is shown on the left side of FIG. 65 includes a brake pad 902 which opposes brake teeth 913 of hook plate 910. Hook plate 910 includes on its other side cable catch channel 912, which slidingly projects through the vertical opening on that side of box 901. Box 901 also includes at its bottom end a fixed cable attachment point 903 and cable guide 904. At its top end box 901 has another cable guide 904 and an axle 906 which is connected to, but free to revolve within its connection to, box 901. Axle 906 is fixedly attached to cable wheel 905 which in turn is fixedly connected to manual locking lever 907. Cable 920 is attached to an appropriate point on the outer diameter of wheel 905 and runs around the top side to the right side to the bottom end of box 901, passing over guides 904 and cable catch channel 912, and terminating at fixed attachment point 903 to which it is attached. When lever 907 is rotated to its counterclockwise position shown in FIG. 65, cable 920 cinches in against cable catch channel 912 (which can be coated with rubber to increase gripping), forcing hook plate 910 to the left which causes brake teeth 913 to impinge upon brake pad 902, fixing hook plate 910 in its vertical position, along with hook 911. When lever 907 is rotated somewhat clockwise as viewed in FIG. 65 to its other position (shown in phantom), cable 920 is loosened from channel 912, allowing hook 911 (and consequently plate 910) to slide up or down through slot 909 as desired. Wheel 905 may be oblong and its surrounding surface (not shown) on box 901 may be formed so that wheel 905 and lever 907 have two desired positions which require some amount of force to "get over the hump" and move between. Lever 907 may be placed as far as possible towards the wall-facing part of wheel 905, to allow box 901 to be placed further inwardly on the reverse side of the item to be hung without lever 907 hitting the item. Lever 907 can be sized such that is easily reachable, but just out of view behind the outer extent of the edge of the item to be hung when lever 907 is in its locked position (shown in solid in FIG. 65). Additionally, or alternatively, the connection between lever 907 and wheel 905 may be detachable, so that lever 907 can be removed from assembly 900 after adjustment, stored, and reconnected if further adjustment is desired. Also, channel 912 may have a cable guard (not shown) which closes the opening of channel 912 thereby preventing cable 920 from falling out.

Figure 67:
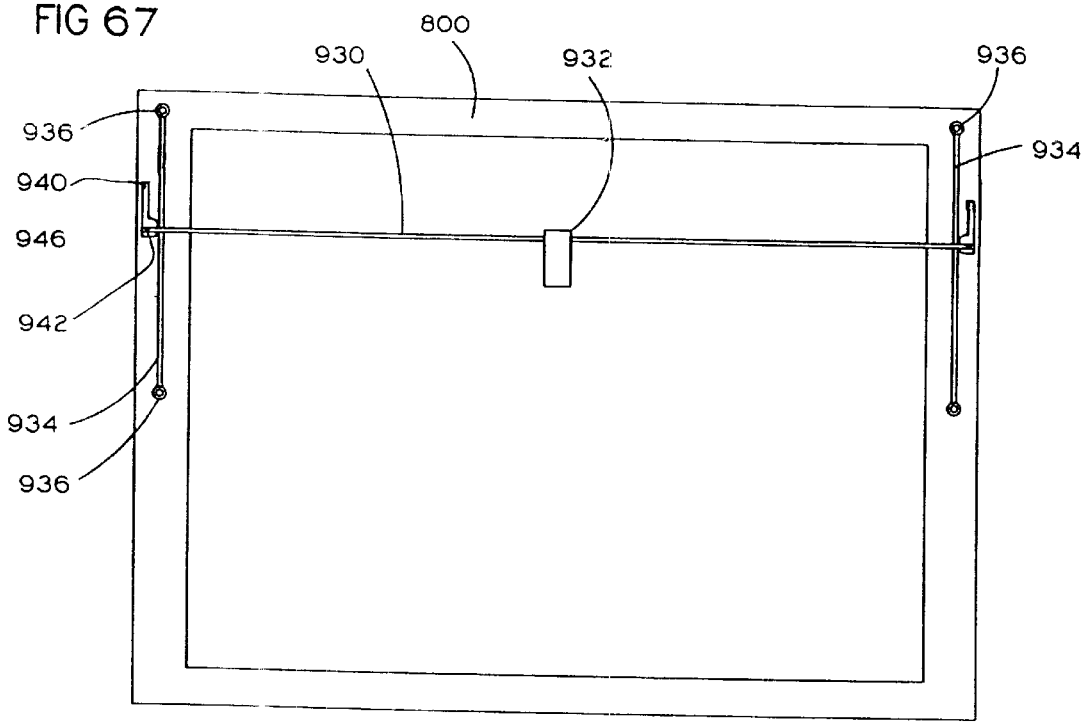
FIG. 67 is a front view of a two-way adjustable embodiment, showing how the vertical adjustability is activated and deactivated by dual finger locks at the edges of the frame.
Figure 67B:
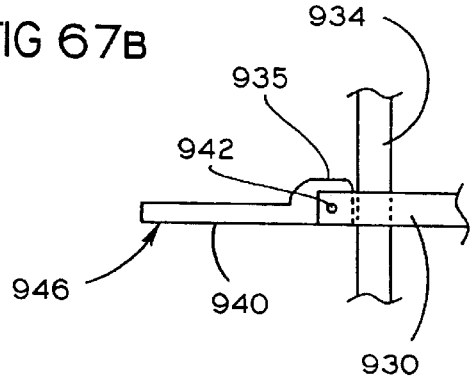
FIGS. 67B and 67C are a sequence of partial front transparent views, showing how the finger lock of FIGS. 67 and 67A is locked.
Figure 67A:
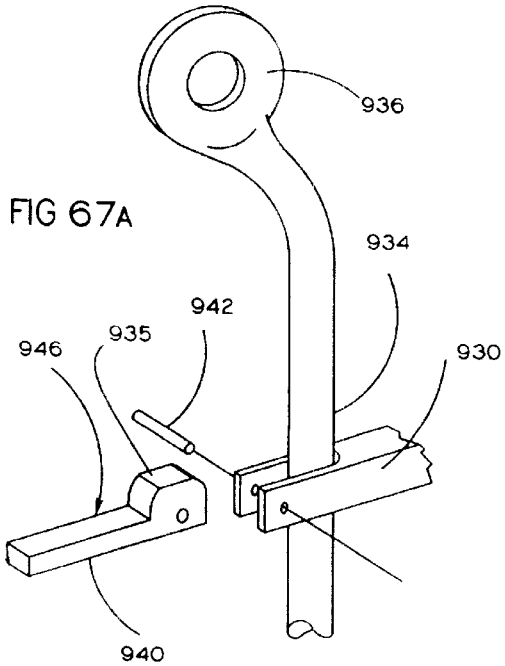
FIG. 67A is a partial exploded perspective close-up view of the finger lock of FIG. 67.
Figure 67C:
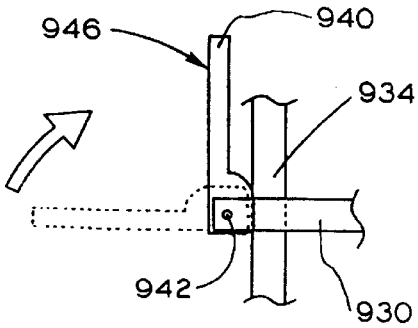

As shown in FIGS. 67–67C, another embodiment utilizes a locking crossbar 930 (or alternately a cable, not shown), wherein vertical adjustability is activated and deactivated by one or more finger locks 946 at the edge of frame 800. Similar to the embodiment of FIGS. 65–66, finger locks 946 can (as shown) rely on a cam mechanism, with levers 940 being placed near the edge of frame 800 allowing the user to conveniently unlock locks 946. Locking is the result of the flat cam surface 935 being forced against rod 934 when lever 940 is upwardly rotated on axle 942 (which is encouraged by the downward force of the hanging item). Cam surface may optionally have ridges or other friction enhancing means on it, in order to increase the locking effect under weight of the item, and prevent sliding. Crossbar 930 is free to slide up and down along rods 934 when locks 946 are unlocked (because axle 942 is positioned farther away from cam surface 935 than the surface of finger lock 946 that is adjacent to rod 934 when it is in the unlocked position as shown in FIG. 67B), but is secured to them at any desired vertical level where locks 946 are locked. In order to accommodate crossbar 930, rods 934 are spaced slightly away from the rear of frame 800, with a concomitant slight bend placed in rods 934 where they connect to screweyes 936. At the center of crossbar 930 is affixed downward pointing hook 932 for seating on a wallbar. An alternate embodiment could be manufactured into a frame with finger locks neatly and flushly incorporated into the frame's edges. In such an embodiment, rods 934 could be replaced by slots through the frame's side edges, running parallel to the plane of the frame and bisecting the frame edges into two layers over part of their vertical length. In this version, the cams could have a female fork connection to the axle with the crossbar being male rather than vice versa, and a first vertically running abutment would be placed in the aforementioned slots immediately between the cam and a pair of second abutments placed on the crossbar near the axle, so that the first abutment would be clamped between the cam and the second abutments when the levers are up, precluding movement of the crossbar.

Figure 68:
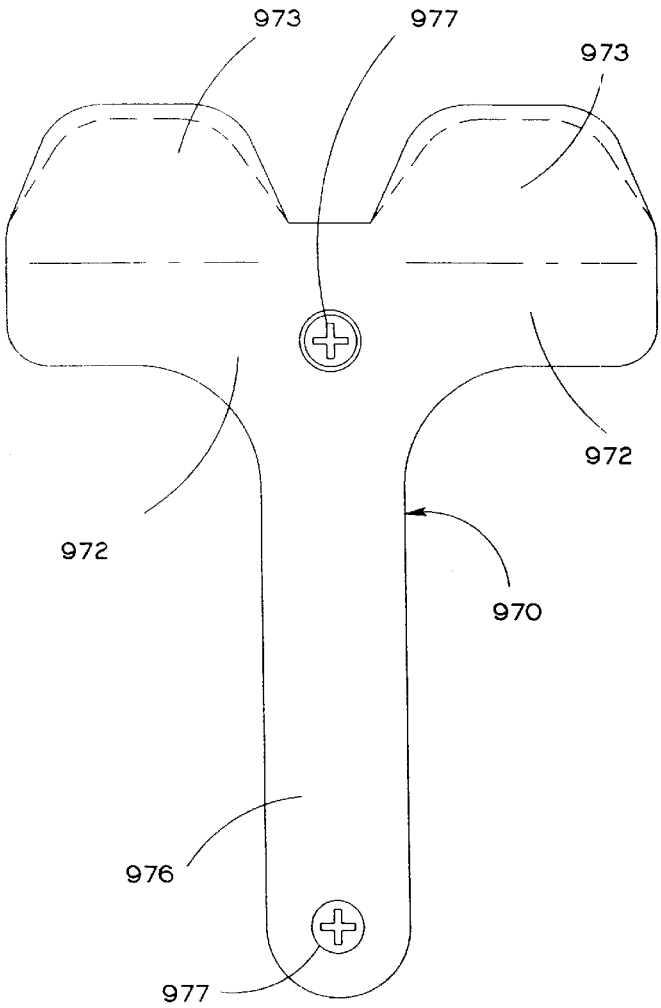
FIG. 68 is a front transparent view of an embodiment that allows for placement of an item off center from a stud, showing how the embodiment is fixed to the wall.
Figure 69:
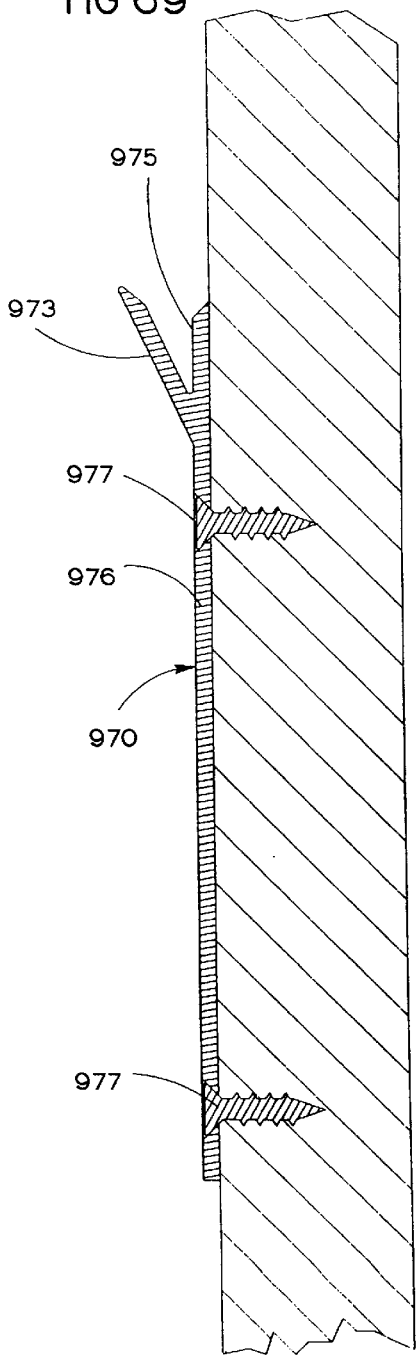
FIG. 69 is a side sectional view of the embodiment of FIG. 68.

FIG. 68 and 69 show a stud extender 970 that allows for placement of an item off-center from a stud while nevertheless utilizing the stud's support. FIG. 68 shows a front view, and FIG. 69 a side cross section of this embodiment, the main purpose of which is to allow an item to be placed at a desired lateral position on the wall, even though there is not a stud exactly at the centerline through that position. This embodiment includes a horizontal bar 972 and a vertical bar 976, and is formed to attach to a stud with screws or nails at vertically aligned points of attachment 977. The dual points of secure attachment inhibit the hanger from twisting or ripping out of the wall, even when the load's center of gravity is not in line with the hanger. In use, the horizontal hanging wire typically placed on the back of frames, or a channel or recess found on many frames, may be placed on hooks 973 and slid horizontally left or right to a desired position. Keepers 975 prevent a wire from slipping past horizontal bar 972 and wedging behind it. A horizontal bar 972 long enough in relation to the weight and horizontal length of the item to be hung to allow decent lateral play without the item falling out of level, should be selected.

Also (not shown), means for allowing manual vertical adjustment of a stud extender can be provided, for example by doubling the vertical length of the vertical bar and adding a second, independent vertical bar underneath it and about half its size, with corresponding vertical slots (for inserting two screws or nails through) extending the length of both vertical bars. A screw and wingnut or alternate means can be placed through the slots above the higher of the two fixed screws (or nails), for tightly securing the two vertical bars together at a desired vertical position.

In most applications of the invention, the gap and angle of pitch between the hanging item and the support (which tend to increase with the weight of the hanging item, and as the hanging item is adjusted to hang toward its highest vertical location) should be minimized. However, as the vertical size of the hanging item increases, the aesthetically acceptable gap between the hanging item and wall also generally increases somewhat. Minimizing the thickness of the parts of the hanger between the hanging item and wall, and/or adding bumpers help in most cases.

The particular embodiments discussed in detail herein to illustrate the principles of the invention are not meant to limit in any embodiments way the scope of the claims that follow, or their legal equivalents. For example, many of the particular nuances and features that are described with regard to only certain embodiments herein are obviously applicable to, or interchangeable with those of, other embodiments. Various additional and/or substitutable features that are well known in the art need not discussed herein, as it will become readily apparent to anyone of ordinary skill in the art that such features are applicable without need for description thereof.

I claim:

1. An adjustable linear locking assembly comprising:

(a) an elongate member;

(b) a sliding element aligned with said elongate member and linearly slidingly connected thereto; and (c) a remotely activatable rolling member clamp connecting said sliding element to said elongate member.

2. The assembly of claim 1, wherein said clamp includes a remote trigger, and said clamp is fixedly attached to said elongate member.

3. The assembly of claim 2, wherein said sliding element includes a rigid rod or taut cable that is aligned with said elongate member and passes through said clamp.

4. The assembly of claim 3, wherein said trigger is aligned with said elongate member.

5. The assembly of claim 1, wherein said clamp includes a rolling member detent means.

6. The assembly of claim 1, a wherein said clamp is fixedly attached to said sliding element, and said clamp includes a portion that is formed to catch a support member.

7. An adjustable mounting device comprising:

(a) a dovetailed vertical track formed to be fixedly incorporated or attached to an item;

(b) an interface formed to vertically slidingly engage the dovetailing of said dovetailed vertical track, and formed to engage a support; and, (c) a substantially continuous, automatic lock formed between said interface and said track.

8. The device of claim 7, wherein the item has a rear, a top, and a bottom, and said track is formed to be fixedly incorporated or attached to approximately the top and bottom of the rear of the item.

9. The device of claim 8, wherein said track includes oblong slots for attaching screws or nails into the top and bottom of the rear of the item.

10. The device of claim 8, further comprising a bottom extender formed to snugly and slidingly engage with the dovetailing of said track.

11. The device of claim 8, wherein a central cutout is defined in said track, and said lock includes a clamp body formed to fixedly insert in said cutout.

12. The device of claim 8, wherein said lock is fixedly attached to said interface and slidingly connected to said track.

13. The device of claim 7, wherein the dovetail of said track is slanted.

14. The device of claim 7, wherein the dovetail of said track is right-angled.

15. An adjustable linear locking assembly, comprising:

(a) a support member;

(b) an elongate member;

(c) a clamp body slidingly connected to said elongate member and formed to engage said support member, said clamp body including a sloped interior face having a first end that is a first distance from said elongate member and a second end that is a second distance from said elongate member;

(d) a trigger including a portion between said sloped interior face and said elongate member, and including a trigger extension protruding out from said clamp body, said trigger extension being formed to catch said support member when said elongate member is firmly pressed toward said support member; and (e) at least one rolling member in rolling contact between said elongate member and said sloped interior face, said at least one rolling member having a diameter that is lesser than said first distance t and greater than said second distance.

16. The assembly of claim 15, wherein said trigger includes a rolling member detent that surrounds at least two sides of said at least one rolling member.

17. The assembly of claim 15, further comprising a bias means that directly or indirectly urges said rolling member in the direction from said first end toward said second end of said sloped interior face.

18. The assembly of claim 15, wherein said support member is a horizontal support member.

19. The assembly of claim 15, wherein said elongate member is a track, said sloped interior face defines a surface of linear extrusion, and said at least one rolling member is cylindrical.

20. The assembly of claim 15, wherein said elongate member is a rod, said sloped interior face is conical, and said at least one rolling member is spherical.

21. An adjustable mounting device comprising:

(a) a vertical track formed to be fixedly incorporated or attached to an item;

(b) an interface vertically slidingly connected to said track and formed to engage a support member; and, (c) a remotely activatable lock connecting said interface and said track, selected from the group consisting of: a rolling member clamp, a node in cone clamps, and a biased rod in collar clamp wherein the rod is separate from the track.

22. The device of claim 21, wherein said lock is fixedly attached to said interface and slidingly connected to said track.

23. The device of claim 22, wherein said lock is a rolling member clamp.

24. The device of claim 23, wherein said clamp includes a cylindrical rolling member.

25. The device of claim 21, wherein said lock is fixedly connected to said track, and further comprising a remote trigger that extends to said lock.

26. The device of claim 25, wherein said interface includes a rigid vertical rod or taut cable aligned with said track and extending through said lock, and wherein said trigger comprises a rigid rod aligned with said track.

* * * * *